US011665482B2

(12) United States Patent
Qi et al.

(10) Patent No.: US 11,665,482 B2
(45) **Date of Patent: *May 30, 2023**

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 84 days.

This patent is subject to a terminal disclaimer.

(21) Appl. No.: 17/219,777

(22) Filed: Mar. 31, 2021

(65) Prior Publication Data

US 2021/0258696 A1 Aug. 19, 2021

Related U.S. Application Data

(63) Continuation-in-part of application No. 17/170,817, filed on Feb. 8, 2021, which is a continuation of (Continued)

(30) Foreign Application Priority Data

Dec. 23, 2011 (CN) ..... 201110438083.9

(51) Int. Cl.
*H04R 9/06* (2006.01)
*H04R 1/00* (2006.01)
(Continued)

(52) U.S. Cl.
CPC ..... *H04R 9/063* (2013.01); *H04R 1/00* (2013.01); *H04R 1/10* (2013.01); *H04R 9/02* (2013.01);
(Continued)

(58) Field of Classification Search
CPC . H04R 9/063; H04R 1/00; H04R 1/10; H04R 1/1075; H04R 9/02; H04R 9/06;
(Continued)

(56) References Cited

U.S. PATENT DOCUMENTS 2,075,198 A 3/1937 Hand
4,418,248 A 11/1983 Mathis
(Continued)

FOREIGN PATENT DOCUMENTS

CN 1842019 A 10/2006
CN 1976541 A 6/2007
(Continued)

OTHER PUBLICATIONS

Notice of Reasons for Rejection in Japanese Application No. 2020-088413 dated Aug. 3, 2021, 7 pages.
(Continued)

*Primary Examiner* — Norman Yu
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where at least two second rods inside it converge to its center. The vibration conductive plate is fixed with the vibration board; the first torus is fixed on a magnetic system, and the second torus comprises a fixed voice coil, which is driven by the
(Continued)

magnetic system. The bone conduction speaker in the present disclosure and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 37 Drawing Sheets

Related U.S. Application Data application No. 17/161,717, filed on Jan. 29, 2021, which is a continuation-in-part of application No. 16/159,070, filed on Oct. 12, 2018, now Pat. No. 10,911,876, which is a continuation of application No. 15/197,050, filed on Jun. 29, 2016, now Pat. No. 10,117,026, which is a continuation of application No. 14/513,371, filed on Oct. 14, 2014, now Pat. No. 9,402,116, which is a continuation of application No. 13/719,754, filed on Dec. 19, 2012, now Pat. No. 8,891,792, said application No. 17/161,717 is a continuation-in-part of application No. 16/833,839, filed on Mar. 30, 2020, which is a continuation of application No. 15/752,452, filed as application No. PCT/CN2015/086907 on Aug. 13, 2015, now Pat. No. 10,609,496, application No. 17/219,777 is a continuation-in-part of application No. 16/822,151, filed on Mar. 18, 2020, which is a continuation of application No. PCT/CN2018/105161, filed on Sep. 12, 2018.

(51) Int. Cl.
*H04R 9/02* (2006.01)
*H04R 31/00* (2006.01)
*H04R 1/10* (2006.01)
*H04R 25/00* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search
CPC ..... H04R 9/025; H04R 9/066; H04R 11/02; H04R 31/00; H04R 25/606; H04R 2225/021; H04R 2225/023; H04R 2225/67; H04R 2400/03; H04R 2420/07; H04R 2460/13; H04R 2499/11; H04R 25/48
USPC ..... 381/151, 380, 162, 182, 326; 340/7.6; 600/25
See application file for complete search history.

(56) References Cited

U.S. PATENT DOCUMENTS

| | | | |
|---|---|---|---|
| 5,127,060 | A | 6/1992 | Paddock |
| 5,673,328 | A | 9/1997 | Wandl et al. |
| 5,734,132 | A | 3/1998 | Proni |
| 5,790,684 | A | 8/1998 | Niino et al. |
| 6,389,148 | B1 | 5/2002 | Yoo et al. |
| 6,449,596 | B1 | 9/2002 | Ejima |
| 6,738,485 | B1 | 5/2004 | Boesen |
| 6,850,138 | B1 | 2/2005 | Sakai |
| 7,283,967 | B2 | 10/2007 | Nishio et al. |
| 8,891,792 | B2 | 11/2014 | Qi et al. |
| 9,084,048 | B1 | 7/2015 | Gottlieb |
| 9,226,075 | B2 | 12/2015 | Lee |
| 9,253,563 | B2 | 2/2016 | Fukuda |
| 9,479,884 | B2 | 10/2016 | Kim |
| 9,742,887 | B2 | 8/2017 | Hosoi et al. |
| 2001/0024508 | A1 | 9/2001 | Croft, III |
| 2003/0012395 | A1 | 1/2003 | Fukuda |
| 2003/0053651 | A1 | 3/2003 | Koura et al. |
| 2004/0105566 | A1 | 6/2004 | Matsunaga et al. |
| 2004/0131218 | A1 | 7/2004 | Dedieu et al. |
| 2006/0098829 | A1 | 5/2006 | Kobayashi |
| 2006/0165246 | A1 | 7/2006 | Lee et al. |
| 2006/0262954 | A1 | 11/2006 | Lee et al. |
| 2007/0053536 | A1 | 3/2007 | Westerkull |
| 2008/0166007 | A1 | 7/2008 | Hankey et al. |
| 2008/0174665 | A1 | 7/2008 | Enstad et al. |
| 2008/0208538 | A1 | 8/2008 | Visser et al. |
| 2009/0060224 | A1 | 3/2009 | Hayakawa |
| 2009/0097681 | A1* | 4/2009 | Puria ..... H04R 1/265 381/318 |
| 2009/0209806 | A1 | 8/2009 | Hakansson |
| 2009/0226004 | A1 | 9/2009 | Sørensen |
| 2009/0240495 | A1 | 9/2009 | Ramakrishnan et al. |
| 2009/0245553 | A1 | 10/2009 | Parker |
| 2009/0285417 | A1 | 11/2009 | Shin et al. |
| 2009/0304198 | A1 | 12/2009 | Herre et al. |
| 2010/0046783 | A1 | 2/2010 | Huang |
| 2010/0272289 | A1 | 10/2010 | Kornagel et al. |
| 2010/0322423 | A1 | 12/2010 | Fukui et al. |
| 2010/0329485 | A1 | 12/2010 | Fukuda |
| 2011/0022119 | A1 | 1/2011 | Parker |
| 2012/0020501 | A1* | 1/2012 | Lee ..... H04R 1/1016 381/151 |
| 2012/0083860 | A1 | 4/2012 | Hakansson |
| 2012/0243715 | A1 | 9/2012 | Pedersen |
| 2012/0281861 | A1 | 11/2012 | Lin |
| 2012/0286765 | A1* | 11/2012 | Van den Heuvel .. H04R 25/606 600/25 |
| 2012/0302822 | A1 | 11/2012 | Van Himbeeck et al. |
| 2013/0121513 | A1 | 5/2013 | Adachi |
| 2013/0156241 | A1 | 6/2013 | Jinton |
| 2013/0163791 | A1 | 6/2013 | Qi |
| 2013/0185035 | A1 | 7/2013 | Tsujino et al. |
| 2013/0308796 | A1 | 11/2013 | Lee |
| 2013/0315402 | A1 | 11/2013 | Visser et al. |
| 2014/0064533 | A1 | 3/2014 | Kasic, II |
| 2014/0270293 | A1 | 9/2014 | Ruppersberg et al. |
| 2015/0130945 | A1 | 5/2015 | Yu et al. |
| 2015/0208183 | A1 | 7/2015 | Bern |
| 2015/0264473 | A1 | 9/2015 | Fukuda |
| 2015/0281865 | A1 | 10/2015 | Gottlieb |
| 2016/0037243 | A1 | 2/2016 | Lippert et al. |
| 2016/0127839 | A1 | 5/2016 | French et al. |
| 2016/0127841 | A1 | 5/2016 | Horii |
| 2017/0006385 | A1 | 1/2017 | Kim |
| 2017/0374479 | A1 | 12/2017 | Qi et al. |
| 2018/0130485 | A1 | 5/2018 | Park et al. |
| 2018/0146284 | A1 | 5/2018 | Benattar et al. |
| 2018/0227692 | A1 | 8/2018 | Lee et al. |
| 2019/0014425 | A1 | 1/2019 | Liao et al. |
| 2019/0103088 | A1 | 4/2019 | Zheng et al. |

FOREIGN PATENT DOCUMENTS

| | | | |
|---|---|---|---|
| CN | 101227763 | A | 7/2008 |
| CN | 101276587 | A | 10/2008 |
| CN | 202435598 | U | 9/2012 |
| CN | 102737646 | A | 10/2012 |
| CN | 105007551 | A | 10/2015 |
| CN | 105101019 | A | 11/2015 |
| CN | 105101020 | A | 11/2015 |
| CN | 105142077 | A | 12/2015 |
| CN | 204887455 | U | 12/2015 |
| CN | 205142506 | U | 4/2016 |
| EP | 1404146 | A1 | 3/2004 |
| EP | 2234413 | B1 | 11/2020 |
| JP | S5574290 | A | 6/1980 |
| JP | H06261389 | A | 9/1994 |
| JP | 07007797 | A | 1/1995 |
| JP | 2003264882 | A | 9/2003 |

(56) References Cited

FOREIGN PATENT DOCUMENTS

| | | | |
|---|---|---|---|
| JP | 2004064457 | A | 2/2004 |
| JP | 2004158961 | A | 6/2004 |
| JP | 2005151183 | A | 6/2005 |
| JP | 2006025333 | A | 1/2006 |
| JP | 2007129364 | A | 5/2007 |
| JP | 2008017398 | A | 1/2008 |
| JP | 2008054063 | A | 3/2008 |
| JP | 2010078941 | A | 4/2010 |
| JP | 2011160175 | A | 8/2011 |
| JP | 2012019322 | A | 1/2012 |
| JP | 2013243564 | A | 12/2013 |
| KR | 20010111653 | A | 12/2001 |
| KR | 20050930183 | A | 3/2005 |
| KR | 20070122104 | A | 12/2007 |
| KR | 20080101166 | A | 11/2008 |
| KR | 20090091378 | A | 6/2009 |
| KR | 20090082999 | A | 8/2009 |
| KR | 20110037483 | A | 4/2011 |
| KR | 200476572 | Y1 | 3/2015 |
| RU | 2439719 | C2 | 1/2012 |
| WO | 0219759 | A1 | 3/2002 |
| WO | 2006088410 | | 8/2006 |
| WO | 2009042385 | A1 | 4/2009 |
| WO | 2010114195 | A1 | 10/2010 |

OTHER PUBLICATIONS

The Extended European Search Report in European Application No. 18933628.2 dated Jul. 28, 2021, 8 pages.
Notice of Preliminary Rejection in Korean Application No. 10-2022-7003237 dated Apr. 13, 2022, 14 pages.
Notice of Reasons for Rejection in Japanese Applcation No. 2021-514610 dated Aprii 26, 2022, 8 pages
Decision to Grant a Patent in Japanese Application No. 2021-514610 dated Aug. 16, 2022; 5 pages.
M. Gripper et al., Using the Callsign Acquisition Test (CAT) to Compare the Speech Intelligibility of Air Versus Bone Conduction, international Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
First Office Action in Chinese Application No. 201110438083.9 dated Sep. 27, 2012, 10 pages.
The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2015/086907 dated May 6, 2016, 10 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
Decision to Grant a Patent in Japanese Application No. 2018-146021 dated Jul. 21, 2020, 5 pages.
Brief Summary of a Notice of Preliminary Rejection in Republic of Korea Application No. 10-2018-7007115 dated May 20, 2021, 9 pages.
International Search Report in PCT/CN2018/105161 dated Jun. 13, 2019, 6 pages.
Written Opinion in PCT/CN2018/105161 dated Jun. 13, 2019, 4 Pages.
Decision of Grant in Russian Application No. 2022112225 dated Nov. 16, 2022, 23 pages.
Notice of Reasons for Refusal in Japanese Application No. 2020-088413 dated Sep. 6, 2022, 11 pages.
The Second Notice of Preliminary Rejection in Korean Application No. 10-2022-7003237 dated Oct. 11, 2022, 14 pages.
Notice of Reasons for Refusal in Japanese Application No. 2021-179711 dated Oct. 18, 2022, 8 pages.
The Office Action in Brazilian Application No. BR112018002854-1 dated Feb. 24, 2023, 8 pages.
Paula Henry et al., Bone Conduction: Anatomy, Physiology, and Communication, Army Research Laboratory, 2007, 206 pages.
Notice of Preliminary Rejection in Korean Application No. 10-2021-7010769 dated Mar. 2, 2023, 12 pages.
Ian Daniel Hasler, Circuits and Systems for Intelligent Hearing Aids, The University of Liverpool, 2009, 179 pages.

* cited by examiner

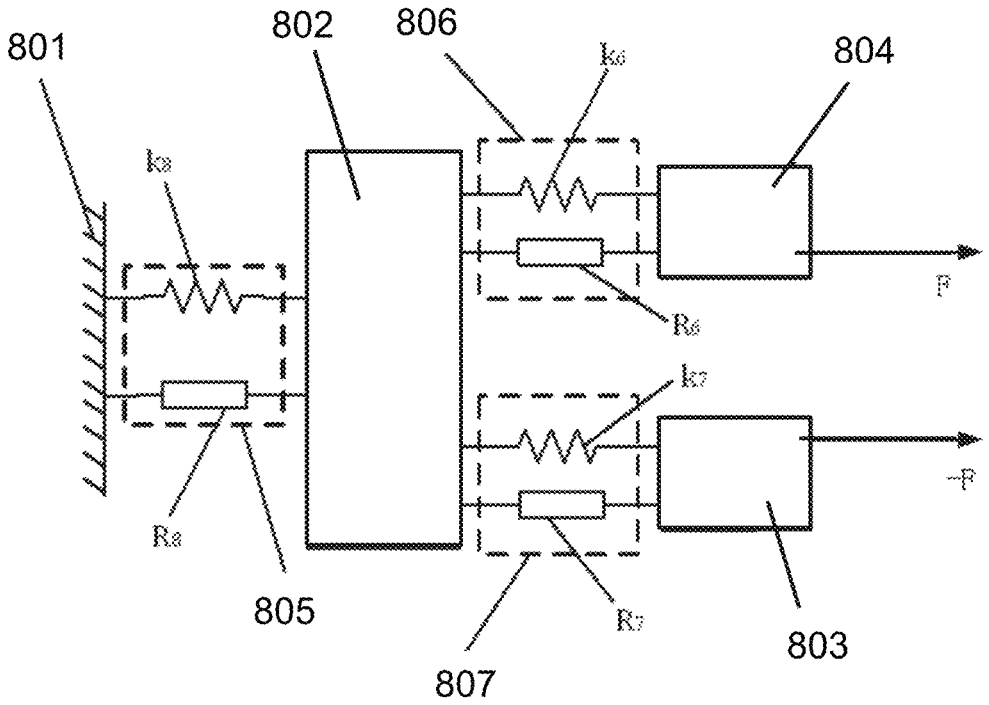
FIG. 8-A

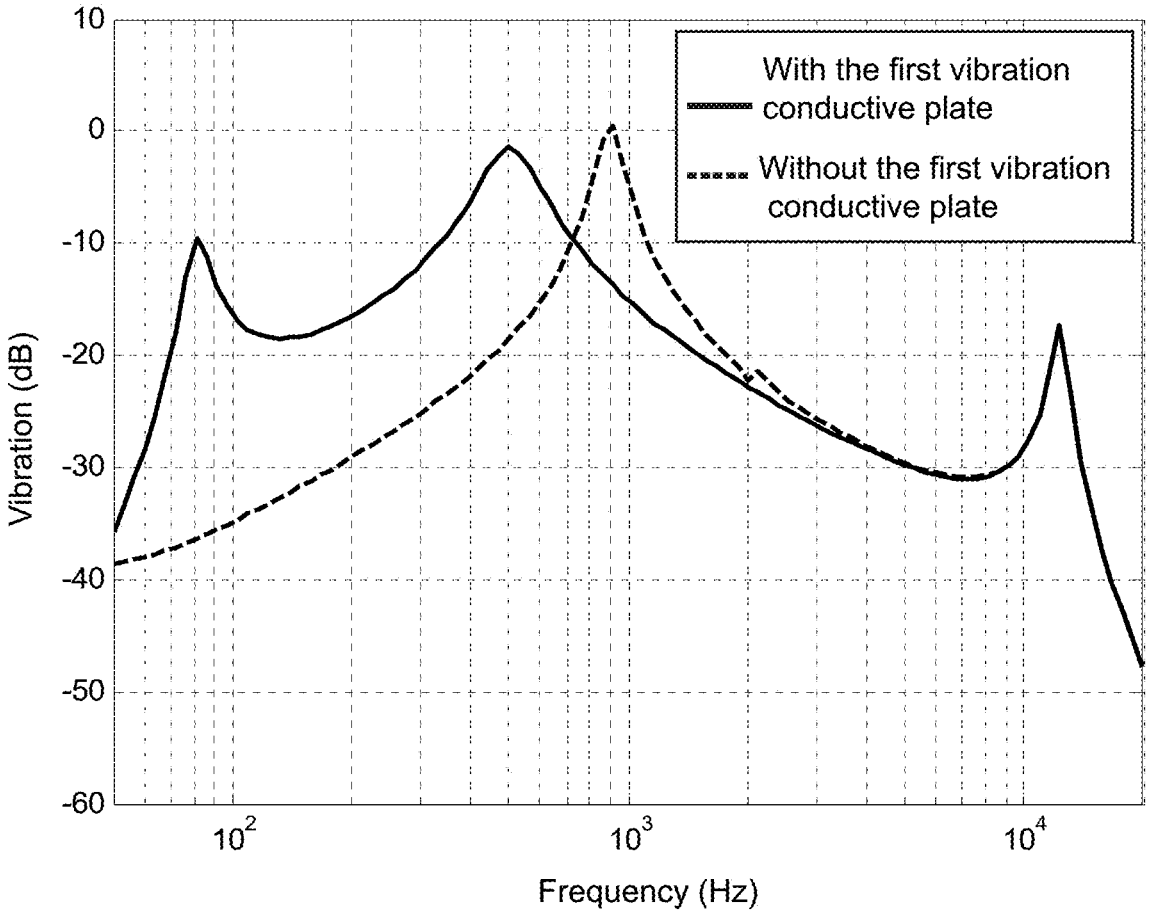
FIG. 8-B

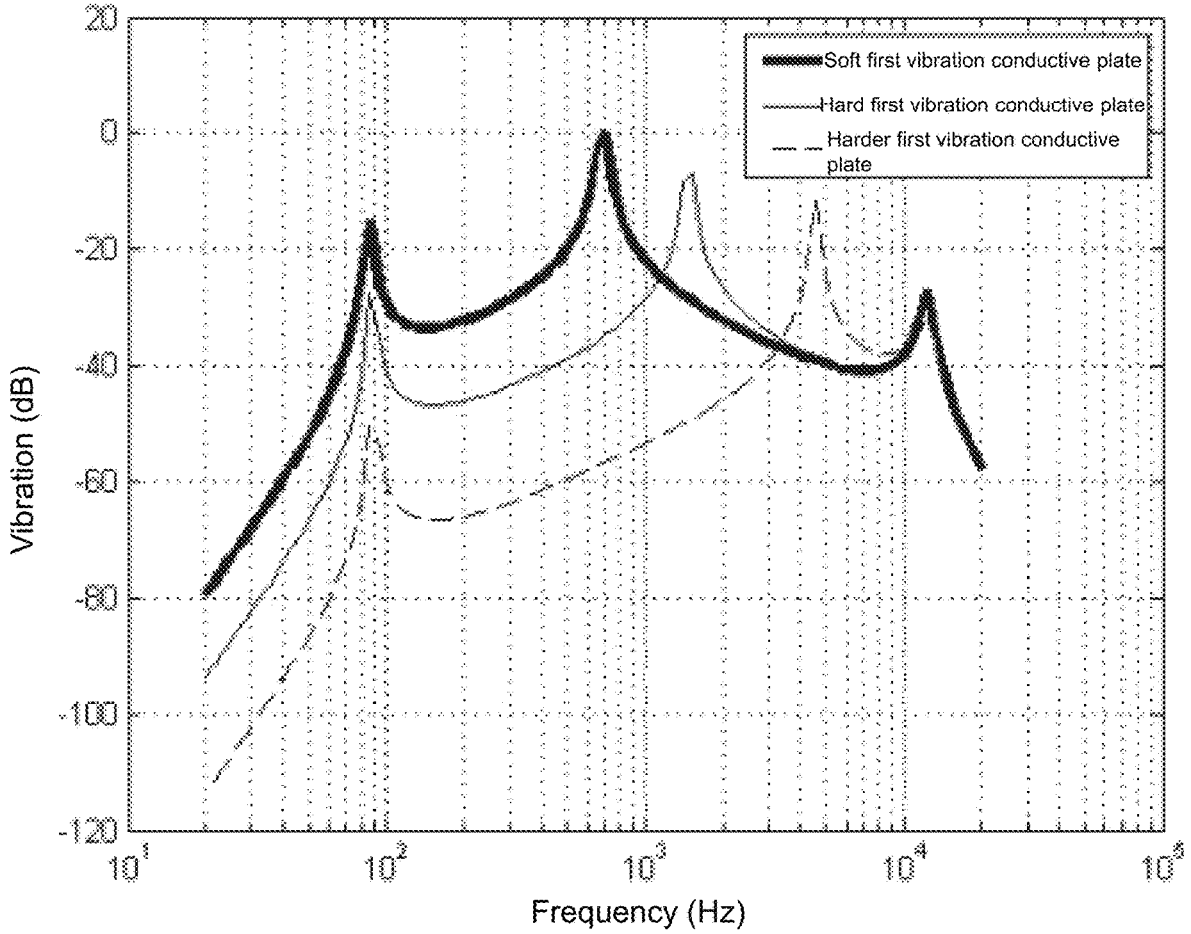
FIG. 8-C

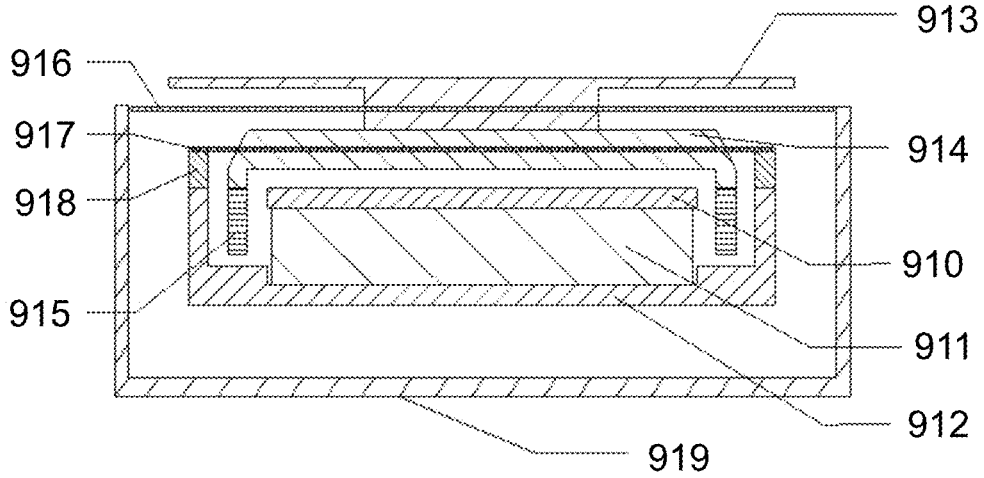
FIG. 9-A

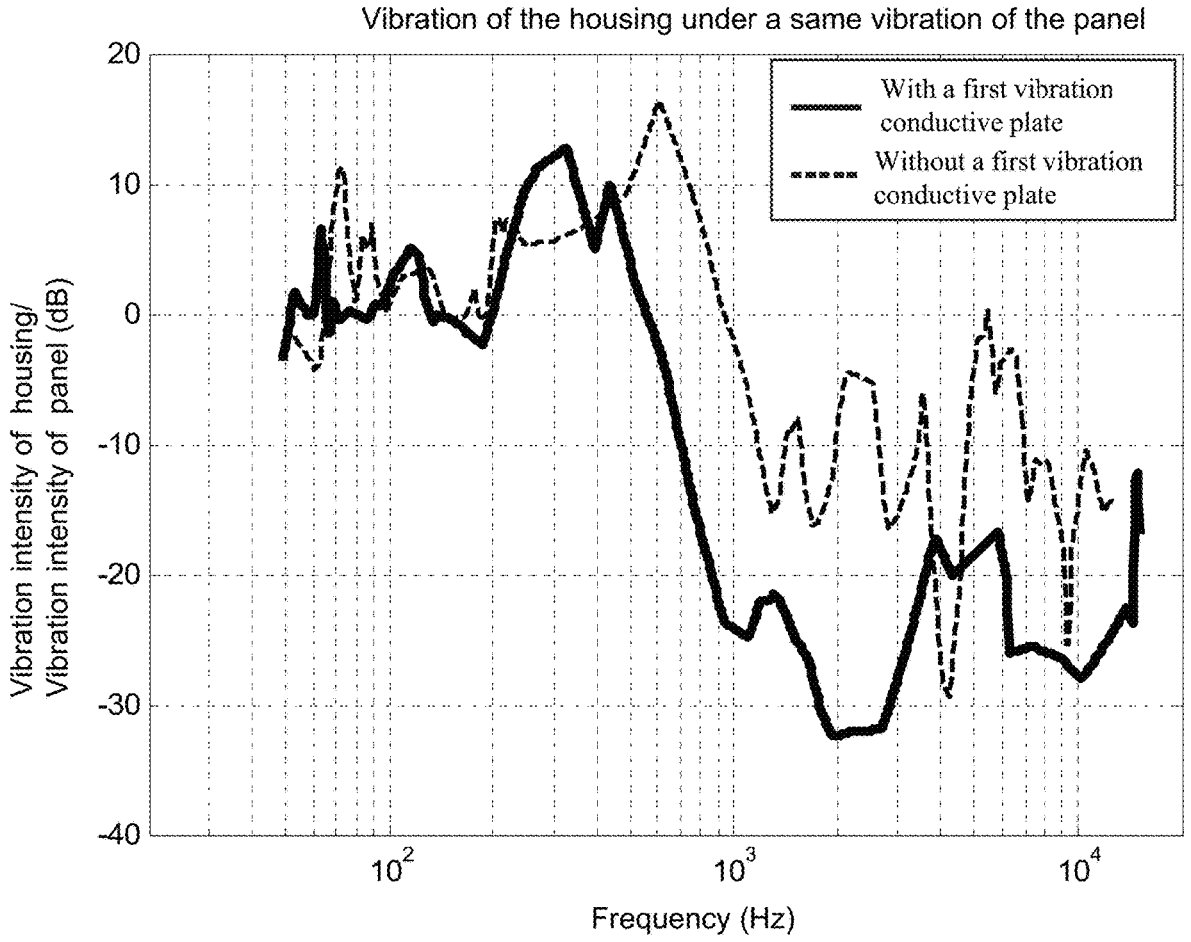
FIG. 9-B

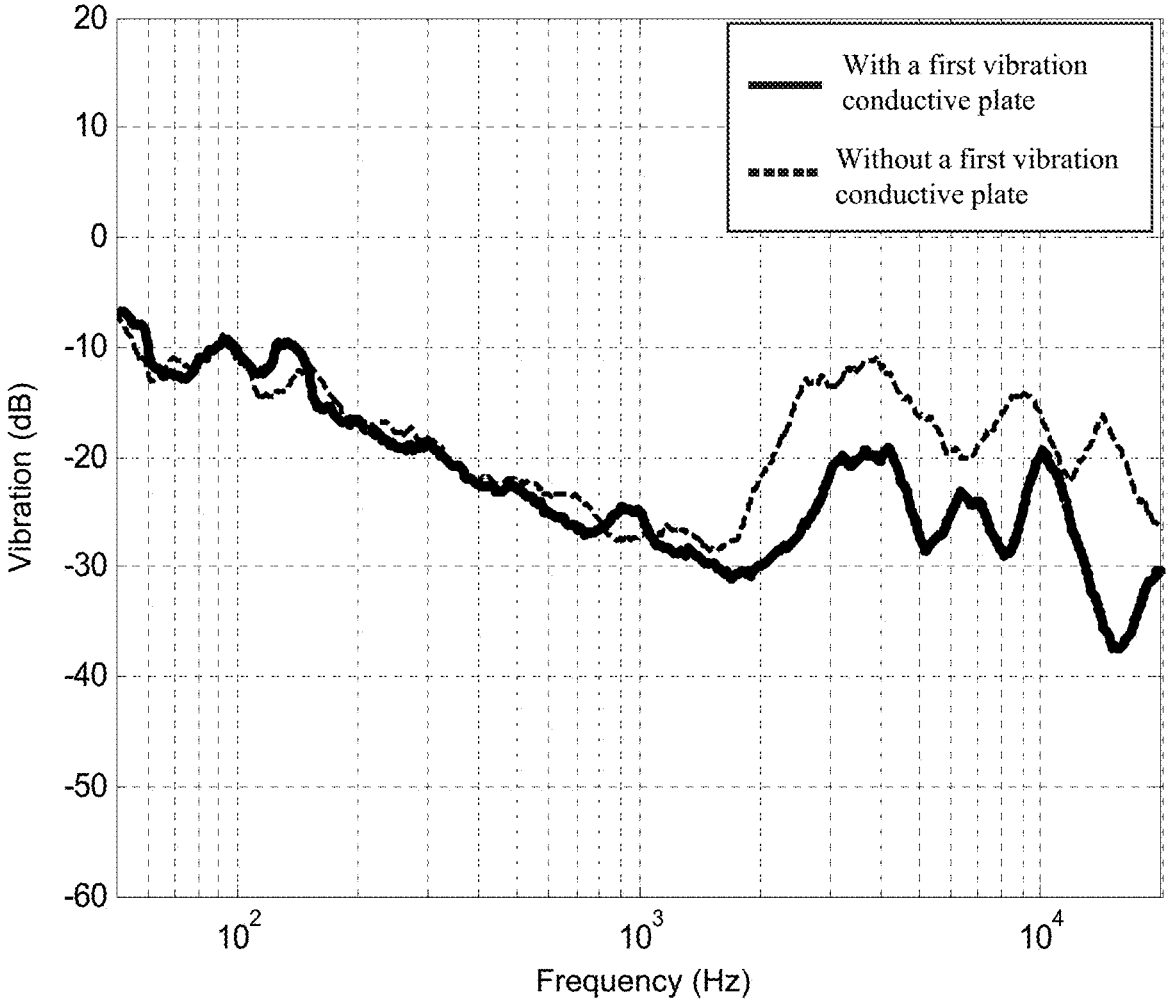
FIG. 9-C

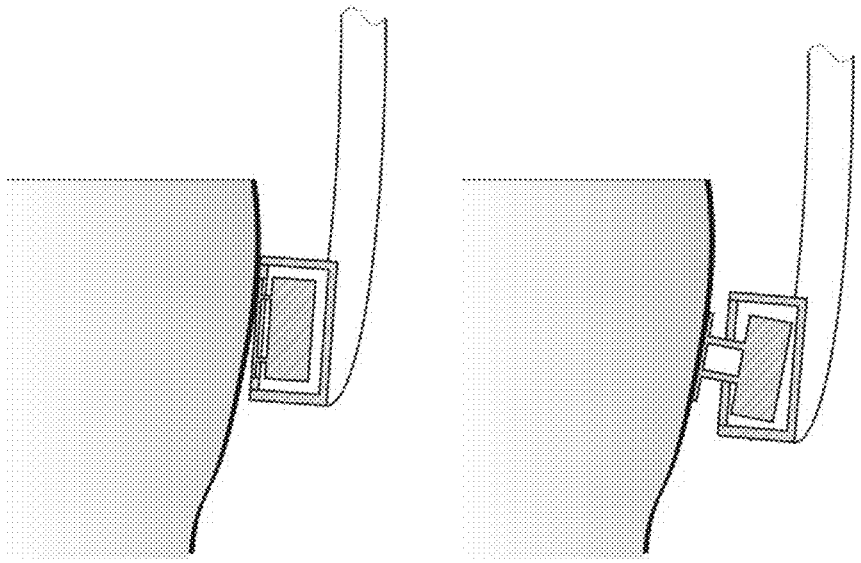
FIG. 11-A

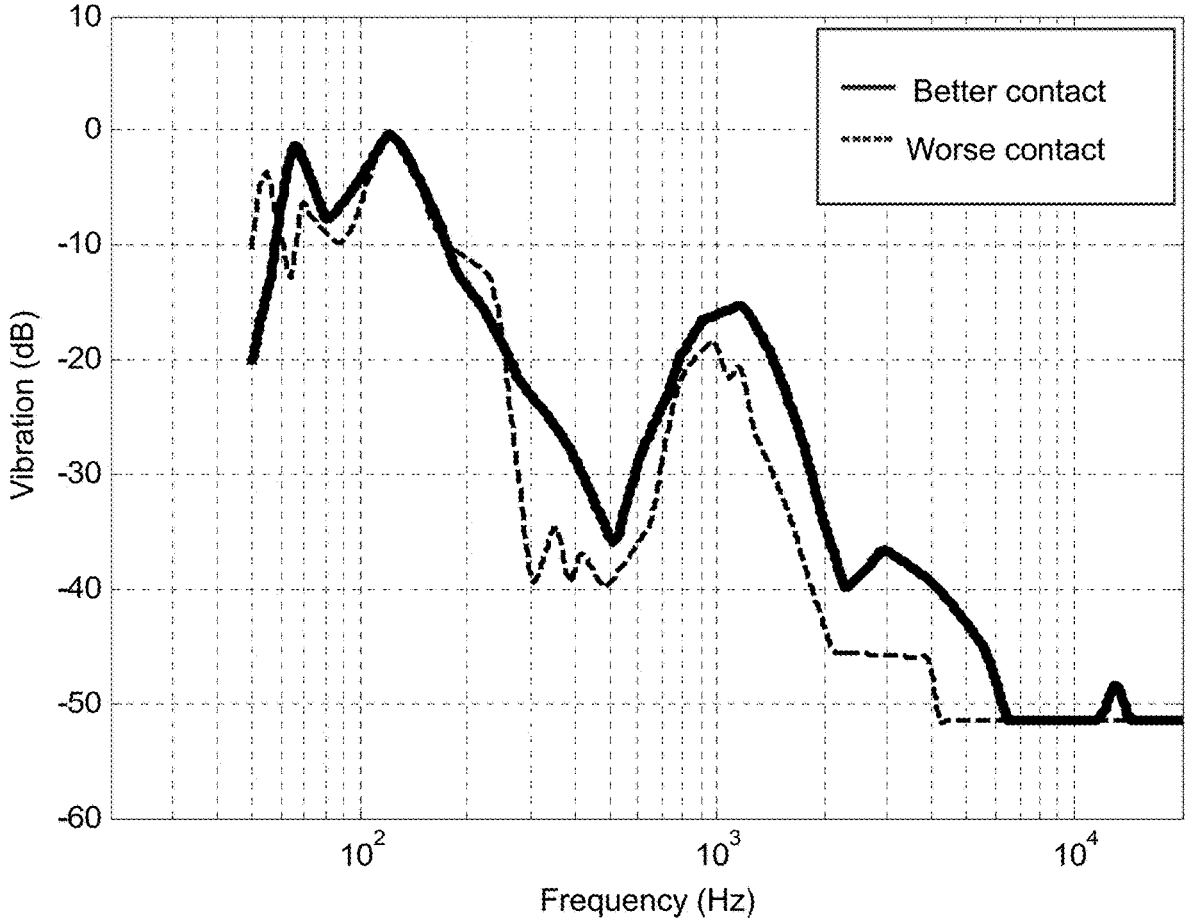
FIG. 11-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 16/822,151 filed on Mar. 18, 2020, which is a continuation of International Application No. PCT/CN2018/105161 filed on Sep. 12, 2018. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present disclosure is stated here, together with attached figures.

Figure 1:
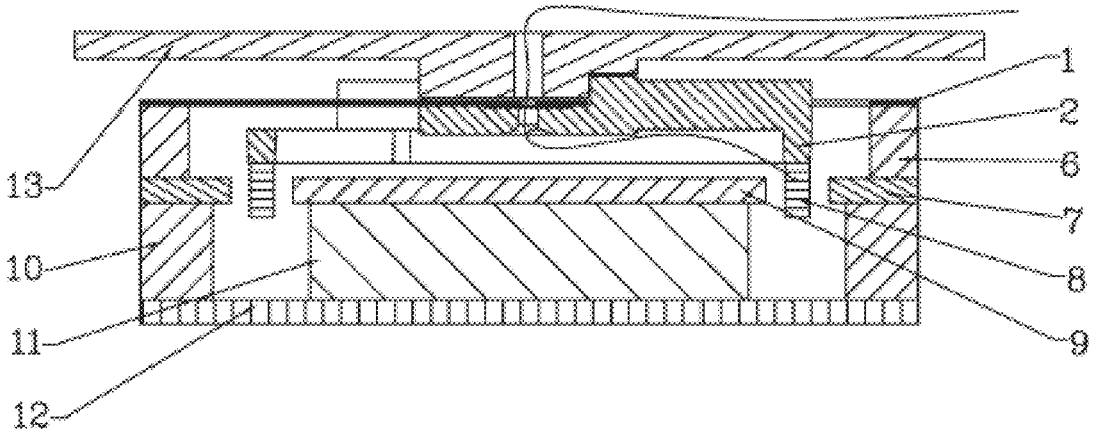
FIG. 1 illustrates a longitudinal section view of the bone conduction speaker in the present disclosure.
Figure 2:
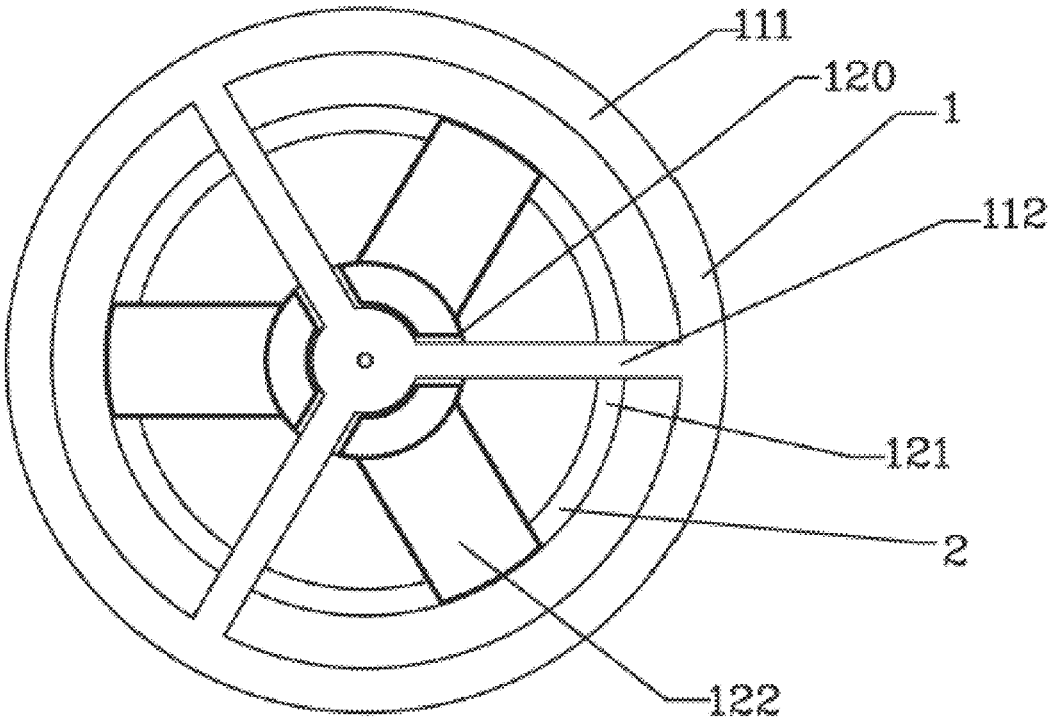
FIG. 2 illustrates a perspective view of the vibration parts in the bone conduction speaker in the present disclosure.
Figure 3:
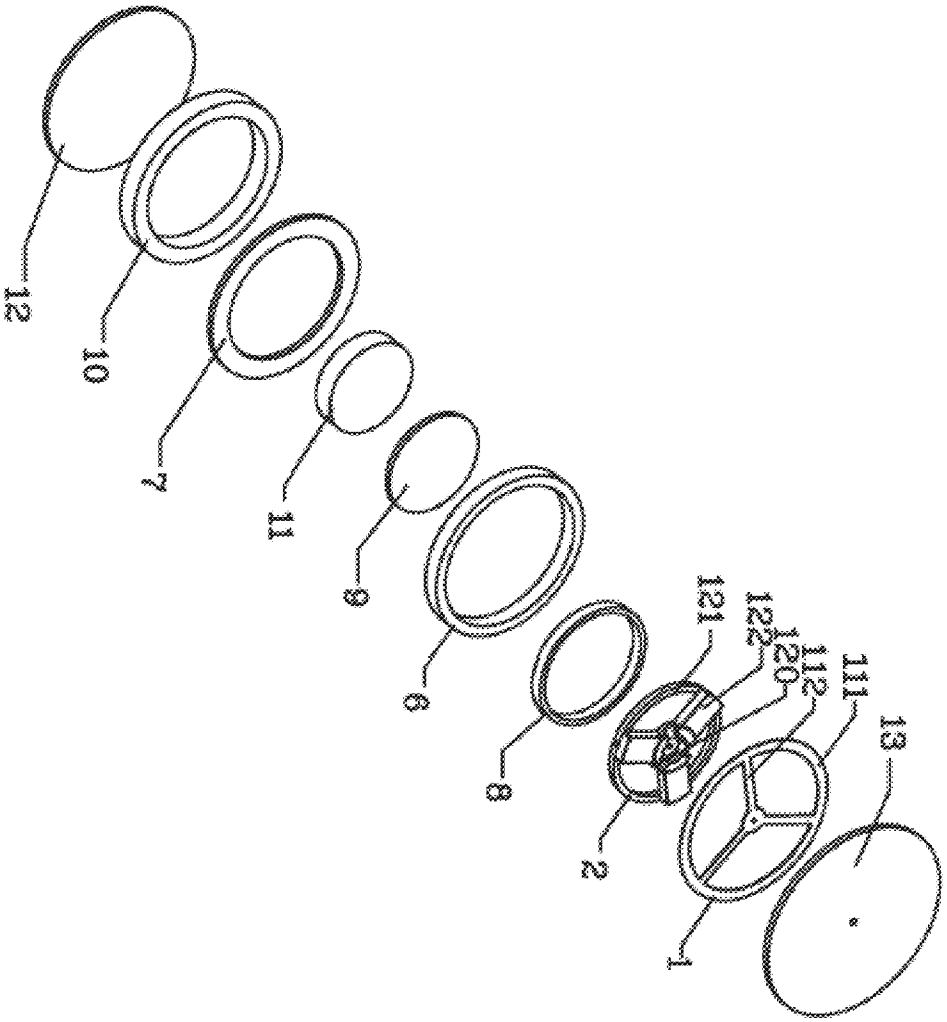
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
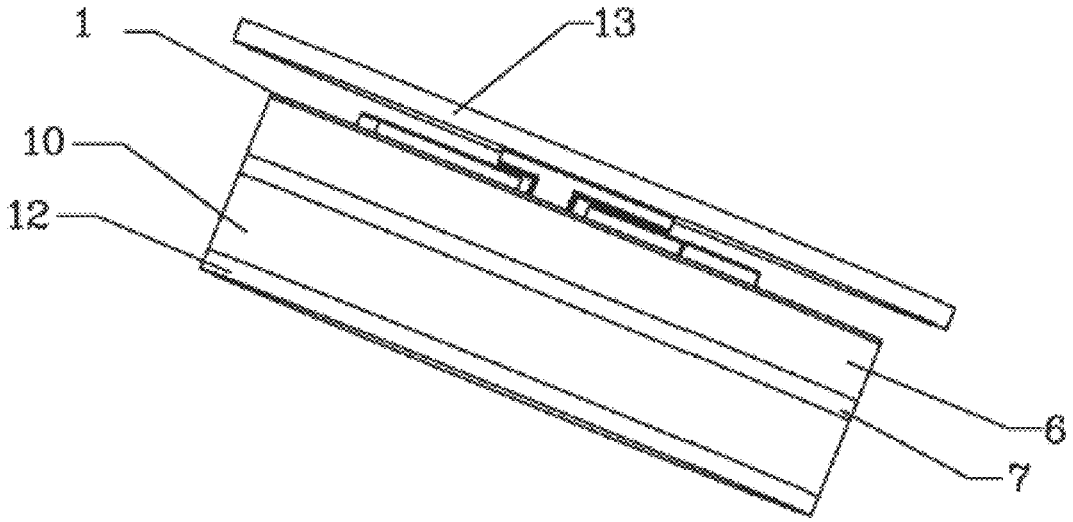
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
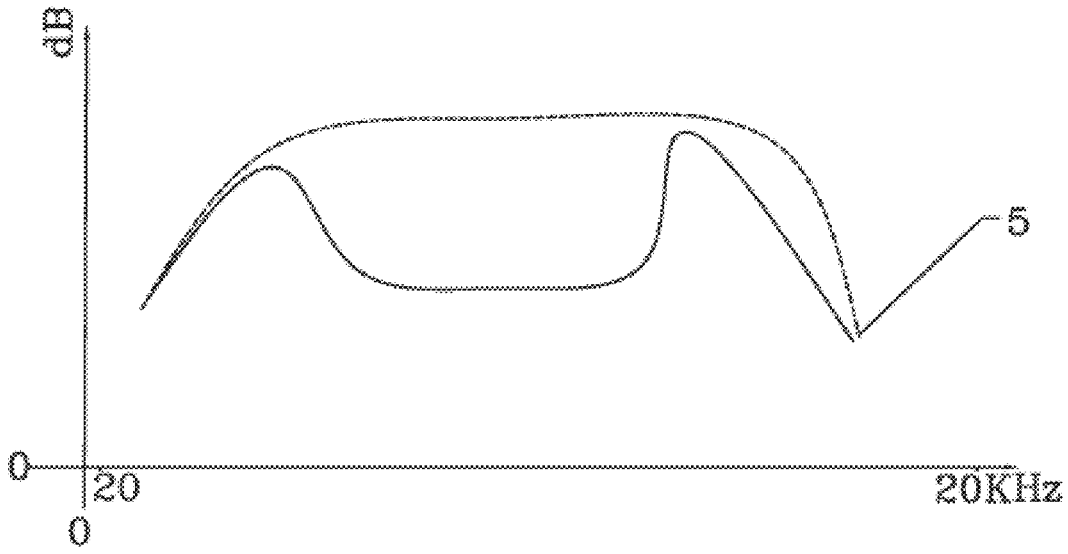
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20

Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
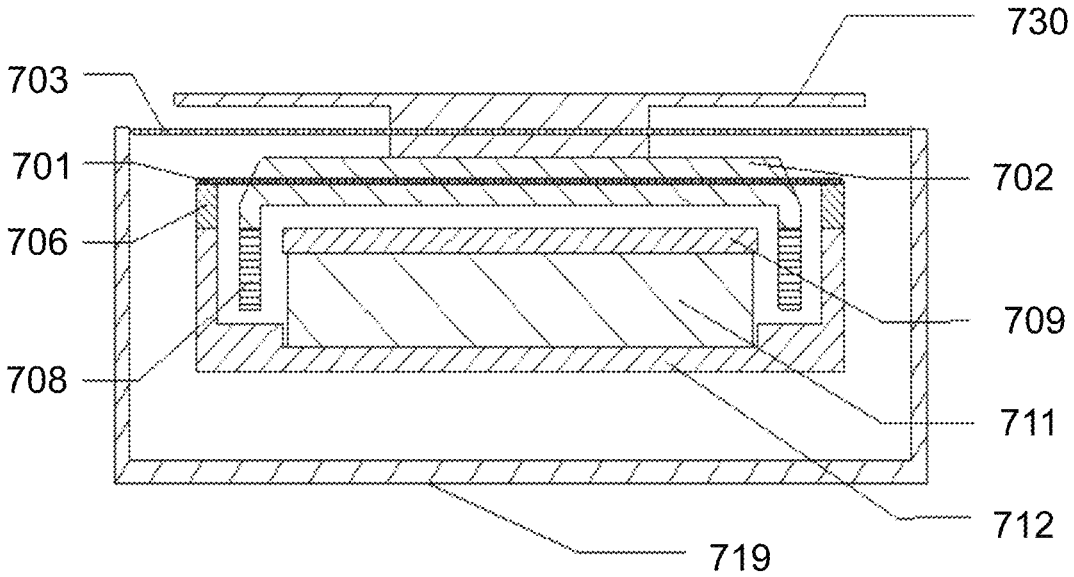
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x_6''+R_6(x_6-x_5)'+k_6(x_6-x_5)=F, \tag{1}$$

$$x_7''+R_7(x_7-x_5)'+k_7(x_7-x_5)=-F, \tag{2}$$

$$m_5x_5''-R_6(x_6-x_5)'-R_7(x_7-x_5)'+R_8x_5'+k_8x_5-k_6(x_6-x_5)-k_7(x_7-x_5)=0, \tag{3}$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is to displacement of the voice coil, and the amplitude of the panel 802 may be:

$$A_5 = \frac{\left(-m_6\omega^2(jR_7\omega - k_7) + m_7\omega^2(jR_6\omega - k_6)\right)}{\left(\begin{array}{c}(-m_5\omega^2 - jR_8\omega + k_8)(-m_6\omega^2 - jR_6\omega + \\ k_6)(-m_7\omega^2 - jR_7\omega + k_7) - \\ m_6\omega^2(-jR_6\omega + k_6)(-m_7\omega^2 - jR_7\omega + k_7) - \\ m_7\omega^2(-jR_7\omega + k_7)(-m_6\omega^2 - jR_6\omega + k_6)\end{array}\right)} f_0, \quad (4)$$

wherein $\omega$ is an angular frequency of the vibration, and $f_0$ is a unit driving force.

The vibration system of the bone conduction speaker may transfer vibrations to a user via a panel (e.g., the panel 730 shown in FIG. 7). According to the Equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
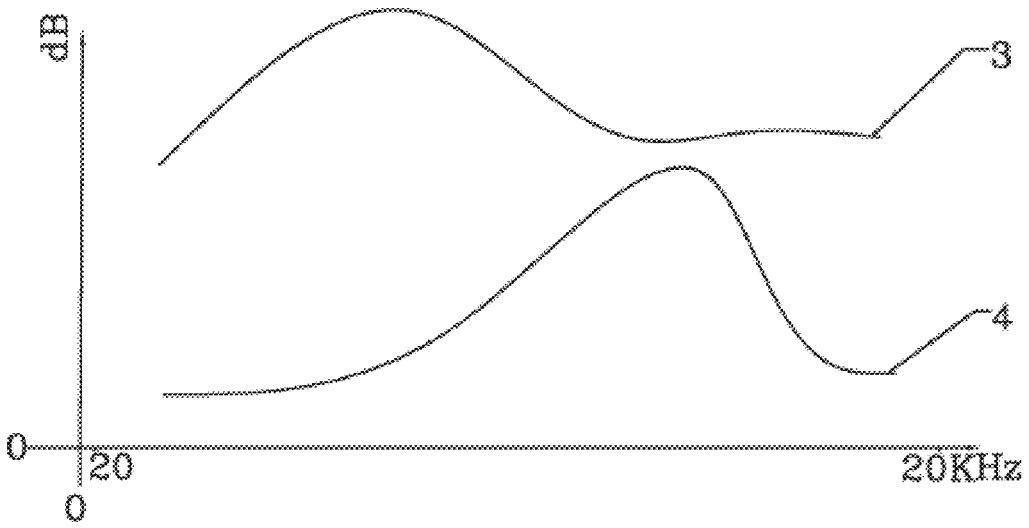
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2N~1.5N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
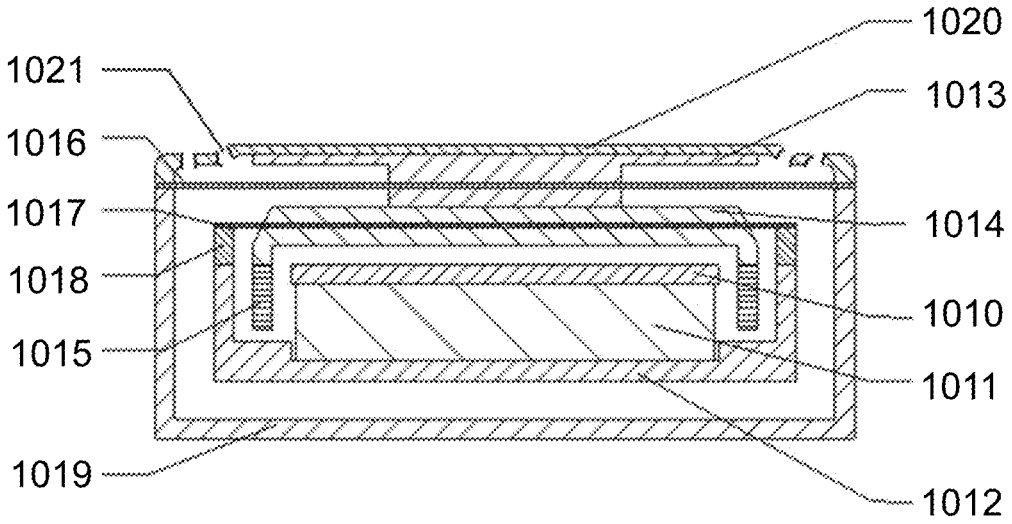
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
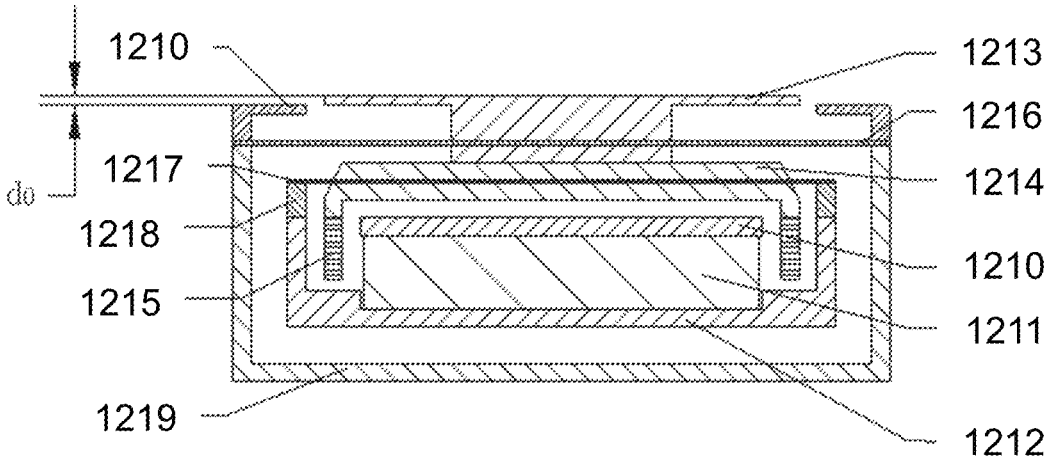
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
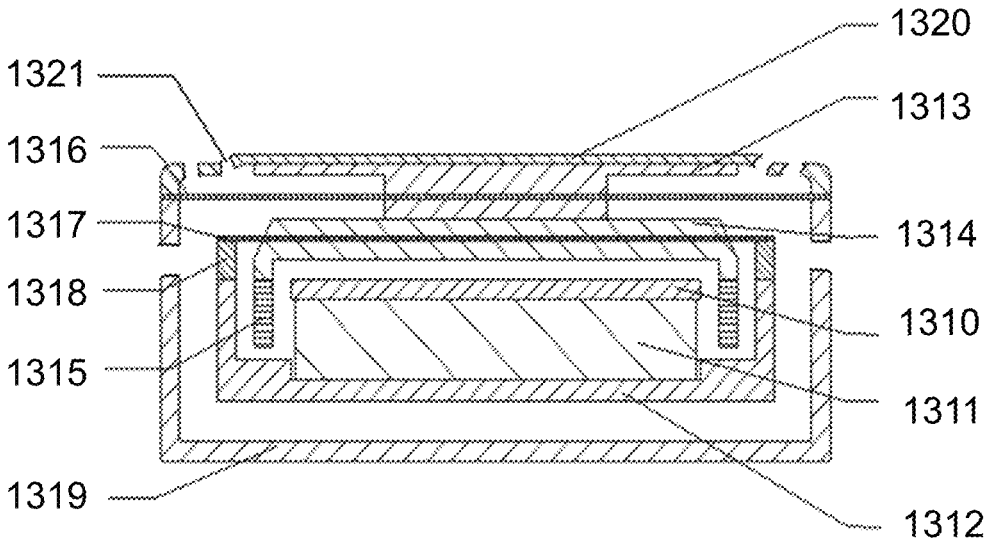
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

In some embodiments, the bone conduction speaker may further include a plurality of acoustic-electric transducer that have different frequency responses. The acoustic-transducers may detect an audio signal and generate a plurality of sub-band signals accordingly. The bone conduction speaker uses inherent properties of the acoustic-transducers to generate the sub-band signals, which spares the processing of digital signals and is thus time-saving.

Figure 14:
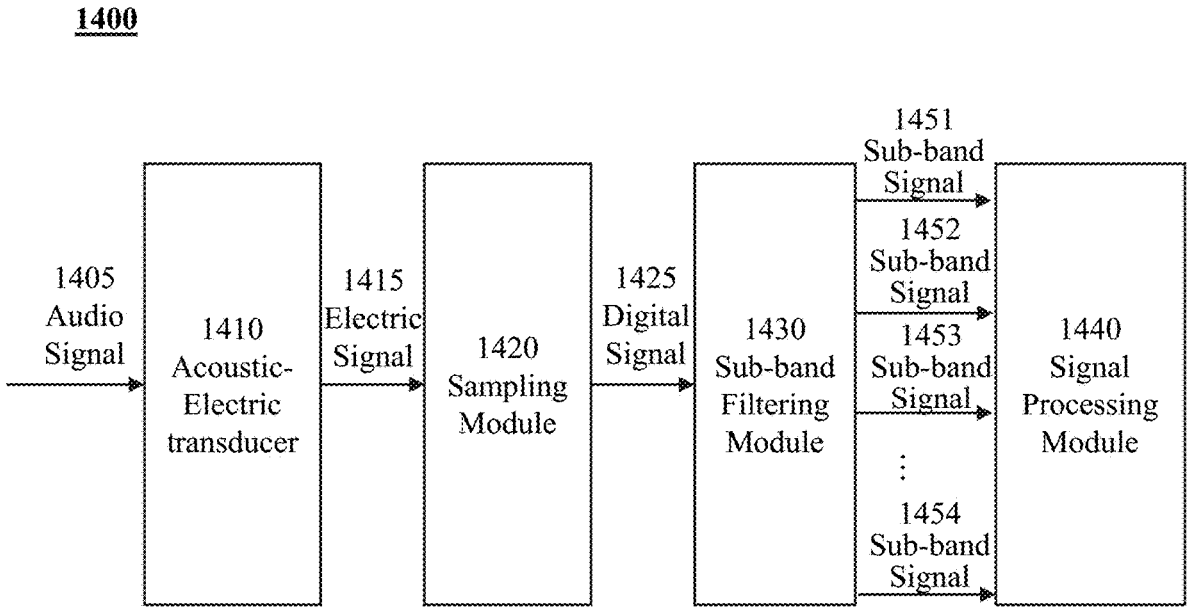
FIG. 14 illustrates a prior art signal processing device.

FIG. 14 illustrates a prior art signal processing device. The prior art signal processing device 1400 may include an acoustic-electric transducer 1410, a sampling module 1420, a sub-band filtering module 1430, and a signal processing module 1440. An audio signal 1405 may be first converted into an electric signal 1415 by the acoustic-electric transducer 1410. The sampling module 1420 may convert the electric signal 1415 into a digital signal 1425 for processing. The sub-band filtering module 1430 may decompose the digital signal 1425 into a plurality of sub-band signals (e.g., sub-band signals 1451, 1452, 1453, . . . , 1454). The signal processing module 1440 may further process the sub-band signals.

In one respect, to sample an electric signal 1415 with a wider bandwidth, the sampling module 1420 may request a higher sampling frequency. In another respect, to generate a plurality of sub-band signals, filter circuits of the sub-band filtering module 1430 need to be relatively complex and have a relatively high order. Also, to generate a plurality of sub-band signals, the sub-band filtering module 1430 may perform a digital signal processing process through a software program, which may be time-consuming and may introduce noise during the digital signal processing process. Thus, there is need to provide a system and method to generate sub-band signals.

Figure 15:
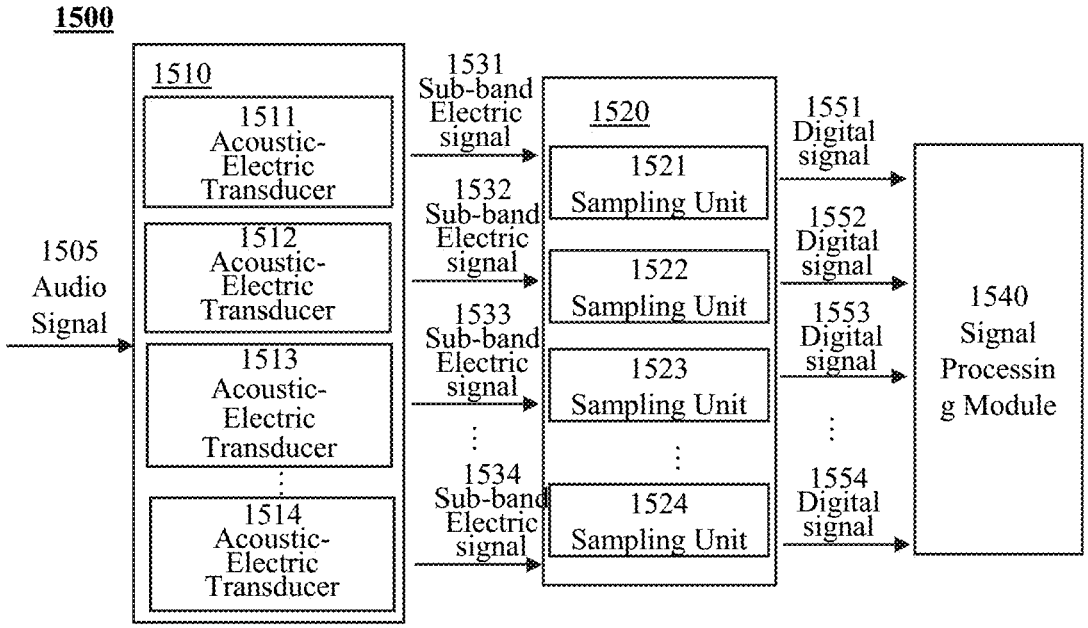
FIG. 15 illustrates an exemplary signal processing device according to some embodiments of the present disclosure.

FIG. 15 illustrates an exemplary signal processing device 1500 according to some embodiments of the present disclosure. As shown in FIG. 15, the signal processing device 1500 may include an acoustic-electric transducing module 1510, a sampling module 1520, and a signal processing module 1540.

The acoustic-electric transducing module 1510 may include a plurality of acoustic-electric transducers (e.g., acoustic-electric transducers 1511, 1512, 1513, . . . , 1514 illustrated in FIG. 15). The acoustic-electric transducers may be connected in parallel. For example, the acoustic-electric transducers may be connected electrically in parallel. As another example, the acoustic-electric transducers may be connected topologically in parallel.

An acoustic-electric transducer (e.g., acoustic-electric transducer 1511, 1512, 1513, and/or 1514) of the acoustic-electric transducing module 1510 may be configured to convert audio signals into electric signals. In some embodiments, one or more parameters of the acoustic-electric transducer 1511 may change in response to the detection of an audio signal (e.g., the audio signal 1505). Exemplary parameters may include capacitance, charge, acceleration, light intensity, or the like, or a combination thereof. In some embodiments, the changes in one or more parameters may correspond to the frequency of the audio signal and may be converted to corresponding electric signals. In some embodiments, an acoustic-electric transducer of the acoustic-electric transducing module 1510 may be a microphone, a hydrophone, an acoustic-optical modulator, or the like, or a combination thereof.

In some embodiments, the acoustic-electric transducer may be a first-order acoustic-electric transducer or a multi-order (e.g., second-order, fourth-order, sixth-order, etc.) acoustic-electric transducer. In some embodiments, the frequency response of a high-order acoustic-electric transducer may have a steeper edge.

In some embodiments, the acoustic-electric transducers in the acoustic-electric transducing module 1510 may include one or more piezoelectric acoustic-electric transducers (e.g., a microphone) and/or one or more piezo-magnetic acoustic-electric transducers. Merely by way of example, each of the acoustic-electric transducers may be a microphone. In some embodiments, the acoustic-electric transducers may include one or more air-conduction acoustic-electric transducers and/or one or more bone-conduction acoustic-electric transducers. In some embodiments, the plurality of acoustic-electric transducers may include one or more high-order wideband acoustic-electric transducers and/or one or more high-order narrow-band acoustic-electric transducers. As used herein, a high-order wideband acoustic-electric transducer may refer to a wideband acoustic-electric transducer having an order larger than 1. As used herein, a high-order narrow-band acoustic-electric transducer may refer to a narrow-band acoustic-electric transducer having an order larger than 1. Detailed descriptions of a wideband acoustic-electric transducer and/or a narrow-band acoustic-electric transducer may be apparent to those in the art, and may not be repeated herein.

Figure 24A:
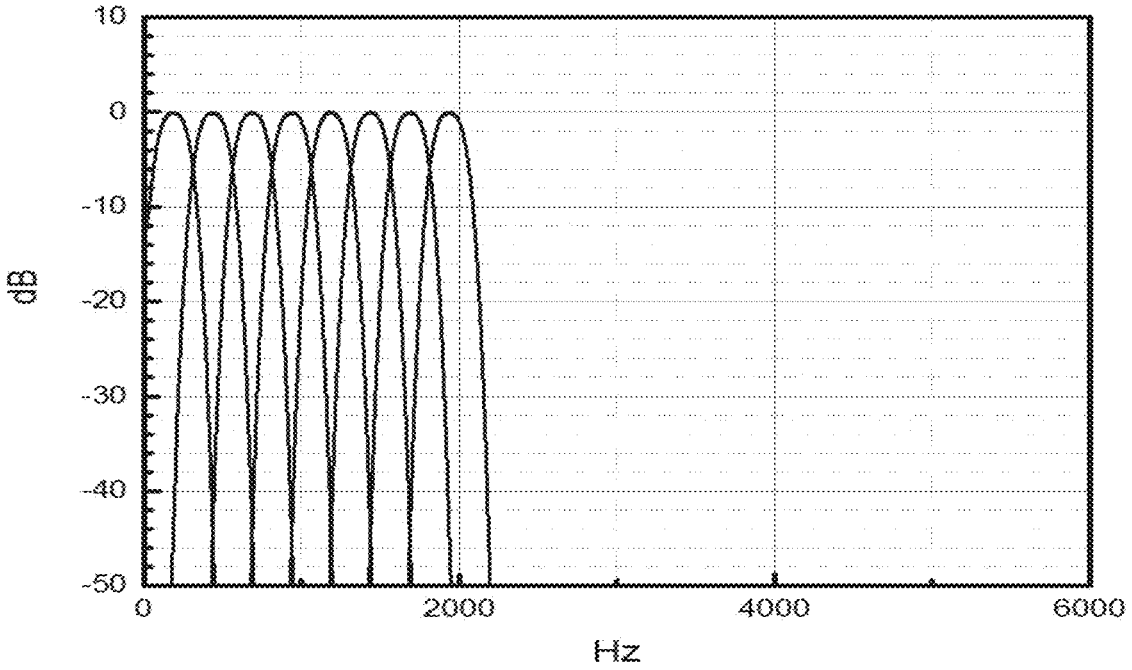
FIG. 24A illustrates an exemplary frequency response of an acoustic-electric transducing module according to some embodiments of the present disclosure.
Figure 24B:
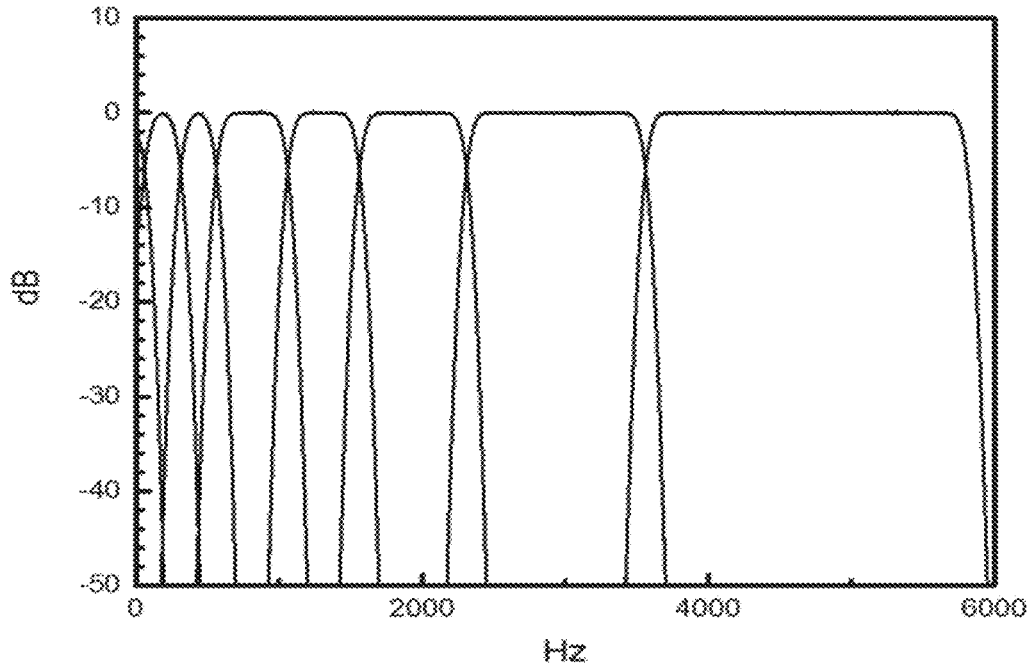
FIG. 24B illustrates an exemplary frequency response of an acoustic-electric transducing module according to some embodiments of the present disclosure.

In some embodiments, at least two of the plurality of acoustic-electric transducers may have different frequency responses, which may have different center frequencies and/or frequency bandwidths (or referred to as frequency width). For example, the acoustic-electric transducers 1511, 1512, 1513, and 1514 may have a first frequency response, a second frequency response, a third frequency response, and a fourth frequency response, respectively. In some embodiments, the first frequency response, the second frequency response, the third frequency response, and the third frequency response may be different from each other. Alternatively, the first frequency response, the second frequency response, and the third frequency response may be different from each other, while the fourth frequency response may be the same as the third frequency response. In some embodiments, the acoustic-electric transducers in an acoustic-electric transducing module 1510 may have same frequency bandwidth (as illustrated in FIG. 24A and the descriptions thereof) or different frequency bandwidths (as illustrated in FIG. 24B and the descriptions thereof). FIG. 24A illustrates the frequency response of an exemplary acoustic-electric transducing module (or referred to as a first acoustic-electric transducing module). FIG. 24B illustrates the frequency response of another exemplary acoustic-electric transducing module (or referred to as a second acoustic-electric transducing module) different from the frequency response of the acoustic-electric transducing module shown in FIG. 24A. As illustrated in FIG. 24A and FIG. 24B, the first acoustic-electric transducing module or the second acoustic-electric transducing module may include 8 acoustic-electric transducers. In some embodiments, the overlap ranges between frequency responses of the acoustic-electric transducers may be adjusted by adjusting structure parameters of the acoustic-electric transducers to change the center frequency and/or the bandwidth of one or more of these acoustic-electric transducers. In some embodiments, the first acoustic-electric transducing module or the second acoustic-electric transducing module may include a certain number of acoustic-electric transducers such that the frequency bands of the sub-band signals generated by the acoustic-electric transducers may cover the frequency band to be processed. In some embodiments, acoustic-electric transducers in the second acoustic-electric transducing module may have different center frequencies. In some embodiments, at least one acoustic-electric transducer with a narrow frequency bandwidth may be set to generate sub-band signals of a certain frequency band. In some embodiments, the acoustic-electric transducer with a higher center frequency response may be set to have a higher frequency bandwidth.

In some embodiments, an acoustic-electric transducer that has a center frequency higher than that of another acoustic-electric transducer may have a larger frequency bandwidth than that of the another acoustic-electric transducer.

The acoustic-electric transducers in the acoustic-electric transducing module 1510 may detect an audio signal 1505. The audio signal 1505 may be from an acoustic source capable of generating an audio signal. The acoustic source may be a living object such as a user of the signal processing device 1500 and/or a non-living object such as a CD player, a television, or the like, or a combination thereof. In some embodiments, the audio signal may also include ambient sound. The audio signal 1505 may have a certain frequency band. For example, the audio signal 1505 generated by the user of the signal processing device 1500 may have a frequency band of 10-30,000 HZ. The acoustic-electric transducers may generate, according to the audio signal 1505, a plurality of sub-band electric signals (e.g., sub-band electric signals 1531, 1532, 1533, . . . , and 1534 illustrated in FIG. 15). A sub-band electric signal generated according to the audio signal 1505 refers to the signal having a frequency band narrower than the frequency band of the audio signal 1505. The frequency band of the sub-band signal may be within the frequency band of the corresponding audio signal 1505. For example, the audio signal 1505 may have a frequency band of 10-30,000 HZ, and the frequency band of the sub-band audio signal may be 100-200 HZ, which is within the frequency band of the audio signal 1505, i.e., 10-30,000 HZ. In some embodiments, an acoustic-electric transducer may detect the audio signal 1505 and generate one sub-band signal according to the audio signal detected. For example, the acoustic-electric transducers 1511, 1512, 1513, and 1514 may detect the audio signal 1505 and generate a sub-band electric signal 1531, a sub-band electric signal 1532, a sub-band electric signal 1533, and a sub-band electric signal 1534, respectively, according to their respectively detected audio signal. In some embodiments, at least two of the plurality of sub-band signals generated by the acoustic-electric transducers may have different frequency bands. As illustrated above, at least two of the acoustic-electric transducers may have different frequency responses, which may result in two different sub-band signals according to the detections of the same audio signal 1505 by two different acoustic-electric transducers. The acoustic-electric transducing module 1510 may transmit the generated sub-band signals to the sampling module 1520. The acoustic-electric transducing module 1510 may transmit the sub-band signals through one or more transmitters (not shown). Exemplary transmitter may be a coaxial cable, a communication cable (e.g., a telecommunication cable), a flexible cable, a spiral cable, a non-metallic sheath cable, a metal sheath cable, a multi-core cable, a twisted-pair cable, a ribbon cable, a shielded cable, a double-strand cable, an optical fiber, or the like, or a combination thereof. In some embodiments, the sub-band signals may be transmitted to the sampling module 1520 via a signal transmitter. In some embodiments, the sub-band signals may be transmitted to the sampling module 1520 via a plurality of sub-band transmitters connected in parallel. Each of the plurality of sub-band transmitters may connect to an acoustic-electric transducer in the acoustic-electric transducing module 1510 and transmit the sub-band signal generated by the acoustic-electric transducer to the sampling module 1520. For example, the sub-band transmitters may include a first sub-band transmitter connected to the acoustic-electric transducer 1511 and a second sub-band transmitter connected to the acoustic-electric transducer 1512. The first sub-band transmitter and the second sub-band transmitter may be connected in parallel. The first sub-band transmitter and the second sub-band transmitter may transmit the sub-band electric signal 1531 and the sub-band electric signal 1532 to the sampling module 1520, respectively.

Figure 23A:
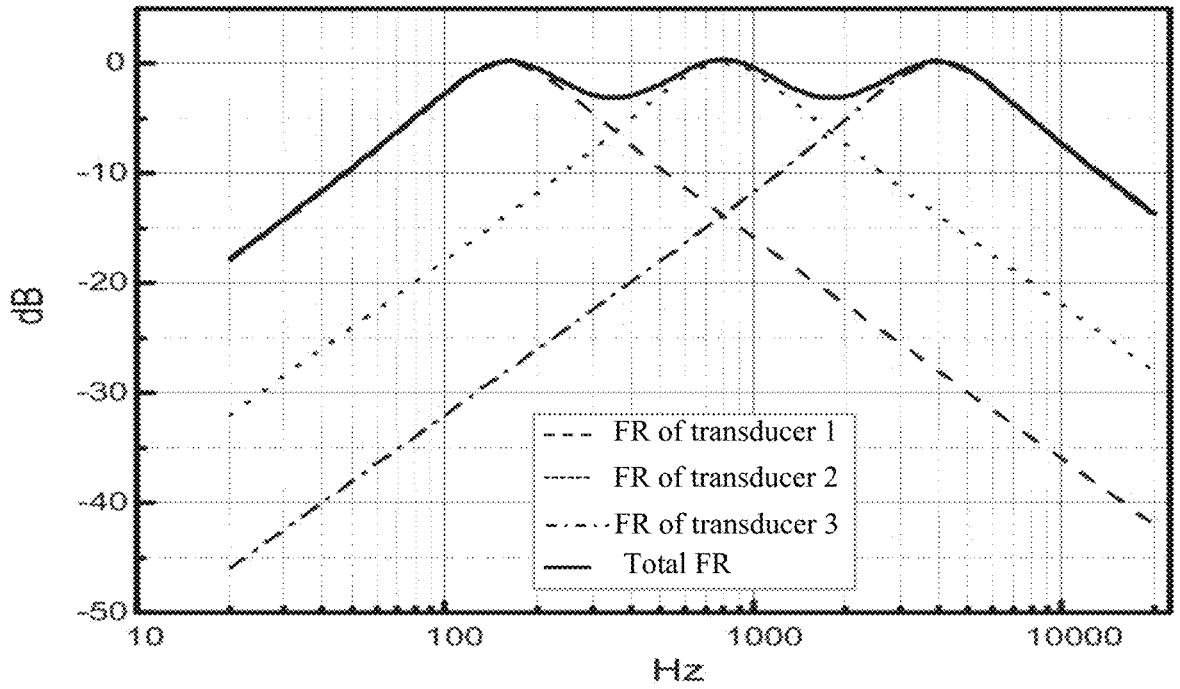
FIG. 23A illustrates an exemplary frequency response of an acoustic-electric transducing module according to some embodiments of the present disclosure.
Figure 23B:
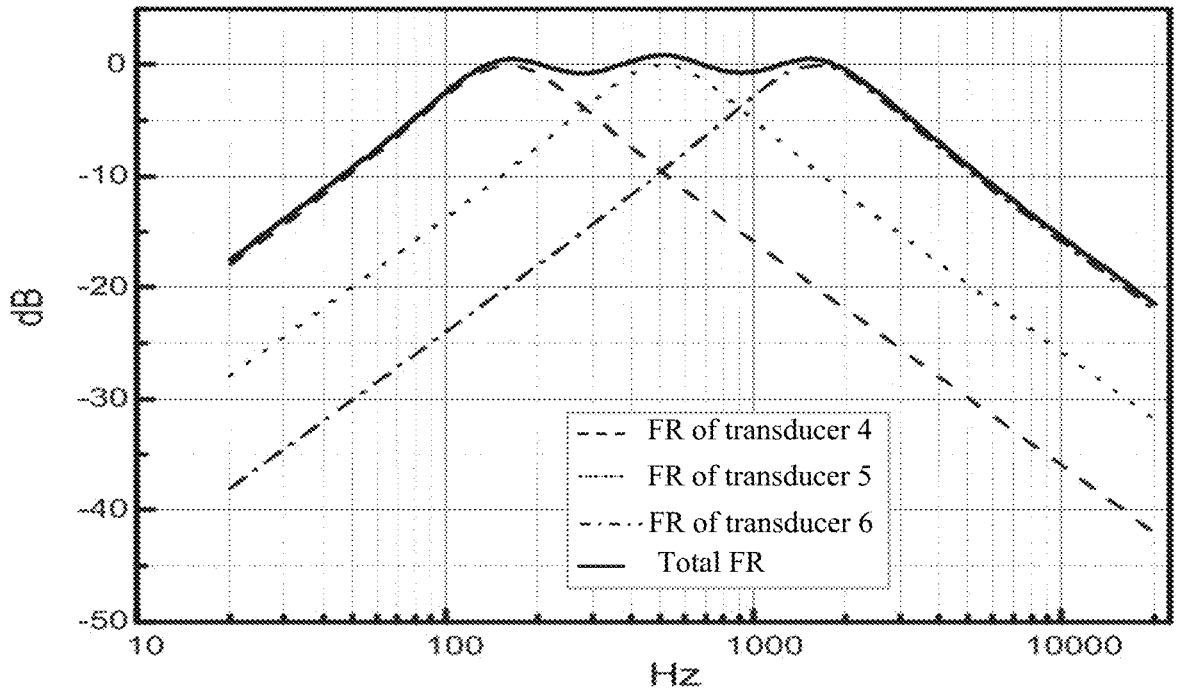
FIG. 23B illustrates an exemplary frequency response of an acoustic-electric transducing module according to some embodiments of the present disclosure.
Figure 23C:
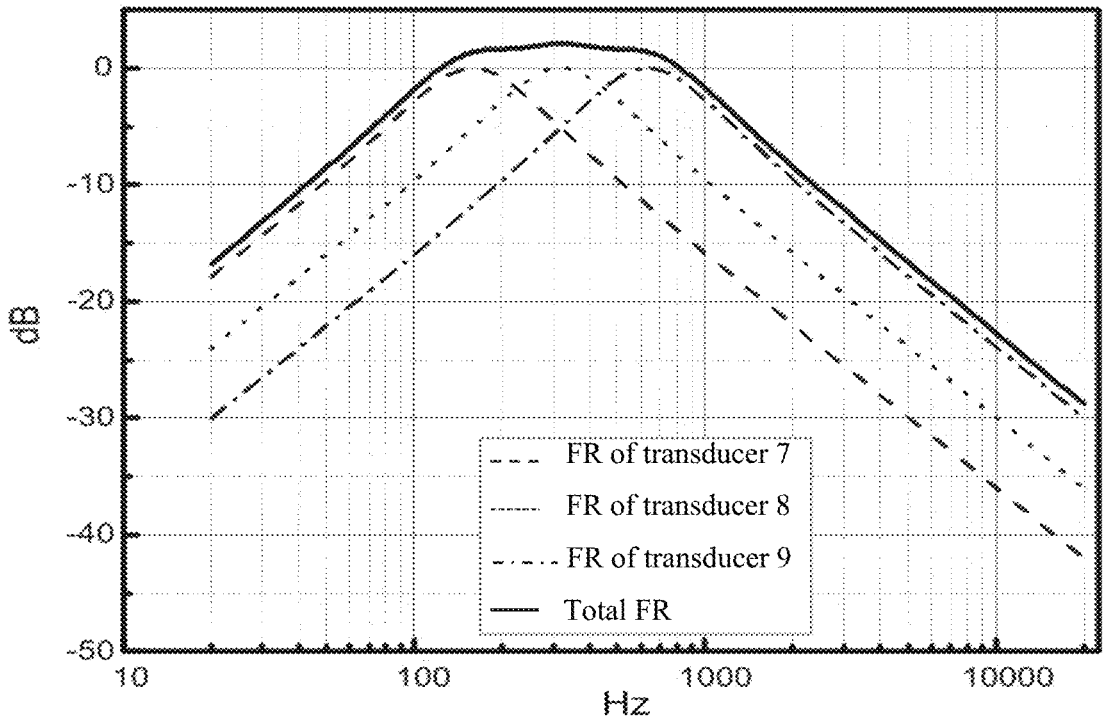
FIG. 23C illustrates an exemplary frequency response of an acoustic-electric transducing module according to some embodiments of the present disclosure.

The frequency response of an acoustic-electric transducing module 1510 may depend on the frequency responses of the acoustic-electric transducers included in the acoustic-electric transducing module 1510. For example, the flatness of the frequency response of an acoustic-electric transducing module 1510 may be related to where the frequency response of the acoustic-electric transducers in the acoustic-electric transducing module 1510 intersect with each other. As illustrated in FIGS. 23A-23C (and the descriptions thereof below), when the frequency responses of acoustic-electric transducers intersect near or at the half-power point(s), the frequency response of the acoustic-electric transducing module 1510 that includes the acoustic-electric transducers may be flatter than that of the acoustic-electric transducing module 1510 when the acoustic-electric transducers therein do not intersect near nor at the half-power point(s). As used herein, the half power point of a certain frequency response refers to frequency point(s) with a power level of −3 dB. As used herein, two frequency responses may be considered to intersect near a half-power point when they intersect at a frequency point that is near the half-power point. As used herein, a frequency point may be considered to be near a half-power point when the power level difference between the frequency point and the half-power point is no larger than 2 dB. In some embodiments, when the frequency response of the acoustic-electric transducers in the acoustic-electric transducing module 1510 intersect with each other at a frequency point (e.g., a one-quarter-power point, or a one-eighths-power point, etc.) with a power level which is more than 2 dB lower than that of the half-power point, the overlap range between frequency responses of adjacent acoustic-electric transducers may be relatively small, causing the frequency response of a combination of the adjacent acoustic-electric transducers to decrease within the overlap range, thus affecting the quality of the sub-band signals output by the adjacent acoustic-electric transducers.

In some embodiments, when the frequency response of the acoustic-electric transducers in the acoustic-electric transducing module 1510 intersect with each other at a frequency point (e.g., a three-quarters-power point, or a seven-eighths-power point, etc.) with a power level 1 dB higher than the half-power point, the overlap range between frequency responses of adjacent acoustic-electric transducers may be relatively high, causing a relatively high interference range between the sub-band signals output by the acoustic-electric transducers.

Figure 26A:
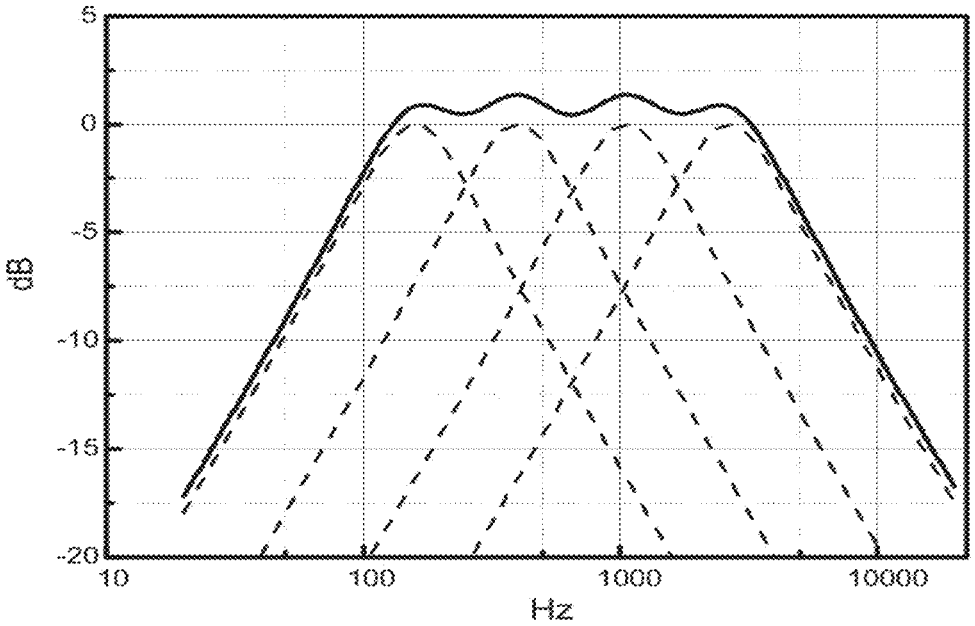
FIG. 26A illustrates an exemplary frequency response of an acoustic-electric transducing module according to some embodiments of the present disclosure.
Figure 26B:
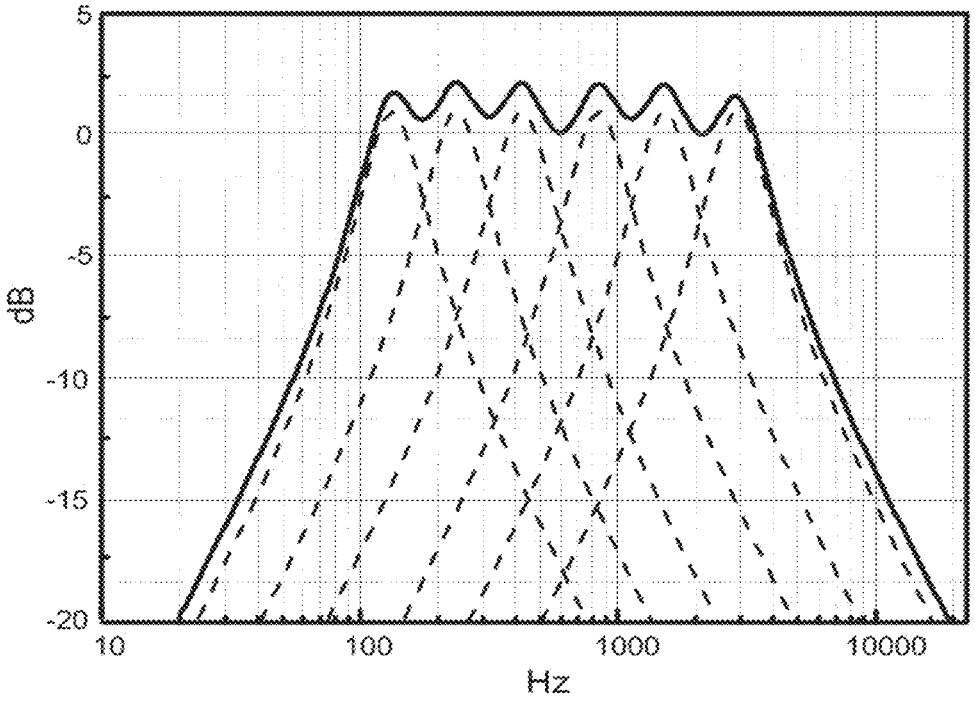
FIG. 26B illustrates an exemplary frequency response of an acoustic-electric transducing module according to some embodiments of the present disclosure.

In some embodiments, for a certain frequency band, a limited number of acoustic-electric transducers may be allowed in an acoustic-electric transducing module 1510. More acoustic-electric transducers may be included in an acoustic-electric transducing module 1510 when the acoustic-electric transducers are under-damped ones rather than non-underdamping ones. Merely by way of example, FIG. 26A illustrates the frequency response of the acoustic-electric transducing module 1510 that includes four (the four dashed lines being the frequency responses of the four individual non-underdamping acoustic-electric transducers if they operate separately; and the solid line being the frequency response of the combination of the four non-underdamping acoustic-electric transducers). In some embodiments, more acoustic-electric transducers may be allowed to be in the acoustic-electric transducing module 1510, when one or more of the acoustic-electric transducers are in under-damped state. For example, the acoustic-electric transducing module 1510 may include six or more under-damped acoustic-electric transducers. Merely by way of example, FIG. 26B illustrates the frequency response of the acoustic-electric transducing module 1510 having six under-damped acoustic-electric transducers.

The sampling module 1520 may include a plurality of sampling units (e.g., sampling units 1521, 1522, 1523, . . . , and 1524 illustrated in FIG. 15). The sampling units may be connected in parallel.

A sampling unit (e.g., the sampling unit 1521, the sampling unit 1522, the sampling unit 1523, and/or the sampling unit 1524) in the sampling module 1520 may communicate with an acoustic-electric transducer and be configured to receive and sample the sub-band signal generated by the acoustic-electric transducer. The sampling unit may communicate with the acoustic-electric transducer via a sub-band transmitter. Merely by way of example, the sampling unit 1521 may be connected to the first sub-band transmitter and configured to sample the sub-band electric signal 1531 received therefrom, while the sampling unit 1522 may be connected to the second sub-band transmitter and configured to sample the sub-band electric signal 1532 received therefrom.

In some embodiments, a sampling unit (e.g., sampling unit 1521, sampling unit 1522, sampling unit 1523, and/or sampling unit 1524) in the sampling module may sample the sub-band signal received and generate a digital signal based on the sampled sub-band signal. For example, the sampling unit 1521, the sampling unit 1522, the sampling unit 1523, and the sampling unit 1524 may sample the sub-band signals and generate a digital signal 1551, a digital signal 1552, a digital signal 1553, and a digital signal 1554, respectively.

In some embodiments, the sampling unit may sample a sub-band signal using a band pass sampling technique. For example, a sampling unit may be configured to sample a sub-band signal using band pass sampling with a sampling frequency according to the frequency band of the sub-band signal. Merely by way of example, the sampling unit may sample a sub-band signal with a frequency band that is no less than two times the bandwidth of the frequency band of the sub-band signal. In some embodiments, the sampling unit may sample a sub-band signal with a frequency band that is no less than two times the bandwidth of the frequency band of the sub-band signal and no greater than four times the bandwidth of the frequency band of the sub-band signal. In some embodiments, by using a band pass sampling technique rather than a bandwidth sampling technique or a low-pass sampling technique, a sampling unit may sample a sub-band signal with a relatively low sampling frequency, reducing the difficulty and cost of the sampling process. Also, by using bandpass sampling technique, little noise or signal distortion may be introduced in the sampling process. As described in connection with FIG. 14, the signal processing system 1400 (e.g., the sub-band filtering module 1430) may perform a digital signal processing process through a software program to generate sub-band signals, which may introduce signal distortions due to factors including the algorithms used in the signal processing process, sampling methods used in the sampling process, and structures of the components in the signal processing system 1400 (e.g., the acoustic-electric transducer 1410, the sampling module 1420, and/or the sub-band filtering module 1430). As compared to sub-band filtering module 1430, the signal processing system 1500 may generate sub-band signals based on structures and characteristics of the acoustic-electric transducers.

The sampling unit may transmit the generated digital signal to the signal processing module 1540. In some embodiments, the digital signals may be transmitted via parallel transmitters. In some embodiments, the digital signals may be transmitted via a transmitter according to a certain communication protocol. Exemplary communication protocol may include AES3 (audio engineering society), AES/EBU (European broadcast union)), EBU (European broadcast union), ADAT (Automatic Data Accumulator and Transfer), I2S (Inter—IC Sound), TDM (Time Division Multiplexing), MIDI (Musical Instrument Digital Interface), CobraNet, Ethernet AVB (Ethernet Audio/VideoBridging), Dante, ITU (International Telecommunication Union)-T G.728, ITU-T G.711, ITU-T G.722, ITU-T G.722.1, ITU-T G.722.1 Annex C, AAC (Advanced Audio Coding)-LD, or the like, or a combination thereof. The digital signal may be transmitted in a certain format including a CD (Compact Disc), WAVE, AIFF (Audio Interchange File Format), MPEG (Moving Picture Experts Group)-1, MPEG-2, MPEG-3, MPEG-4, MIDI (Musical Instrument Digital Interface), WMA (Windows Media Audio), RealAudio, VQF (Transform-domain Weighted Nterleave Vector Quantization), AMR (Adaptive Multi-Rate), APE, FLAC (Free Lossless Audio Codec), AAC (Advanced Audio Coding), or the like, or a combination thereof.

The signal processing module 1540 may process the data received from other components in the signal processing device 1500. For example, the signal processing module 1540 may process the digital signals transmitted from the sampling units in the sampling module 1520. The signal processing module 1540 may access information and/or data stored in the sampling module 1520. As another example, the signal processing module 1540 may be directly connected to the sampling module 1520 to access stored information and/or data. In some embodiments, the signal processing module 1540 may be implemented by a processor such as a microcontroller, a microprocessor, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), a programmable logic device (PLD), any circuit or processor capable of executing one or more functions, or the like, or any combinations thereof.

It should be noted that the above descriptions of the signal processing device 1500 is merely provided for the purposes of illustration, and not intended to limit the scope of the present disclosure. For a person having ordinary skill in the art, multiple variations and modifications may be made under the teaching of the present disclosure. However, those variations and modifications do not depart from the scope of the present disclosure. For example, the signal processing device 1500 may further include a storage to store the signals received from other components in the signal processing device 1500 (e.g., the acoustic-electric transducing module 1510, and/or the sampling module 1520). Exemplary storage may include a mass storage, removable storage, a volatile read-and-write memory, a read-only memory (ROM), or the like, or a combination thereof. As another example, one or more transmitters may be omitted. The plurality of sub-band signals may be transmitted by media of wave such as infrared wave, electromagnetic wave, sound wave, or the like, or a combination thereof. As a further example, the acoustic-electric transducing module 1510 may include 2, 3, or 4 acoustic-electric transducers.

Figure 16:
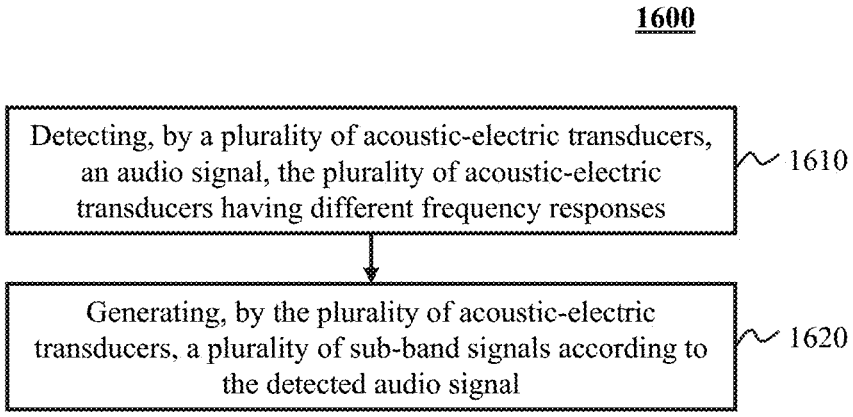
FIG. 16 is a flowchart of an exemplary process for processing an audio signal according to some embodiments of the present disclosure.

FIG. 16 is a flowchart illustrating an exemplary process for processing an audio signal according to some embodiments of the present disclosure. At least a portion of process 300 may be implemented on the signal processing device 1500 as illustrated in FIG. 15.

In 1610, an audio signal 1505 may be detected. The audio signal 1505 may be detected by a plurality of acoustic-electric transducers. In some embodiments, the acoustic-electric transducers may have different frequency responses. The plurality of acoustic-electric transducers may be arranged in the same signal processing device 1500 as illustrated in FIG. 15. The audio signal 1505 may have a certain frequency band.

In 1620, a plurality of sub-band signals may be generated according to the audio signal 1505. The plurality of sub-band signals may be generated by the plurality of acoustic-electric transducers. At least two of the generated sub-band signals may have different frequency bands. Each sub-band signal may have a frequency band that is within the frequency band of the audio signal 1505.

It should be noted that the above description regarding the process 1600 is merely provided for the purposes of illustration, and not intended to limit the scope of the present disclosure. For a person having ordinary skill in the art, multiple variations and modifications may be made under the teachings of the present disclosure. However, those variations and modifications do not depart from the scope of the present disclosure. In some embodiments, one or more operations in process 1600 may be omitted, or one or more additional operations may be added. For example, the process 1600 may further include an operation for sampling the sub-band signals after operation 1620.

Figure 17:
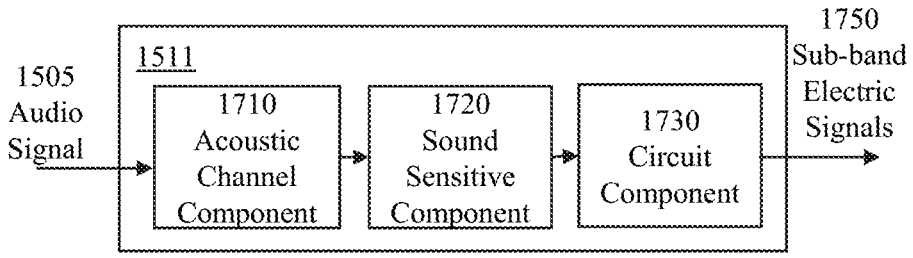
FIG. 17 is a schematic diagram of an exemplary acoustic-electric transducer according to some embodiments of the present disclosure.

FIG. 17 is a schematic diagram of an exemplary acoustic-electric transducer according to some embodiments of the present disclosure. The acoustic-electric transducer 1511 may be configured to convert an audio signal to an electric signal. The acoustic-electric transducer 1511 may include an acoustic channel component 1710, a sound sensitive component 1720, and a circuit component 1730.

The acoustic channel component 1710 may affect the path through which an audio signal is transmitted to the sound sensitive component 1720 by the acoustic channel component 1710's acoustic structure, which may process the audio signal before the audio signal reaches the sound sensitive component 1720. In some embodiments, the audio signal may be an air-conduction-sound signal, and the acoustic structure of the acoustic channel component 1710 may be configured to process the air-conduction-sound signal. Alternatively, the audio signal may be a bone-conduction-sound signal, and the acoustic structure of the acoustic channel component 1710 may be configured to process the bone-conduction-sound signal. In some embodiments, the acoustic structure may include one or more chamber structures, one or more pipe structures, or the like, or a combination thereof.

In some embodiments, the acoustic impedance of an acoustic structure may change according to the frequency of a detected audio signal. In some embodiments, the acoustic impedance of an acoustic structure may change within a certain range. Thus, in some embodiments, the frequency band of an audio signal may cause corresponding changes in the acoustic impedance of an acoustic structure. In other words, the acoustic structure may function as a filter that processes a sub-band of a detected audio signal. In some embodiments, an acoustic structure mainly including a chamber structure may function as a high-pass filter, while an acoustic structure mainly including a pipe structure may function as a low-pass filter.

In some embodiments, the acoustic impedance of an acoustic structure which mainly includes a chamber structure may be determined according to Equation (5) as follows:

$$Z = \frac{1}{j\omega C_a} = \frac{\rho_0 c_0}{j\omega V_0}, \tag{5}$$

Where Z refers to the acoustic impedance, ω refers to the angular frequency (e.g., the chamber structure), j refers to a unit imaginary number $C_a$ refers to the sound capacity, $\rho_0$ refers to the density of air, $c_0$ refers to the speed of sound, and $V_0$ refers to the equivalent volume of the chamber.

In some embodiments, the acoustic impedance of an acoustic structure which mainly includes a pipe structure may be determined according to Equation (6) as follows:

$$Z = j\omega M_a = j\omega \frac{\rho_0 l_0}{S}, \tag{6}$$

Where Z refers to the acoustic impedance, $M_a$ refers to the acoustic mass, ω refers to the angular frequency of the acoustic structure (e.g., the pipe structure), $\rho_0$ refers to the density of air, $l_0$ refers to the equivalent length of the pipe, and S refers to the cross-sectional area of the orifice.

A chamber-pipe structure is a combination of the sound capacity and the acoustic mass in serial, for example, a Helmholtz resonator, and an inductor-capacitor (LC) resonance circuit may be formed. The acoustic impedance of a chamber-pipe structure may be determined according to Equation (7) as follows:

$$Z = j\left(\omega M_a - \frac{1}{\omega C_a}\right). \tag{7}$$

According to Equation (7), a chamber-pipe structure may function as a bandpass filter. The center frequency of the bandpass filter may be determined according to Equation (8) as follows:

$$\omega_0=\sqrt{M_a C_a} \quad (8).$$

If an acoustic resistance material is used in the chamber-pipe structure, a resistor-inductor-capacitor (RLC) series loop may be formed, and the acoustic impedance of the RLC series loop may be determined according to Equation (9) as follows:

$$Z = R_a + j\left(\omega M_a - \frac{1}{\omega C_a}\right), \quad (9)$$

where $R_a$ refers to the acoustic resistance of the RLC series loop. The chamber-pipe structure may also function as a band pass filter. The adjustment of the acoustic resistance $R_a$ may change the bandwidth of the band pass filter. The center frequency of the bandpass filter may be determined according to Equation (10) as follows:

$$\omega_0=\sqrt{M_a C_a} \quad (10).$$

The sound sensitive component 1720 may convert the audio signal transmitted by the acoustic-channel component to an electric signal. For example, the sound sensitive component 1720 may convert the audio signal into changes in electric parameters, which may be embodied as an electric signal. The structure of the sound sensitive component 1720 may include diaphragms, plates, cantilevers, etc. In some embodiments, the sound sensitive component 1720 may include one or more diaphragms. Details regarding the structure of a sound sensitive component 1720 including a diaphragm may be found elsewhere in this disclosure (e.g., FIGS. 19A and 19B and the descriptions thereof). Details regarding the structure of a sound sensitive component 1720 including multiple diaphragms may be found elsewhere in this disclosure (e.g., FIGS. 20A and 21A and the descriptions thereof). The diaphragms included in the sound sensitive component 1720 may be connected in parallel (e.g., as illustrated in FIG. 20A) or series (e.g., as illustrated in FIG. 21A). In some embodiments, referring to FIGS. 20B and 20C and the descriptions thereof, the bandwidth of the frequency response of a sound sensitive component 1720 having multiple diaphragms that are connected in parallel may be wider and flatter than the bandwidth of the frequency response of the sound sensitive component 1720 having a diaphragm. In some embodiments, referring to FIG. 21B and the descriptions thereof, the bandwidth of the frequency response of a sound sensitive component 1720 having multiple diaphragms that are connected in series may have a sharper edge than the bandwidth of the frequency response of the sound sensitive component 1720 having a diaphragm. The material of the sound sensitive component 1720 may include plastics, metals, composites, piezoelectric materials, etc. More detailed descriptions about the sound sensitive component 1720 may be found elsewhere in the present disclosure (e.g., FIGS. 19A-22D and the descriptions thereof).

As described in connection with the acoustic channel component 1710, the acoustic channel component 1710 or the sound sensitive component 1720 may function as a filter. A structure including an acoustic channel component 1710 and a sound sensitive component 1720 may also function as a filter. Detailed description of the structure may be found in FIG. 22A and FIG. 22B and the descriptions thereof.

In some embodiments, by modifying parameter(s) (e.g. structure parameters) of an acoustic channel component 1710 and/or a sound sensitive component 1720, the frequency response of the combination of the acoustic channel component 1710 and the sound sensitive component 1720 may be adjusted accordingly. For example, FIG. 22C illustrates exemplary frequency responses of two combination structures according to some embodiments of the present disclosure. Dotted line 2231 represents the frequency response of a combination of an acoustic channel component and a sound sensitive component (or referred to as a first combination structure). One or more parameters (e.g., structural parameters) of the acoustic channel component or the sound sensitive component may be modified, resulting in a second combination structure that is different from the first combination structure. Solid line 2233 may indicate the frequency response of the second combination structure. As illustrated by FIG. 22C, the frequency response of the second combination structure (i.e., solid line 2233) may be flatter than the frequency response of the first combination structure (i.e., dotted line 2231), in the frequency band 20 HZ-20,000 HZ.

In some embodiments, the frequency response of a combination of an acoustic channel component 1710 and a sound sensitive component 1720 may be related to the frequency response of the acoustic channel component 1710 and/or the frequency response of the sound sensitive component 1720. For example, the steepness of the edges of the frequency response of the combination of the acoustic channel component 1710 and the sound sensitive component 1720 may be related to the extent to which the cutoff frequency of the frequency response of the acoustic channel component 1710 is close to the cutoff frequency of the frequency response of the sound sensitive component 1720. The edges of the frequency response of the combination of the acoustic channel component 1710 and the sound sensitive component 1720 may be steeper, when the cutoff frequency of the frequency response of the acoustic channel component 1710 and the cutoff frequency of the frequency response of the sound sensitive component 1720 are closer to each other. For example, FIG. 22D illustrates an exemplary frequency response of a combination structure according to some embodiments of the present disclosure. Dashed line 2241 represents the frequency response of a sound sensitive component. Dotted line 2243 represents the frequency response of an acoustic channel component, and solid line 2245 may indicate the frequency response of a combination of the acoustic channel component and the sound sensitive component. As illustrated by FIG. 22D, the corner frequency (also referred to as cutoff frequency) of the acoustic channel component (i.e., dotted line 2243) may be close to or the same as the corner frequency of the sound sensitive component (i.e., dashed line 2241), which may result in the frequency of the combination of the acoustic channel component and the sound sensitive component (i.e., solid line 2245) to have a steeper edge.

In some embodiments, one or more structure parameters of the acoustic channel component 1710 and/or the sound sensitive component 1720 may be modified or adjusted. For example, the spacing between different elements in the acoustic channel component 1710 and/or the sound sensitive component 1720 may be adjusted by a motor, which is driven by the feedback module illustrated elsewhere in the present disclosure. As another example, the current flowing through the sound sensitive component 1720 may be adjusted under instructions sent, e.g., by the feedback module. The adjustment of one or more structure parameters of the acoustic channel component 1710 and/or the sound sensitive component 1720 may result in changes in the filtering characteristic thereof.

The circuit component 1730 may detect the changes in electric parameters (e.g., an electric signal). In some embodiments, the circuit component 1730 may perform one or more functions on electric signals for further processing. Exemplary functions may include amplification, modulation, simple filtering, or the like, or a combination thereof. In some embodiments, via adjusting one or more parameters of the circuit component 1730, a sensitivity of corresponding pass-bands may be adjusted to match each other. In some embodiments, the circuit components 1730 may adjust the sensitivity of one or more pass-bands according to conditions such as a preset instruction, a feedback signal, or a control signal transmitted by a controller, or the like, or a combination thereof. In some embodiments, the circuit components 1730 may adjust the sensitivity of one or more pass-bands automatically.

Figure 18A:
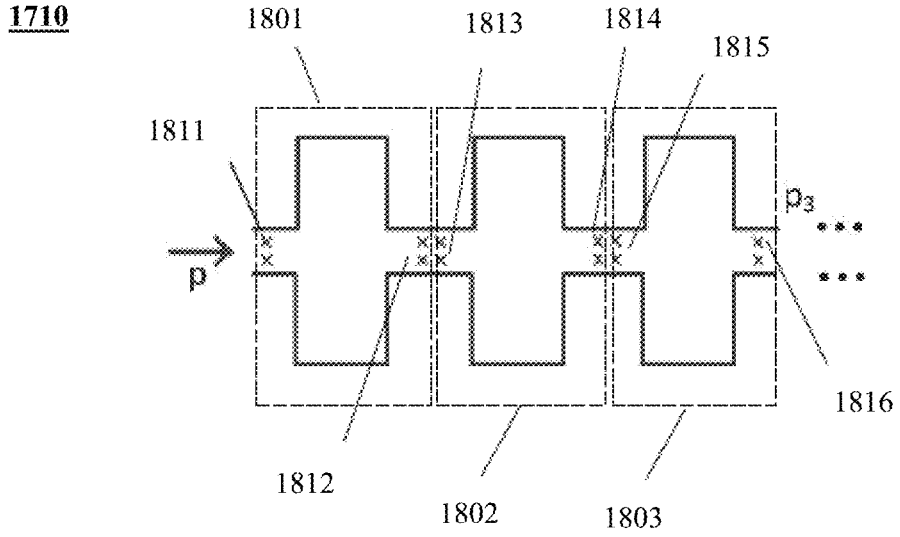
FIG. 18A illustrates an exemplary acoustic channel component according to some embodiments of the present disclosure.

FIG. 18A illustrates an exemplary acoustic channel component 1710 according to some embodiments of the present disclosure. The acoustic channel component 1710 may include one or more pipe structures. FIG. 18A depicts three exemplary pipe structures, namely, a first pipe structure 1801, a second pipe structure 1802, and a third pipe structure 1803. Each pipe structure may include a front acoustic resistance material to detect or receive an audio signal, and an end acoustic resistance material to output a signal according to the audio signal. For example, the first pipe structure 1801 may include a front acoustic resistance material 1811 and an end acoustic resistance material 1812. The second pipe structure 1802 may include a front acoustic resistance material 1813, and an end acoustic resistance material 1814. The third pipe structure 1803 may include a front acoustic resistance material 1815, and an end acoustic resistance material 1816. When sound pressure P passes the first pipe structure 1801, the second pipe structure 1802, and the third pipe structure 1803 successively, the sound pressure P may become sound pressure $P_3$. An exemplary circuit corresponding to the acoustic channel component 1710 (or referred to as an acoustic filtering network) may be illustrated in FIG. 18B.

Figure 18B:
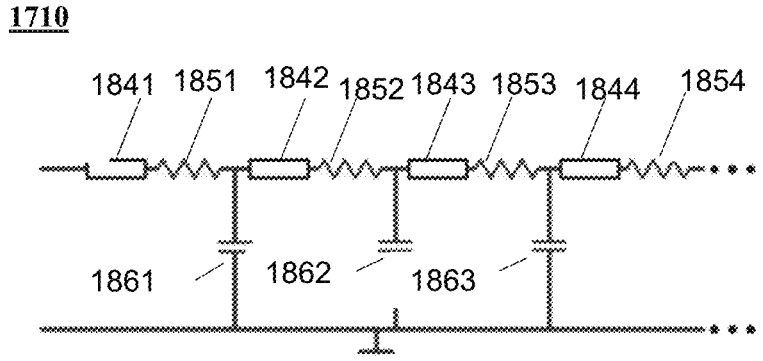
FIG. 18B illustrates an exemplary equivalent circuit model of the acoustic channel component shown in FIG. 5A according to some embodiments of the present disclosure.

FIG. 18B illustrates an exemplary equivalent circuit model of the acoustic channel component 1710 shown in FIG. 18A according to some embodiments of the present disclosure. The circuit may include a first resistor 1841, a second resistor 1842, a third resistor 1843, a fourth resistor 1844, a first inductor 1851, a second inductor 1852, a third inductor 1853, a fourth inductor 1854, a first capacitor 561, a second capacitor 562, and a third capacitor 563. A first end of the first capacitor 561 may connect to a first end of the first inductor 1851, and a first end of the second resistor 1842. A second end of the first inductor 1851 may connect to a first end of the first resistor 1841. A first end of the second capacitor 562 may connect to a first end of the second inductor 1852, and a first end of the third resistor 1843. A second end of the second inductor 1852 may connect to a second end of the second resistor 1842. A first end of the third capacitor 563 may connect to a first end of the third inductor 1853, and a first end of the fourth resistor 1844. A second end of the third inductor 1853 may connect to a second end of the third resistor 1843. A first end of the fourth inductor 1854 may connect to a second end of the fourth resistor 1844.

Figures 19A, 19B:
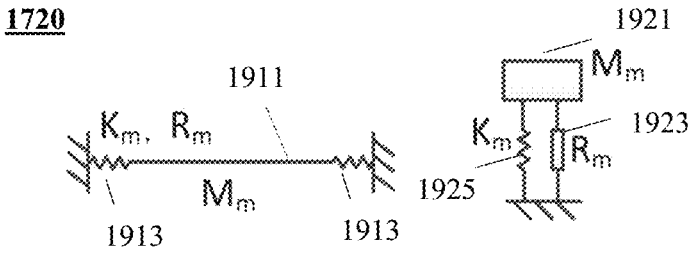
FIG. 19A is a schematic diagram of an exemplary mechanical model of a sound sensitive component according to some embodiments of the present disclosure.
FIG. 19B is a schematic diagram of an exemplary mechanical model of a sound sensitive component according to some embodiments of the present disclosure.
Figure 20A:
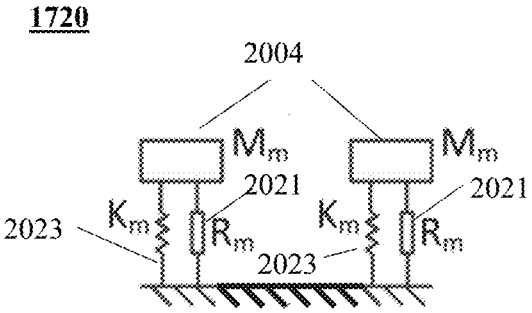
FIG. 20A is a schematic diagram of a mechanical model of an exemplary sound sensitive component according to some embodiments of the present disclosure.

FIG. 19A is a schematic diagram of an exemplary mechanical model of the sound sensitive component 1720 according to some embodiments of the present disclosure. One or more elements in the sound sensitive component 1720 may vibrate according to an audio signal impinging on it. The audio signal may be transmitted from the acoustic channel component 1710. In some embodiments, the vibration of one or more elements in the sound sensitive component 1720 may lead to changes in electric parameters of the sound sensitive component 1720. Sound sensitive component 1720 may be sensitive to a certain frequency band of an audio signal. The frequency band of an audio signal may cause corresponding changes in electric parameters of the sound sensitive component 1720. In other words, the sound sensitive component 1720 may function as a filter that processes a sub-band of the audio signal.

In some embodiments, the sound sensitive component 1720 may be a diaphragm. FIG. 19A illustrates an exemplary diaphragm, which may include a diaphragm 1911, and an elastic component 1913. A first point of the diaphragm 1911 may connect to a first point of the elastic component 1913. A second point of the diaphragm 1911 may connect to and a second point of the elastic component 1913.

FIG. 6B is a schematic diagram of an exemplary mechanical model of sound sensitive component 1720 according to some embodiments of the present disclosure. The sound sensitive component 1720 may be a diaphragm. As illustrated in FIG. 19B, the diaphragm may include a diaphragm 1921, a damping component 1923, and an elastic component 1925. A first end of the diaphragm 1921 may connect to a first end of the damping component 1923, and a first end of the elastic component 1925 (e.g., a spring). A second end of the damping component 1923 may be fixed. A second end of the elastic component 1925 may be fixed.

Figure 19C:
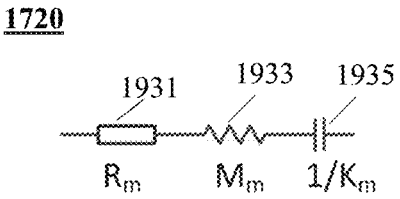
FIG. 19C is a schematic diagram of an exemplary equivalent circuit model corresponding to the mechanical model shown in FIGS. 6A and 6B according to some embodiments of the present disclosure.

FIG. 19C is a schematic diagram of an exemplary equivalent circuit model corresponding to the mechanical model shown in FIGS. 19A and 19B according to some embodiments of the present disclosure. The circuit may include a resistor 1931, an inductor 1933, and a capacitor 1935. A first end of the inductor 1933 may connect to a first end of the resistor 1931. A second end of the inductor 1933 may connect to a first end of the capacitor 1935. The circuit may constitute an RLC series circuit, which may act as a bandpass filter. The center frequency of the bandpass filter may be determined according to Equation (11) as follows:

$$\omega_0 = \sqrt{\frac{K_m}{M_m}}, \tag{11}$$

Where $M_m$ refers to the mass of the diaphragm, $K_m$ refers to the elasticity coefficient of the diaphragm, and $R_m$ refers to the damping of the diaphragm. $R_m$ may be adjusted to modify the bandwidth of the filter implemented by the RLC series circuit. In some embodiments, the acoustic structure, which may affect the path through which an audio signal is transmitted to the sound sensitive component 1720, or the sound sensitive component 1720, which may convert the audio signal to an electric signal, may affect the audio signal in both frequency domain and time domain. In some embodiments, one or more characteristics of the sound sensitive component 1720 may be adjusted by adjusting one or more non-linear time-varying characteristics of the materials of the sound sensitive component 1720 to meet certain filtering requirements. Exemplary non-linear time-varying characteristics may include hysteresis delay, creep, non-Newtonian characteristics, or the like, or a combination thereof.

FIG. 20A is a schematic diagram of a mechanical model of an exemplary sound sensitive component 1720 according to some embodiments of the present disclosure. In some embodiments, multiple sound sensitive components may be combined to achieve certain filtering characteristics.

As shown in FIG. 20A, the mechanical model may include a plurality of sound sensitive components. The sound sensitive components may be connected in parallel. The mechanical model corresponding to each sound sensitive component may include a diaphragm 2004, a damping component 2021, and an elastic component 2023. More detailed descriptions about an individual sound sensitive component may be found elsewhere in the present disclosure (e.g., FIGS. 19B and 19C, and the descriptions thereof). In some embodiments, the sound sensitive component 1720 including multiple sound sensitive components may perform multi-peak filtering, multi-center-frequency filtering, or multi-bandpass filtering.

Figure 20B:
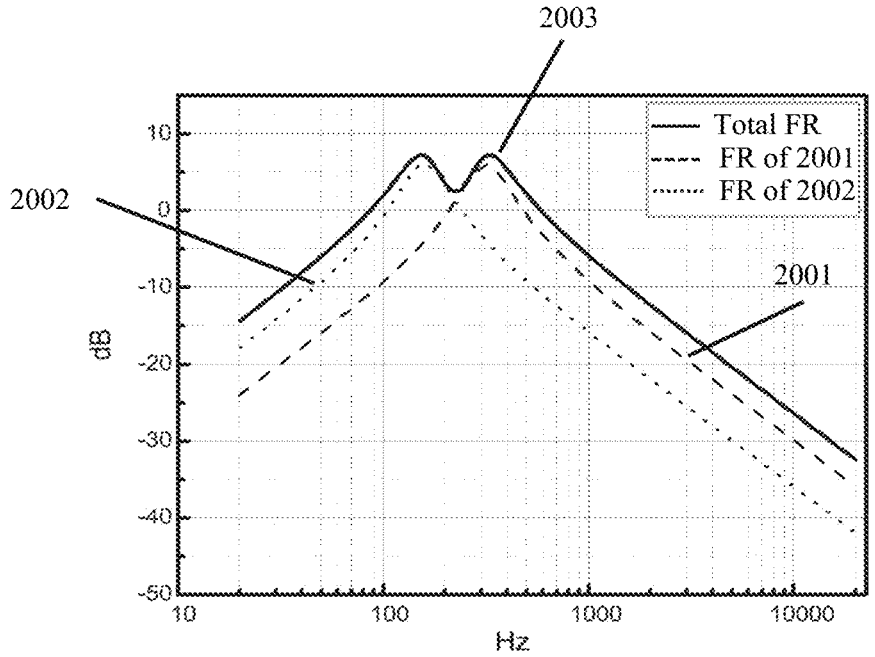
FIG. 20B illustrates exemplary frequency responses corresponding to different sound sensitive components according to some embodiments of the present disclosure.
Figure 21A:
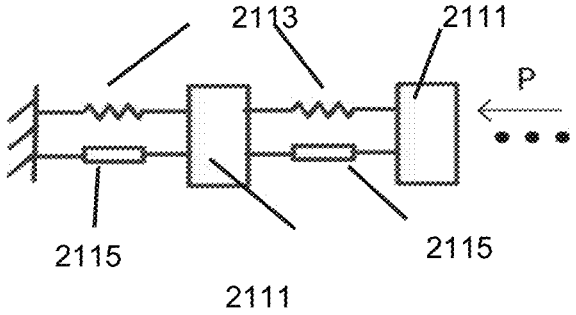
FIG. 21A is a schematic diagram of an exemplary mechanical model corresponding a sound sensitive component 420 according to some embodiments of the present disclosure.

FIG. 20B illustrates exemplary frequency responses corresponding to different sound sensitive components according to some embodiments of the present disclosure. The sound sensitive component 1720 include a first sound sensitive component and a second sound sensitive component. The first sound sensitive component and the second sound sensitive component may be connected in parallel. The center frequency of the first sound sensitive component may be different from the center frequency of the second-sensitive component. For example, as shown in FIG. 20B, dotted line 2001 represents the frequency response of the first sound sensitive component, while dashed line 2002 represents the frequency response of the second sound sensitive component. Solid line 2003 may indicate the frequency response of the combination of the first sound sensitive component and the second sound sensitive component. The bandwidth of the frequency response of the combination of the first sound sensitive component and the second sound sensitive component (i.e., the solid line 2003) is wider and flatter than the frequency response of the first sound sensitive component (i.e., the dotted line 2001) or the frequency response of the second sound sensitive component (i.e., the dashed line 2002).

In some embodiments, the frequency responses of the first sound sensitive component and the second sound sensitive component may intersect with each other. In some embodiments, the frequency responses of the first sound sensitive component and the second sound sensitive component may intersect at a frequency point that is not near the half-power point. As described in connection with FIGS. 23A-23C and the descriptions thereof, when the frequency responses of acoustic-electric transducers intersect near or at the half-power point(s), the frequency response of an acoustic-electric transducing module 1510 which includes the acoustic-electric transducers may be flatter than that of an acoustic-electric transducing module 1510 when the acoustic-electric transducers therein do not intersect near nor at the half-power point(s). However, since the first sound sensitive component and the second sound sensitive component are arranged in the same sound sensitive component 1720, and the overlap of the frequency responses of the first sound sensitive component and the second sound sensitive component may be overlap of vectors, in which the output phases of the first sound sensitive component and the second sound sensitive component should be taken into consideration. Thus, when the frequency response of the first sound sensitive component and the frequency response of the second sound sensitive component intersect at a frequency point that is not near the half-power point, the frequency response of a combination of the first sound sensitive component and the second sound sensitive component may be flatter and wider than that of a combination of two sound sensitive components that have frequency response that intersect at a frequency point near or at the half-power point.

Figure 20C:
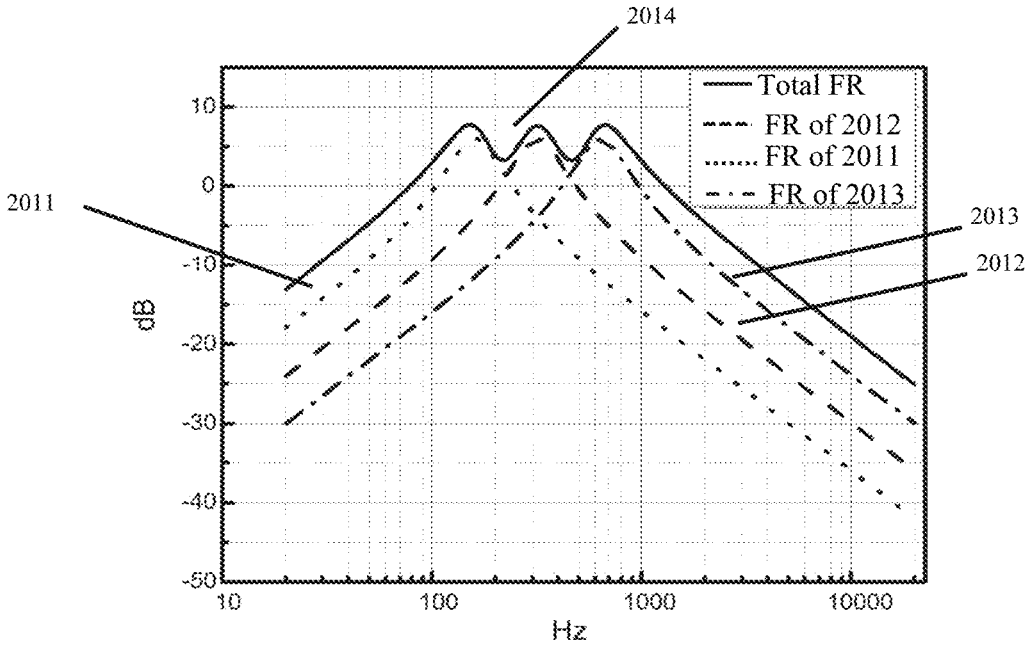
FIG. 20C illustrates exemplary frequency responses of different sound sensitive components according to some embodiments of the present disclosure.

FIG. 20C illustrates exemplary frequency responses of different sound sensitive components according to some embodiments of the present disclosure. As shown in FIG. 20C, the sound sensitive component 1720 may include a first sound sensitive component, a second sound sensitive component, and a third sound sensitive component, which are connected in parallel. The first sound sensitive component, the second sound sensitive component, and the third sound sensitive component may be underdamping sound sensitive components, and may be referred to as a first underdamping sound sensitive component, a second underdamping sound sensitive component, and a third underdamping sound sensitive component, respectively. The center frequency of each sound sensitive component may be different. For example, as shown in FIG. 20C, dotted line 2011, dashed line 2012, and dashed-dotted line 2013 represent the frequency responses of the first sound sensitive component, the second sound sensitive component, and the third sound sensitive component, respectively. Solid line 2014 may indicate the frequency response of the combination of the first sound sensitive component, the second sound sensitive component, and the third sound sensitive component. The bandwidth of the frequency response of the combination of the first sound sensitive component, the second sound sensitive component and the third sound sensitive component (i.e., solid line 2014) is wider and flatter than the frequency response of the first sound sensitive component (i.e., dotted line 2011, or referred to as a fourth frequency response), the frequency response of the second sound sensitive component (i.e., dashed line 2012, or referred to as a fifth frequency response), or the frequency response of the third sound sensitive component (i.e., dashed-dotted line 2013, or referred to as a sixth frequency response).

The center frequency of the second underdamping sound sensitive component (or referred to as a fifth center frequency) is higher than the center frequency of the first underdamping sound sensitive (or referred to as a fourth center frequency), and the center frequency of the third underdamping sound sensitive component (or referred to as a sixth center frequency) is higher than the center frequency of the second underdamping sound sensitive.

In some embodiments, the fourth frequency response and the fifth frequency response intersect at a point which is near a half-power point of the fourth frequency response and a half-power point of the fifth frequency response. That is, the fourth frequency response and the fifth frequency response intersect at a point with a power level no smaller than −5 dB and no larger than −1 dB.

As described in connection with FIG. 20B, when the frequency responses of the first sound sensitive component and the second sound sensitive component, and the third sound sensitive component may intersect at frequency points that are not near the half-power point, the frequency response of the combination of the first sound sensitive component and the second sound sensitive component, and the third sound sensitive component may be flatter and wider than that of a combination of three sound sensitive components that have frequency response that intersect at frequency points near or at the half-power point.

FIG. 21A is a schematic diagram of an exemplary mechanical model corresponding a sound sensitive component 1720 according to some embodiments of the present disclosure. The mechanical model corresponding to the sound sensitive component 1720 may include a plurality of sound sensitive components. The plurality of sound sensitive components may be connected in serial. For example, as illustrated in FIG. 21A, the sound sensitive component 1720 may include two sound sensitive components, each of which may include a diaphragm 2111, a damping component 2115, and an elastic component 2113. An audio signal (the sound pressure being P) may arrive at a diaphragm 2111, and cause the sound sensitive component 1720 to generate an electric signal (not shown). More detailed descriptions of an individual sound sensitive component may be found elsewhere in the present disclosure (e.g., FIGS. 19B and 19C, and the descriptions thereof).

Figure 21B:
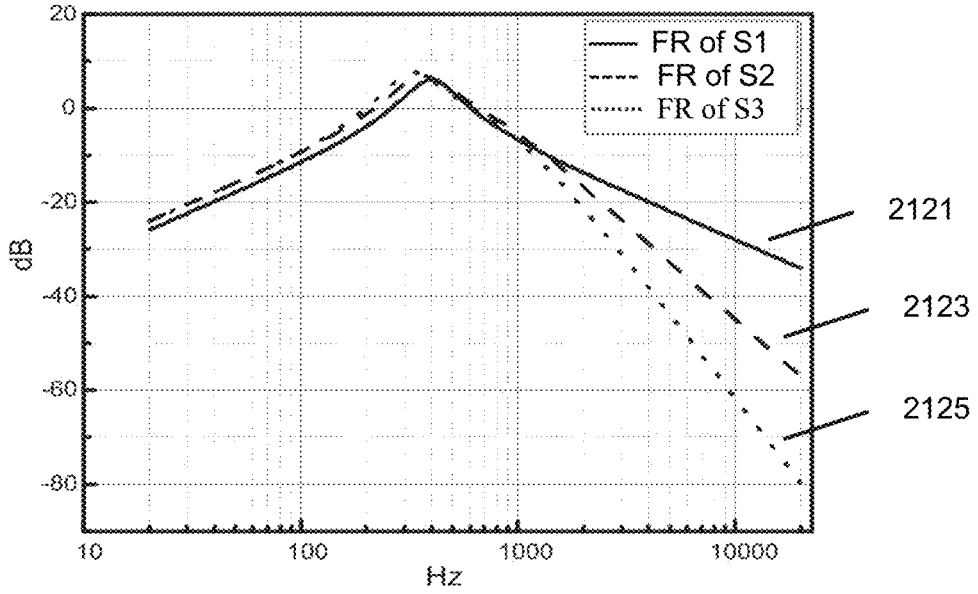
FIG. 21B illustrates exemplary frequency responses corresponding to different sound sensitive components according to some embodiments of the present disclosure.

FIG. 21B illustrates exemplary frequency responses corresponding to different sound sensitive components according to some embodiments of the present disclosure. Solid line 2121 represents the frequency response of one sound sensitive component. Dotted line 2123 represents the frequency response of a combination of two sound sensitive components connected in serial. Dashed line 2125 represents the frequency response of a combination of three sound sensitive components connected in serial. As illustrated by FIG. 21B, the number of sound sensitive components may affect the frequency response of the acoustic-transducing device in which they are arranged. The frequency response of the combination of three sound sensitive components connected in serial (i.e., dashed line 2125) may have a steeper edge than the frequency response of the combination of two sound sensitive components connected in serial (i.e., dashed line 2123). The frequency response of the combination of the two sound sensitive components connected in serial (i.e., dashed line 2123) may have a steeper edge than the frequency response of one sound sensitive component (i.e., solid line 2121). In some embodiments, when more sensitive components are arranged in a same acoustic-transducing device, the order of the acoustic-transducing device may increase.

In some embodiments, three sound sensitive components may be connected in series. As known to those skilled in the art, a sound sensitive component may have a lower cut-off frequency and an upper cut-off frequency. In some embodiments, the center frequency of any of the three sound sensitive components may be larger than the smallest cut-off frequency among the lower cut-off frequencies of the three sound sensitive components, and no larger than the largest cut-off frequency among the upper cut-off frequencies of the three sound sensitive components.

Figure 22A:
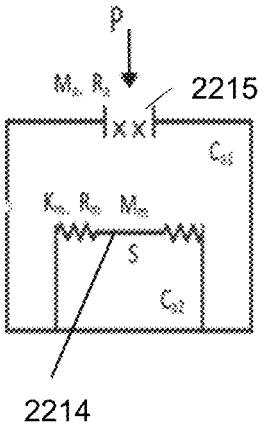
FIG. 22A illustrates a structure of a combination of an acoustic channel component and a sound sensitive component according to some embodiments of the present disclosure.

FIG. 22A illustrates a structure of a combination of an acoustic channel component and a sound sensitive component according to some embodiments of the present disclosure. The structure may be embodied as a diaphragm microphone with a front chamber and a rear chamber. As shown in FIG. 22A, an audio signal (the sound pressure being P) may first arrive at a sound hole 2215 of an acoustic channel component, which may include an acoustic resistance material, and then arrive at a diaphragm 2214 and a rear chamber of a sound sensitive component. P is the sound pressure on the microphone caused by an audio signal, and S is the effective area of the diaphragm. More detailed descriptions about the acoustic channel component may be found elsewhere in the present disclosure (e.g., FIGS. 18A and 18B and the descriptions thereof). More detailed descriptions about the sound sensitive component may be found elsewhere in the present disclosure (e.g., FIGS. 19A-19C and the descriptions thereof).

Figure 22B:
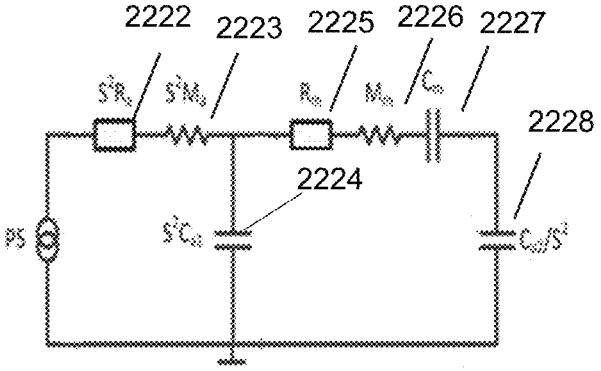
FIG. 22B is a schematic diagram of an exemplary equivalent circuit of the combination structure shown in FIG. 9A according to some embodiments of the present disclosure.
Figure 22C:
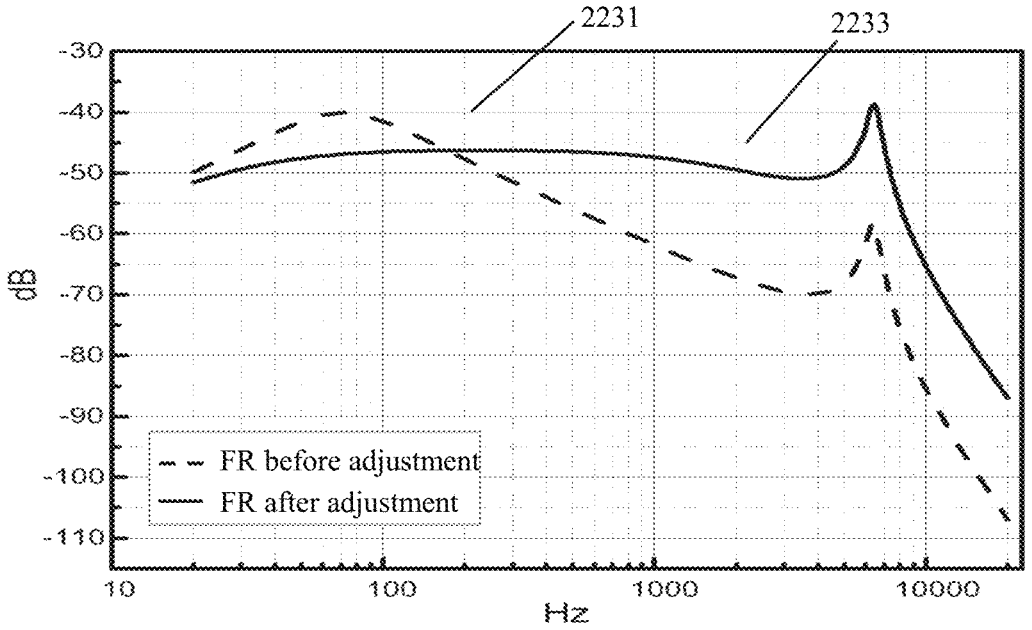
FIG. 22C illustrates exemplary frequency responses of two combination structures according to some embodiments of the present disclosure.
Figure 22D:
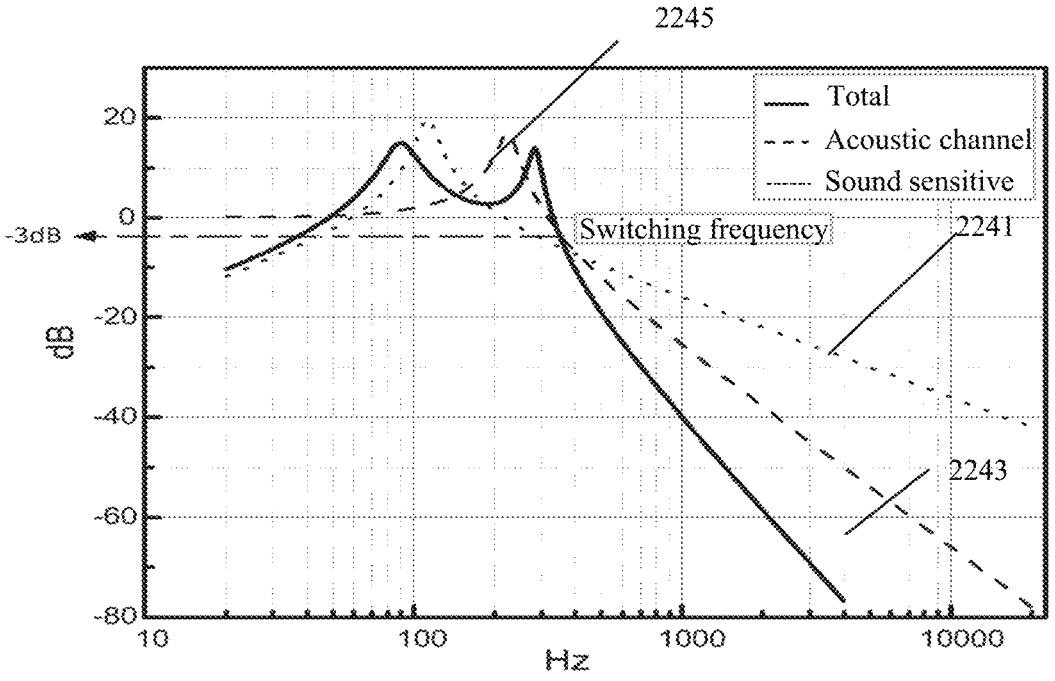
FIG. 22D illustrates an exemplary frequency response of a combination structure according to some embodiments of the present disclosure.

FIG. 22B is a schematic diagram of an exemplary circuit of the combination structure shown in FIG. 22A according to some embodiments of the present disclosure. In the circuit, a resistor 2222 (with a resistance $S^2R_a$) and an inductor 2223 (with an inductance $S^2M_a$) may indicate the acoustic resistance and the acoustic mass of the sound hole. A capacitor 2224 (with a capacitance $S^2C_{a1}$) may indicate the acoustic capacitance of the front chamber. A capacitor 2228 (with a capacitance $C_{a2}/S^2$) may indicate the acoustic capacitance of the rear chamber. A resistor 2225 (with a resistance $R_m$), an inductor 2226 (with an inductance $M_m$), and a capacitor 2227 (with a capacitance $C_m$) may indicate the resistance of the diaphragm, the mass of the diaphragm, and the elasticity coefficient of the diaphragm, respectively.

FIGS. 23A-23C illustrate frequency responses of different acoustic-electric transducing modules according to some embodiments of the present disclosure. FIG. 23A, FIG. 23B, and FIG. 23C illustrate the frequency response of a first acoustic-electric transducing module, a second acoustic-electric transducing module, and a third acoustic-electric transducing module, respectively. Each of the first acoustic-electric transducing modules, the second acoustic-electric transducing module, and the third acoustic-electric transducing module may include three acoustic-electric transducers. As illustrated in FIG. 23A, the first acoustic-electric transducing module may include a transducer 1, a transducer 2, and a transducer 3. The frequency response of the transducer 1 intersects with the frequency response of the transducer 2 at a frequency point that is not near the half-power point, and the frequency response of the transducer 2 intersects with the frequency response of the transducer 3 at a frequency point that is not near the half-power point. As illustrated in FIG. 23B, the first acoustic-electric transducing module may include a transducer 4 (e.g., the first acoustic-electric transducer), a transducer 5 (e.g., the second acoustic-electric transducer), and a transducer 6 (e.g., the third acoustic-electric transducer). The transducer 4 has a first frequency bandwidth, and the transducer 5 has a second frequency bandwidth different from the first frequency bandwidth. The second frequency bandwidth is larger than the first frequency bandwidth, and the center frequency of the transducer 5 is higher than the center frequency of the transducer 4. The center frequency of the transducer 6 is higher than the center frequency of the transducer 5.

The frequency response of the transducer 4 intersects with the frequency response of the transducer 5 at a frequency point near the half-power point, and the frequency response of the transducer 5 intersects with the frequency response of the transducer 6 at a frequency point near the half-power point. For example, the frequency response of the transducer 4 and the frequency response of the transducer 5 intersect at a point which is near a half-power point of the frequency response of the transducer 4 and a half-power point of the frequency response of the transducer 5. As illustrated, the frequency response of the transducer 4 and the frequency response of the transducer 5 intersect at a point with a power level no smaller than −5 dB and no larger than −1 dB.

As illustrated in FIG. 23C, the first acoustic-electric transducing module may include a transducer 7, a transducer 8, and a transducer 9. The frequency response of the transducer 7 intersects with the frequency response of the transducer 8 at a frequency point not near the half-power point, and the frequency response of the transducer 8 intersects with the frequency response of the transducer 9 at a frequency point not near the half-power point. As illustrated by FIGS. 23A-23C, the frequency response of the second acoustic-electric transducing module may be flatter than the frequency response of the first acoustic-electric transducing module, and the frequency response of the third acoustic-electric transducing module indicate more interferences from adjacent channels than the frequency response of the second acoustic-electric transducing module. Descriptions illustrated below may be provided to illustrate the relationship between the frequency response of an acoustic-electric transducing module and where the acoustic-electric transducers in the acoustic-electric transducing module intersect with each other.

Frequency responses of the acoustic-electric transducers may intersect with each other at certain frequency points, resulting in a certain overlap range between the frequency responses. As used herein, an overlap range relates to the frequency point at which the frequency responses intersect with each other. The overlap of the frequency responses of acoustic-electric transducers may cause interferences in adjacent channels that are configured to output electric signals generated by the acoustic-electric transducers in the acoustic-electric transducing module 1510. In some cases, the larger the overlap range, the more interference may be. The center frequencies and bandwidths of the response frequencies of the acoustic-electric transducers may be adjusted to obtain a narrower overlap range among frequency responses of the acoustic-electric transducers.

For example, the acoustic-electric transducing module 1510 may include multiple first-order acoustic-electric transducers. The center frequency of each of the acoustic-electric transducers may be adjusted by adjusting structure parameters thereof, to achieve certain overlap ranges. The overlap range between two frequency responses of two adjacent acoustic-electric transducers may relate to the interference range between the sub-band signals output by the acoustic-electric transducers. In an ideal scenario, no overlap range between two frequency responses of two adjacent acoustic-electric transducers. In practice, however, a certain overlap range may exist between two frequency responses of two adjacent acoustic-electric transducers, which may affect the quality of the sub-band signals output by the two acoustic-electric transducers. If a relatively small overlap range between two frequency responses of two adjacent acoustic-electric transducers, the frequency response of a combination of the two adjacent acoustic-electric transducers may decrease within the overlap range. The decrease in the frequency response in a certain frequency band may indicate the decrease of power level in the frequency band. As used herein, the overlap range between two frequency responses may be deemed relatively small when the frequency responses intersect at a frequency point with a power level smaller than −5 dB. If a relatively large overlap band exists between two frequency responses of two adjacent acoustic-electric transducers, the frequency response of a combination of the two adjacent acoustic-electric transducers may increase within the overlap range. The increase in the frequency response in a certain frequency band may indicate a higher power level in the frequency band compared with that in other frequency ranges. The overlap range between two frequency responses may be deemed relatively small when the frequency responses intersect at a frequency point with a power level larger than −1 dB. When the frequency responses of two adjacent acoustic-electric transducers intersect near or at half-power point, the frequency response of each acoustic-electric transducer may contribute to the frequency response of a combination of the two adjacent acoustic-electric transducers in a such a manner that there is no loss nor repetition of energies in certain frequency bands, which may result in a proper overlap band between the frequency responses of two adjacent acoustic-electric transducers. The frequency responses of two adjacent acoustic-electric transducers may be deemed to intersect near or at half-power point when the frequency responses intersect at a frequency point with a power level no smaller than −5 dB and no larger than −1 dB. In some embodiments, via adjusting structure parameters of at least one acoustic-electric transducer of the two adjacent acoustic-electric transducers, the center frequency and the frequency bandwidth of the at least one acoustic-electric transducer of the two adjacent acoustic-electric transducers may be adjusted, resulting in adjusted overlap regions among the acoustic-electric transducers accordingly.

Figure 25:
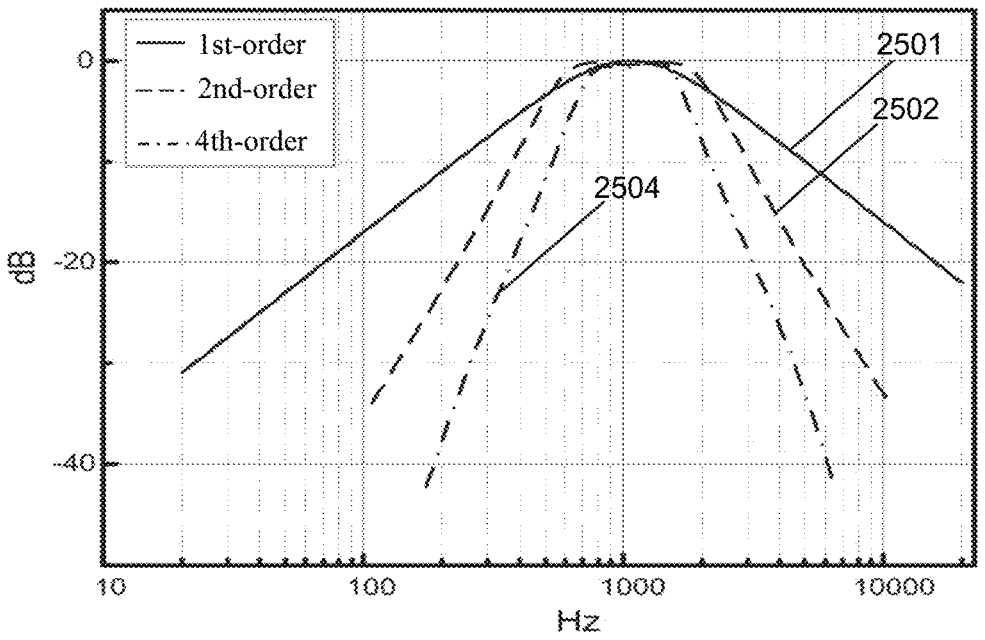
FIG. 25 illustrates the frequency responses of acoustic-electric transducers of different orders according to some embodiments of the present disclosure.

FIG. 25 illustrates the frequency responses of acoustic-electric transducers of different orders according to some embodiments of the present disclosure. The acoustic-electric transducing module 1510 includes a plurality of acoustic-electric transducers. The frequency responses of the acoustic-electric transducers may overlap, introducing interference between adjacent signal processing channels in the acoustic-electric transducing module 1510. As illustrated in FIG. 25, sold line 2501 represents the frequency response of a first-order acoustic-electric transducer, dotted line 1202 represents the frequency response of a second-order acoustic-electric transducer, while dashed-dotted line 2504 represents the frequency response of a fourth-order acoustic-electric transducer. The bandpass edge of the frequency response of the fourth-order acoustic-electric transducer (i.e., dashed-dotted line 2504) may be steeper than that of the second-order acoustic-electric transducer (i.e., dotted line 2502). The bandpass edge of the frequency response of the second-order acoustic-electric transducer (i.e., dotted line 2502) may be steeper than that of the first-order acoustic-electric transducer (i.e., sold line 2501). In some embodiments, the higher order of an acoustic-electric transducer, the greater the slope of the bandpass edge of the acoustic-electric transducer may be. According to the theoretical analysis, the slope of the bandpass edge of a first-order acoustic-electric transducer may be 6 dB/oct, and when the order of an acoustic-electric transducer increased by every 1 order, the slope of the bandpass edge may increase by 6 dB/oct. Thus, employing multi-order acoustic-electric transducer in acoustic-electric transducer module 1510 may allow more acoustic-electric transducer to be included therein, which is usually desirable to ensure a wider coverage of the frequency band of an audio signal detected.

In some embodiments, the acoustic-electric transducers in the acoustic-electric transducing module 1510 may be underdamping bandpass acoustic-electric transducers. In some embodiments, an underdamping bandpass acoustic-electric transducer may have a steeper slope than a non-underdamping bandpass acoustic-electric transducer, near the resonance peak in the frequency response of the acoustic-electric transducer. In some embodiments, the maximum number of acoustic-electric transducers allowed in a certain frequency band may be determined according to the filtering characteristics of the bandpass acoustic-electric transducers. For example, given that the frequency responses of the acoustic-electric transducers intersect with each other at half-power points, for a certain frequency range, the maximum number of the acoustic-electric transducers of certain order that may be allowed to be included in one acoustic-electric transducing module 1510 may be shown in table 1:

TABLE 1

| The numbers of acoustic-electric transducers to be included | | | |
|---|---|---|---|
| | Frequency band | | |
| Order | 20 Hz-20 kHz | 100 Hz-8 kHz | 300 Hz-4000 Hz |
| 1 | 10 | 7 | 4 |
| 2 | 20 | 13 | 8 |
| 3 | 30 | 19 | 12 |
| 4 | 40 | 26 | 15 |

For example, for the frequency band 20 Hz-20 kHz, an acoustic-electric transducing module 1510 may include no more than 10 first-order acoustic-electric transducers. In some embodiments, via adjusting of one or more acoustic-electric transducers in an acoustic-electric transducing module 1510 to an under-damped state, the acoustic-electric transducing module 1510 may have a larger order. It is to be expressly understood, however, that Table 1 is for the purpose of illustration and description only and is not intended to limit the scope of the present disclosure. In some embodiments, various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure. In some embodiments, the acoustic-electric transducing module 1510 may include a plurality of first acoustic-electric transducers. In some embodiments, the acoustic-electric transducing module 1510 includes no more than 10 first-order acoustic-electric transducers, wherein each first-order acoustic-electric transducer corresponds to a frequency band whose width is no larger than 20 kHz. In some embodiments, the acoustic-electric transducing module 1510 includes no more than 20 second-order acoustic-electric transducers, wherein each second-order acoustic-electric transducer corresponds to a frequency band whose width is no larger than 20 kHz. In some embodiments, the acoustic-electric transducing module 1510 includes no more than 30 third-order acoustic-electric transducers, wherein each third-order acoustic-electric transducer corresponds to a frequency band whose width is no larger than 20 kHz. In some embodiments, the acoustic-electric transducing module 1510 includes no more than 40 fourth-order acoustic-electric transducers, wherein each fourth-order acoustic-electric transducer corresponds to a frequency band whose width is no larger than 20 kHz. In some embodiments, the acoustic-electric transducing module 1510 includes no more than 8 first-order acoustic-electric transducers, wherein each first-order acoustic-electric transducer corresponds to a frequency band whose width is no larger than 8 kHz. In some embodiments, the acoustic-electric transducing module 1510 includes no more than 13 second-order acoustic-electric transducers, wherein each second-order acoustic-electric transducer corresponds to a frequency band whose width is no larger than 8 kHz. In some embodiments, the acoustic-electric transducing module 1510 includes no more than 19 third-order acoustic-electric transducers, wherein each third-order acoustic-electric transducer corresponds to a frequency band whose width is no larger than 8 kHz. In some embodiments, the acoustic-electric transducing module 1510 includes no more than 26 fourth-order acoustic-electric transducers, wherein each fourth-order acoustic-electric transducer corresponds to a frequency band whose width is no larger than 8 kHz. In some embodiments, the acoustic-electric transducing module 1510 includes no more than 4 first-order acoustic-electric transducers, wherein each first-order acoustic-electric transducer corresponds to a frequency band whose width is no larger than 4 kHz. In some embodiments, the acoustic-electric transducing module 1510 includes no more than 8 second-order acoustic-electric transducers, wherein each second-order acoustic-electric transducer corresponds to a frequency band whose width is no larger than 4 kHz. In some embodiments, the acoustic-electric transducing module 1510 includes no more than 12 third-order acoustic-electric transducers, wherein each third-order acoustic-electric transducer corresponds to a frequency band whose width is no larger than 4 kHz. In some embodiments, the acoustic-electric transducing module 1510 includes no more than 15 fourth-order acoustic-electric transducers, wherein each fourth-order acoustic-electric transducer corresponds to a frequency band whose width is no larger than 4 kHz.

FIGS. 26A and 26B illustrate the frequency responses of exemplary acoustic-electric transducing modules according to some embodiments of the present disclosure. FIG. 26A illustrates the frequency response of a first-order bandpass acoustic-electric transducing module (referred to as first-order bandpass acoustic-electric transducing module 1). FIG. 26B illustrates frequency responses of a first-order bandpass acoustic-electric transducing module (referred to as first-order bandpass acoustic-electric transducing module 2). The acoustic-electric transducer(s) in the first-order bandpass acoustic-electric transducing module 1 are non-underdamping acoustic-electric transducers, while the acoustic-electric transducer(s) in the first-order bandpass acoustic-electric transducing module 1 are underdamping acoustic-electric transducers. As can be seen from FIG. 26A and FIG. 26B, more acoustic-electric transducers may be included in an acoustic-electric transducing module when the acoustic-electric transducers are underdamping ones rather than non-underdamping ones. The first-order bandpass acoustic-electric transducing module 1 and the first-order bandpass acoustic-electric transducing module 2 includes 4 first-order bandpass acoustic-electric transducers and 6 first-order bandpass acoustic-electric transducers, respectively. The solid line in FIG. 26A represents the frequency response of the first-order bandpass acoustic-electric transducing module 1. The 4 dotted lines in FIG. 26A represent the frequency responses of the 4 acoustic-electric transducers respectively. The solid line in FIG. 26B represents the frequency response of the first-order bandpass acoustic-electric transducing module 2. The 6 dotted lines in FIG. 26B represent the frequency responses of the 6 acoustic-electric transducers respectively.

In some embodiments, the acoustic-electric transducing module may be regarded as a filter configured to achieve a designated filtering effect. In some embodiments, the filter may be a first-order filter or a multi-order filter. In some embodiments, the filter may be a linear or non-linear filter. In some embodiments, the filter may be a time-varying or non-time-varying filter. The filter may include a resonance filter, a Roex function filter, a Gamatone filter, a Gamachirp filter, etc.

In some embodiments, acoustic-electric transducing module may be a Gamatone filter. Specifically, bandwidths of the frequency responses of acoustic-electric transducers in the acoustic-electric transducing module may be different. Further, the acoustic-electric transducer having a higher center frequency may be set to have a larger bandwidth. Further, in some embodiments, the center frequency $f_c$ of an acoustic-electric transducer may be determined according to Equation (12) as follows:

$$f_c = (f_H + 228.7)\exp\left(-\frac{\alpha}{9.26}\right) - 228.7, \tag{12}$$

where $f_H$ refers to the cutoff frequency, and a refers to the overlap factor.

The bandwidth B of the acoustic-electric transducer may be set according to Equation (13) as follows:

$$B = 24.7\times\left(4.37\times\frac{f_c}{1000}+1\right). \tag{13}$$

Figure 27A:
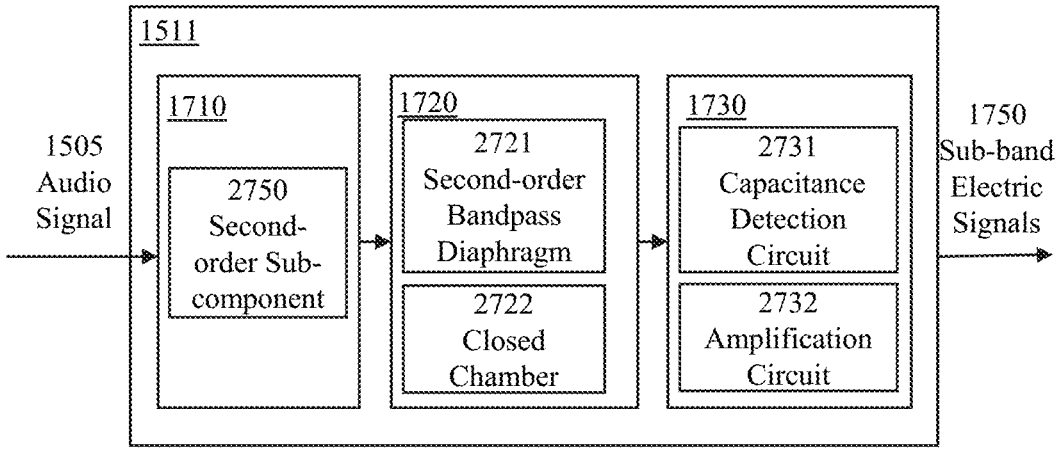
FIG. 27A is a schematic diagram of an exemplary acoustic-electric transducer according to some embodiments of the present disclosure.

FIG. 27A is a schematic diagram of an exemplary acoustic-electric transducer 1511 according to some embodiments of the present disclosure. The acoustic-electric transducer 1511 may include an acoustic channel component 1710, a sound sensitive component 1720, and a circuit component 1730.

The acoustic channel component 1710 may include a second-order component 2750. The sound sensitive component 1720 may include a second-order bandpass diaphragm 2721, and a closed chamber 2722. The circuit component 1730 may include a capacitance detection circuit 2731, and an amplification circuit 2732.

The acoustic-electric transducer 1511 may be an air-conduction acoustic-electric transducer with two cavities. A diaphragm of the second-order bandpass diaphragm 2721 may be used to convert a change of sound pressure caused by an audio signal on the diaphragm surface into a mechanical vibration of the diaphragm. The capacitance detection circuit 2731 may be used to detect the change of a capacitance between the diaphragm and a plate caused by the vibration of the diaphragm. The amplification circuit 2732 may be used to adjust the amplitude of the output voltage. A sound hole may be provided in a first chamber, and the sound hole may be provided with an acoustic resistance material as needed. A second chamber may be closed. The acoustic impedance of the sound hole and the surrounding air may be inductive. The resistive material may have acoustic impedance. The first chamber may have capacitive acoustic impedance. The second chamber may have capacitive acoustic impedance. As used herein, the first chamber may also be referred to as a front chamber, and the second chamber may be referred to as a rear chamber.

Figure 27B:
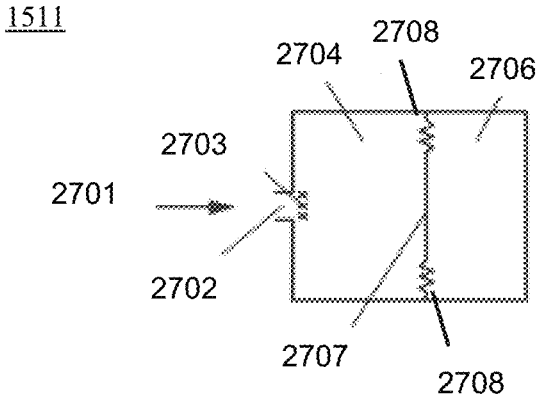
FIG. 27B is a schematic diagram of an exemplary acoustic force generator of the acoustic-electric transducer shown in FIG. 14A according to some embodiments of the present disclosure.

FIG. 27B is a schematic diagram of an exemplary acoustic force generator of the acoustic-electric transducer shown in FIG. 27A according to some embodiments of the present disclosure.

The acoustic force generator may detect an audio signal 2701, and may include a first chamber 1404 and a second chamber 2706. The first chamber 1404 may include a sound hole 2702 and a sound resistance material 2703 embedded in the sound hole 2702. The first chamber 2704 and the second chamber 2706 may be separated by a diaphragm 2707. The diaphragm 2707 may connect an elastic component 2708.

Figure 27C:
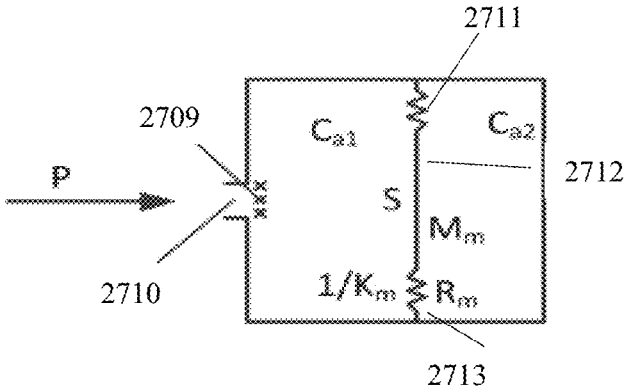
FIG. 27C is a schematic diagram of an exemplary structure of the acoustic force generator shown in FIG. 14B according to some embodiments of the present disclosure.

FIG. 27C is a schematic diagram of an exemplary structure of the acoustic force generator shown in FIG. 27B according to some embodiments of the present disclosure. As shown in FIG. 27C, sound pressure P may pass through an acoustic resistance material 2709 embedded in a sound hole 2710. The sound pressure P may be converted into a vibration of a diaphragm 2712. Prefers to the sound pressure arriving at the microphone, $R_{a1}$ refers to the sound resistance of the acoustic material 2709, $M_{a1}$ refers to the mass near the sound hole 2710, $C_{a1}$ refers to the sound capacity of the first chamber, S is an effective area of the diaphragm 2712, $R_m$ refers to damping of the diaphragm 2712, $M_m$ refers to the mass of the diaphragm 2712, $K_m$ refers to the elastic modulus of the diaphragm 2712, and $C_{a2}$ refers to the sound capacity of the first chamber.

Figure 27D:
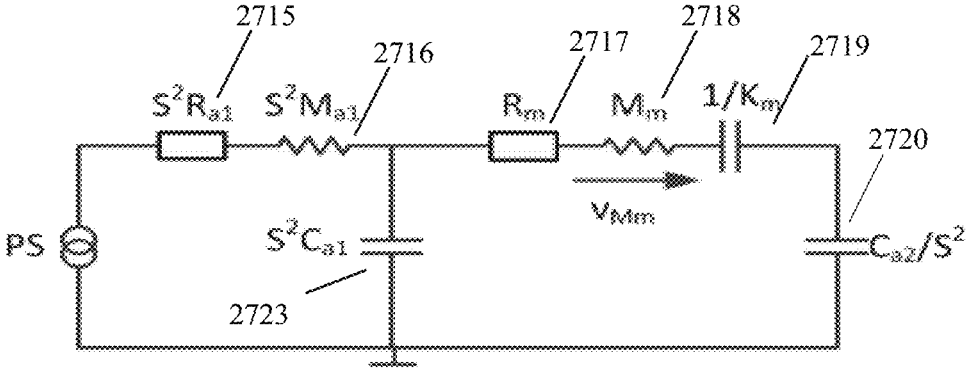
FIG. 27D is a schematic diagram of an equivalent circuit of the structure shown in FIG. 14C according to some embodiments of the present disclosure.

FIG. 27D is a schematic diagram of an exemplary circuit of the structure shown in FIG. 27B and FIG. 27C according to some embodiments of the present disclosure. In the circuit, a resistor 2715 (with a resistance $S^2R_a$) and an inductor 2716 (with an inductance $S^2M_a$) may indicate the acoustic resistance and the acoustic mass of the sound hole 2710. A capacitor 2723 (with a capacitance $S^2C_{a1}$) may indicate the acoustic capacitance of the first chamber 2704. A capacitor 2720 (with a capacitance $C_{a2}/S^2$) may indicate the acoustic capacitance of the second chamber 2706. A resistor 2717 (with a resistance $R_m$), an inductor 2718 (with an inductance $M_m$), and a capacitor 2719 (with a capacitance $C_m$) may indicate the resistance of the diaphragm 2707, the mass of the diaphragm 2707, and the elasticity coefficient of the diaphragm 2707, respectively.

In the circuit, circuit current corresponds to a vibration velocity of the diaphragm 2712. The vibration velocity $V_{Mm}$ may be determined according to Equation (14) as follows:

$$v_{Mm} = PS\cdot\frac{Z_2}{Z_1+Z_2}\cdot\frac{1}{A} = P\cdot\frac{1}{(R_{a1}+j\omega M_{a1})(j\omega C_{a1}\cdot A+1)+A}, \tag{14}$$

where ω refers to the angular frequency of the acoustic structure (e.g., the acoustic force structure illustrated in FIG. 27C), j refers to an unit imaginary number, $Z_1$ refers to the acoustic impedance of the resistor 2715 and the inductor 2716, $Z_2$ refers to the acoustic impedance of the resistor 2717, the inductor 2718, the capacitor 2719, and the capacitor 2720, the descriptions of P, S, $R_{a1}$, $M_{a1}$, and $C_{a1}$ may be found in FIG. 27C and descriptions thereof, and A may be determined according to Equation (15) as follows:

$$A = R_m + j\omega M_m + \frac{K_m + \frac{1}{C_{a2}}}{j\omega}, \tag{15}$$

where ω refers to the angular frequency of the acoustic structure (e.g., the acoustic force structure illustrated in FIG. 27C), j refers to an unit imaginary number, and the descriptions of $R_m$, $M_m$, $K_m$, and $C_{a2}$ may be found in FIG. 27C and descriptions thereof.

Further, a capacitance change output by the system is related to a distance between the diaphragm and the plate, and the distance between the diaphragm and the plate is related to deformation of the diaphragm (displacement of the diaphragm). Therefore, the displacement of the diaphragm may be determined according to Equation (16) as follows:

$$\begin{aligned} S_{Mm}(t) &= \int v_{Mm}(t)dt \\ &= \frac{1}{(R_{a1}+j\omega M_{a1})(j\omega C_{a1}\cdot A+1)+A}\cdot e^{j\omega t}dt \\ &= PSe^{j\omega t}\cdot\frac{1}{j\omega}\cdot\frac{1}{(R_{a1}+j\omega M_{a1})(j\omega C_{a1}\cdot A+1)+A}, \end{aligned} \tag{16}$$

Wherein the descriptions of P, S, $R_{a1}$, $M_{a1}$, and $C_{a1}$ may be found in FIG. 27C and descriptions thereof.

A transfer function of the system may be determined according to equation (17) as follows:

$$\frac{S_{Mm}}{PSe^{j\omega t}} = \frac{1}{j\omega} \cdot \frac{1}{(R_{a1} + j\omega M_{a1})(j\omega C_{a1} \cdot A + 1) + A}, \tag{17}$$

where ω refers to the angular frequency of the acoustic structure (e.g., the acoustic force structure illustrated in FIG. 27C), j refers to an unit imaginary number, and the descriptions of $R_{a1}$, $M_{a1}$, and $C_{a1}$ may be found in FIG. 27C and descriptions thereof.

By performing a Laplace transform, the transfer function may be expressed as follows:

$$G(s) = \frac{1}{a_4 s^4 + a_3 s^3 + a_2 s^2 + a_1 s + a_0}, \tag{18}$$

where $$a_0 = K_m + \frac{S^2}{C_{a2}}, \tag{19}$$

$$a_1 = R_m + S^4 R_{a1} K_m C_{a1} + \frac{S^6 R_{a1} C_{a1}}{C_{a2}} + S^2 R_{a1}, \tag{20}$$

$$a_2 = M_m + S^4 R_{a1} R_m C_{a1} + S^4 M_{a1} K_m C_{a1} + \frac{S^6 M_{a1} C_{a1}}{C_{a2}} + S^2, \tag{21}$$

$$a_3 = S^4 M_m R_{a1} C_{a1} + S^4 M_{a1} R_m C_{a1}, \tag{22}$$

$$a_4 = S^4 M_{a1} M_m C_{a1}. \tag{23}$$

As a result, a combination of the first chamber corporate with a sound hole may function as a multi-order bandpass filter (e.g., a second-order bandpass filter), and a combination of the second chamber, which a closed-chamber and the diaphragm may function as a second-order bandpass filter. The diaphragm, which may function as an acoustic-sensitive element, may convert the audio signal into a change of a capacitance between the diaphragm and the plate. In some embodiments, a fourth-order system may be formed by combining the acoustic channel component and the acoustic-sensitive component.

An acoustic-electric transducer constructed in accordance with the above-described configuration may function as a bandpass filter. A plurality of the acoustic-electric transducers with different filtering characteristics may be set in the acoustic-electric transducing module 1510 to form a filter group, which may generate a plurality of sub-band signals according to the audio signal. In some embodiments, the acoustic-electric transducer may be adjusted to a non-underdamping state through adjustment of damping of the acoustic resistance material and the diaphragm of the acoustic-electric transducer. A frequency bandwidth of each acoustic-electric transducer may be set to increase as a center frequency increases.

Figure 28:
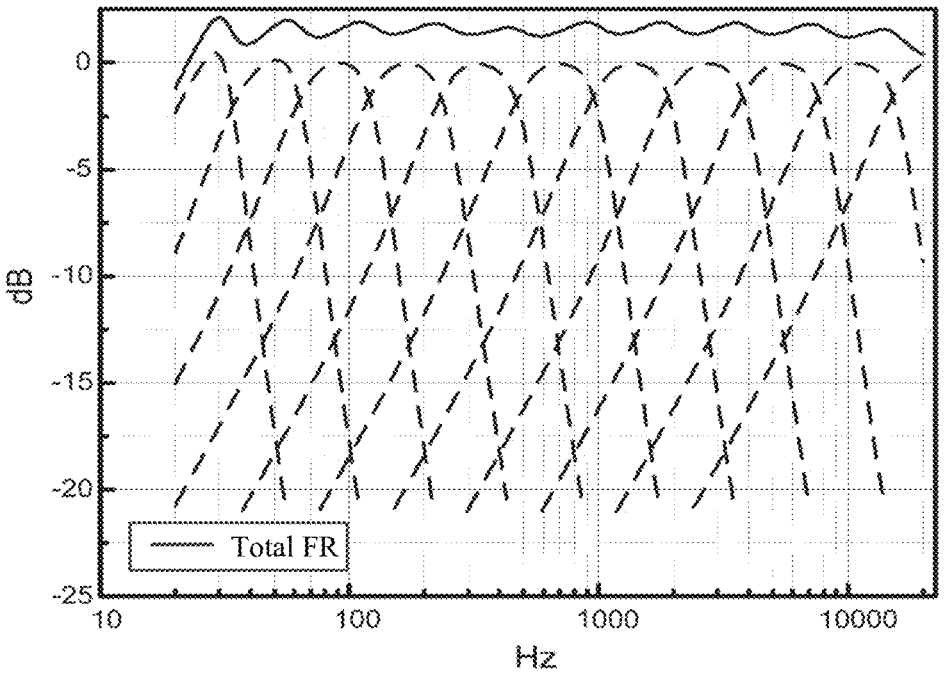
FIG. 28 illustrates an exemplary frequency response of an acoustic-electric transducing module according to some embodiments of the present disclosure.

FIG. 28 illustrates an exemplary frequency response of an acoustic-electric transducing module according to some embodiments of the present disclosure. The acoustic-electric transducing module may include 11 acoustic-electric transducers. 11 dotted lines in FIG. 28 represent the frequency responses of the individual 11 acoustic-electric transducers. The solid line in FIG. 28 may indicate the frequency response of the acoustic-electric transducing module. As illustrated above, multiple acoustic-electric transducers, each of which may function as a bandpass filter for an audio signal, may be arranged in the same acoustic-electric transducing module, and generate sub-band signals according to an audio signal. As shown in FIG. 28, frequency responses of the eleven acoustic-electric transducers may cover the audible frequency band of the human ear 20 Hz-20 kHz, only the frequency band 20 Hz-10 kHz is shown in FIG. 28. The frequency responses of the 11 acoustic-electric transducers may intersect at frequency points with energies that range from −1 dB to −5 dB, and the frequency response of the acoustic-electric transducing module may have a power level fluctuation within ±1 dB.

Figure 29A:
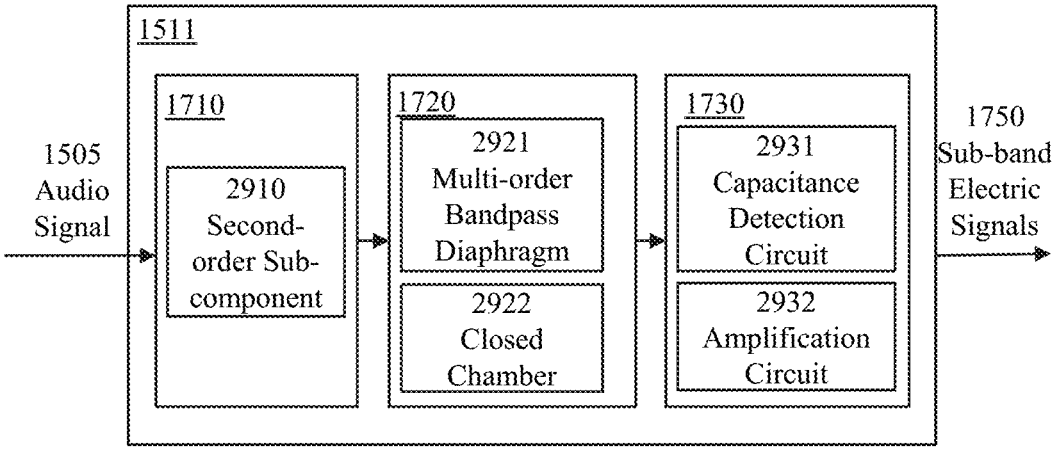
FIG. 29A is a schematic diagram of an exemplary acoustic-electric transducer according to some embodiments of the present disclosure.

FIG. 29A is a schematic diagram of an exemplary acoustic-electric transducer 1511 according to some embodiments of the present disclosure. The acoustic-electric transducer 1511 may include an acoustic channel component 1710, a sound sensitive component 1720, and a circuit component 1730. The acoustic channel component 1710 may include a second-order component 2910. The sound sensitive component 1720 may be a multi-order bandpass diaphragm 2921, and a closed chamber 2922. The circuit component 1730 may include a capacitance detection circuit 2931, and an amplification circuit 2932.

The acoustic-electric transducer 1511 may be an air-conduction acoustic-electric transducer with two cavities. A diaphragm of the multi-order bandpass diaphragm 2921 may be used to convert sound pressure change caused by an audio signal 1505 on the diaphragm surface into a mechanical vibration of the diaphragm. The capacitance detection circuit 2931 may be used to detect a change of a capacitance between the diaphragm and a plate caused by the vibration of the diaphragm. The amplification circuit 2932 may be used to adjust an output voltage to a suitable amplitude. A sound hole may be provided in a first chamber, and the sound hole may be provided with an acoustic resistance material as required. A second chamber may be closed.

Figure 29B:
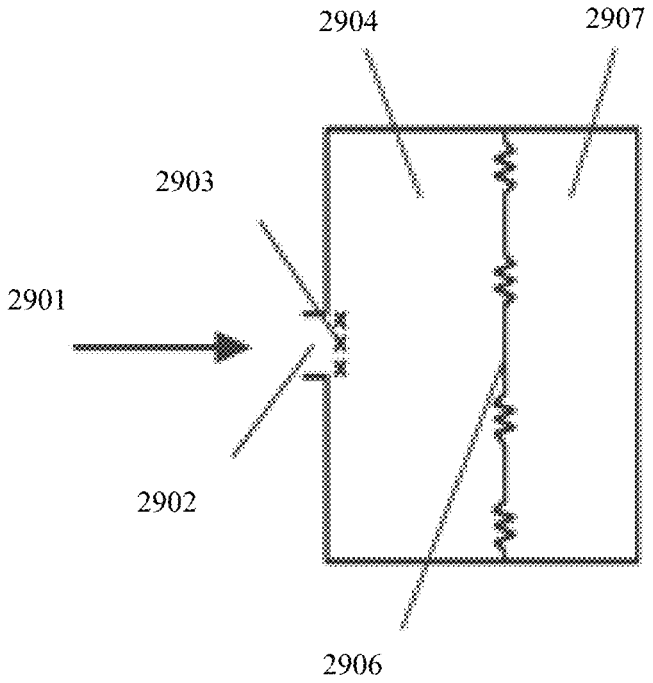
FIG. 29B is a schematic diagram of an exemplary acoustic force generator of the acoustic-electric transducer shown in FIG. 16A according to some embodiments of the present disclosure.

FIG. 29B is a schematic diagram of an exemplary acoustic force generator of the acoustic-electric transducer shown in FIG. 29A according to some embodiments of the present disclosure.

As described in connection with FIG. 27A, the first chamber with the sound hole may function as a second-order bandpass filter. In some embodiments, the diaphragm is configured as a composed vibration system. A system including the diaphragm and the second chamber (or referred to as the closed chamber) may function as a high-order (larger than second-order) bandpass filter. In some embodiments, the acoustic-electric transducer illustrated in FIG. 29B may have a higher order than the acoustic-electric transducer illustrated in FIG. 27A.

Figure 30:
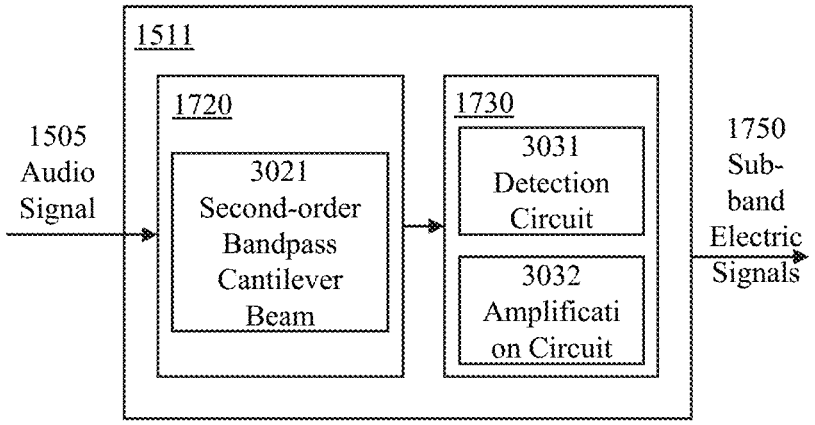
FIG. 30 is a schematic diagram of an exemplary acoustic-electric transducer according to some embodiments of the present disclosure.

FIG. 30 is a schematic diagram of an exemplary acoustic-electric transducer according to some embodiments of the present disclosure.

The acoustic-electric transducer 1511 may include a sound sensitive component 1720, and a circuit component 1730. The sound sensitive component 1720 may include a second-order bandpass cantilever 3021. The circuit component 1730 may include a detection circuit 3031, and an amplification circuit in 3032.

A cantilever may obtain audio signals transmitted to the cantilever, and cause changes of electric parameters of a cantilever material. The audio signal may include an air-conduction signal, a bone-conduction signal, a hydro audio signal, a mechanical vibration signal, or the like, or a combination thereof. The cantilever material may include a piezoelectric material. The piezoelectric material may include a piezoelectric ceramic or piezoelectric polymers. The piezoelectric ceramic may include PZT. The detection circuit 3031 may detect changes of electric signals of the cantilever material. The amplification circuit 3032 may adjust the amplitudes of the electric signals.

According to a circuit corresponding to the cantilever (which is similar to the circuit corresponding to the diaphragm in FIG. 19C), an impedance of the cantilever may be determined according to Equation (24) as follows:

$$Z = R + j\left(\omega M - \frac{K}{\omega}\right), \tag{24}$$

Where Z refers to the impedance of the cantilever, ω prefers to the angular frequency of the acoustic structure (e.g., the cantilever), j refers to a unit imaginary number, R refers to damping of the cantilever, M refers to the mass of the cantilever, and K refers to then elasticity coefficient of the cantilever.

In some embodiments, the cantilever may function as a second-order system, and an angular frequency may be determined according to Equation (25) as follows:

$$\omega_0 = \sqrt{\frac{K}{M}}, \tag{25}$$

where $\omega_0$ refers to the angular frequency, M refers to the mass of the cantilever, and K refers to then elasticity coefficient of the cantilever.

Cantilever vibration may have a resonant peak at its angular frequency. Thus, the audio signal may be filtered using the cantilever. Further, when a filter bandwidth is calculated at a half-power point, corresponding cutoff frequencies may be determined according to Equation (26) and Equation (27) as follows:

$$\omega_1 = \frac{\sqrt{R^2 + 4MK} - R}{2M}, \tag{26}$$

$$\omega_2 = \frac{\sqrt{R^2 + 4MK} \mp R}{2M}, \tag{27}$$

where R refers to damping of the cantilever, M refers to the mass of the cantilever, and K refers to then elasticity coefficient of the cantilever.

A quality factor of the cantilever filtering (referred as Q below) may be determined according to Equation (28) as follows:

$$Q = \frac{\omega_0}{\omega_2 - \omega_1} = \frac{\sqrt{MK}}{R}, \tag{28}$$

where R refers to damping of the cantilever, M refers to the mass of the cantilever, and K refers to then elasticity coefficient of the cantilever.

It can be seen that, after the angular frequency (center frequency) of the cantilever filter is determined, the quality factor Q of the cantilever filtering may be changed by adjusting the damping R. The smaller the damping R is, the larger the quality factor R is, the narrower the filter bandwidth is, and the sharper a filter frequency response curve is.

Figure 31:
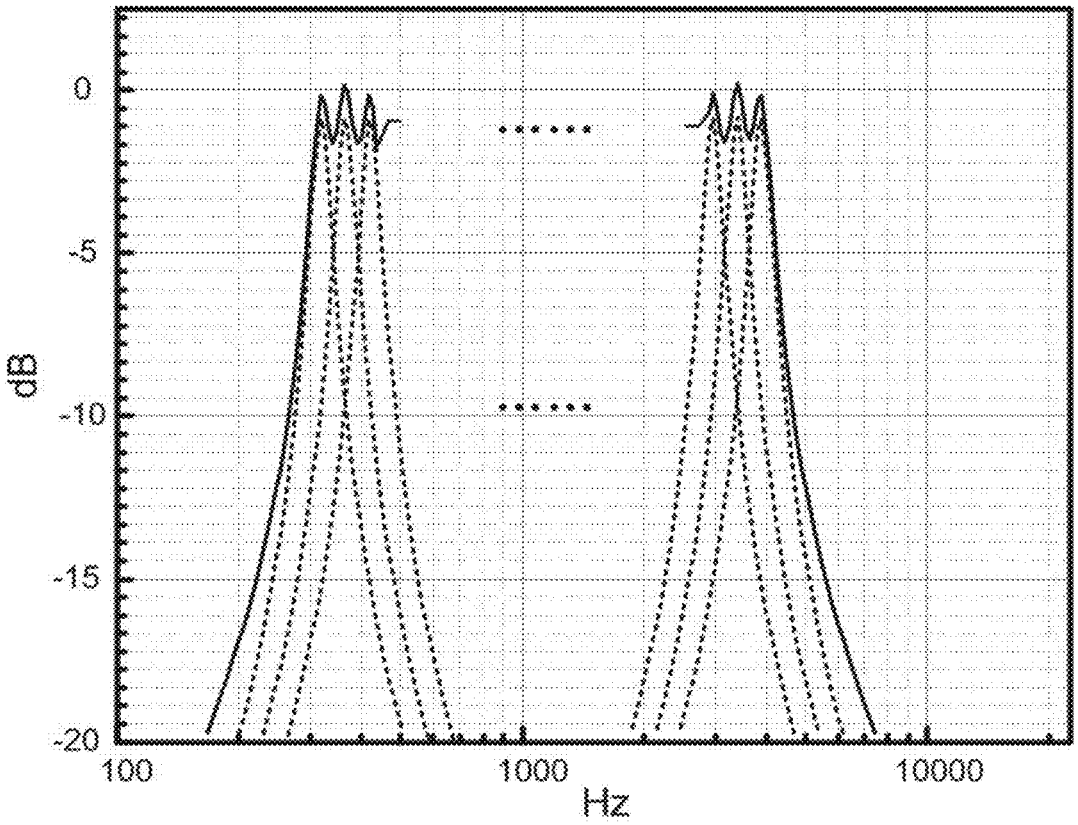
FIG. 31 illustrates an exemplary frequency response of an acoustic-electric transducing module according to some embodiments of the present disclosure.

FIG. 31 illustrates an exemplary frequency response of the acoustic-electric transducing module according to some embodiments of the present disclosure.

The acoustic-electric transducing module may include 19 acoustic-electric transducers. 19 dashed lines in FIG. 31 may represent the frequency responses of the 19 acoustic-electric transducers respectively. The solid line in FIG. 31 may indicate the frequency response of the acoustic-electric transducing module. As illustrated above, multiple acoustic-electric transducers, each of which may function as a bandpass filter for an audio signal, may be arranged in a same acoustic-electric transducing module, and generate sub-band signals according to an audio signal. As shown in FIG. 31, frequency responses of the 19 acoustic-electric transducers may cover a frequency band of 300 Hz-4000 Hz. The frequency response of the acoustic-electric transducing module may have a power level fluctuation within ±1 dB.

Figure 32A:
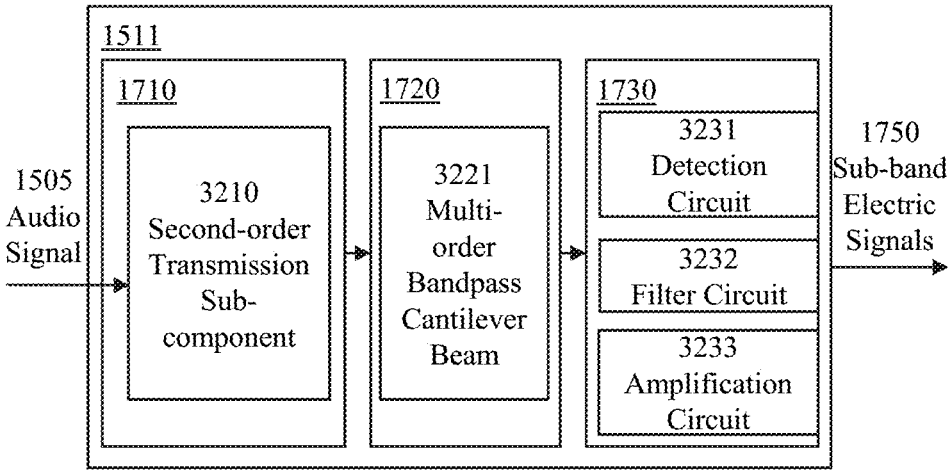
FIG. 32A is a schematic diagram of an exemplary acoustic-electric transducer according to some embodiments of the present disclosure.

FIG. 32A is a schematic diagram of an exemplary acoustic-electric transducer according to some embodiments of the present disclosure. The acoustic-electric transducer 1511 may include an acoustic channel component 1710, a sound sensitive component 1720, and a circuit component 1730. The acoustic channel component 1710 may include a second-order transmission sub-component 3210. The sound sensitive component 1720 may a multi-order bandpass cantilever 3221. The circuit component 1730 may include a detection circuit 3231, a filter circuit 3232, and an amplification circuit 3233.

A cantilever may obtain an audio signal, and cause changes of electric parameters of a cantilever material. The audio signal may include an air-conduction signal, a bone-conduction signal, a hydro audio signal, a mechanical vibration signal, etc. The cantilever material may include a piezoelectric material. The piezoelectric material may include a piezoelectric ceramic or piezoelectric polymers. The piezoelectric ceramic may include PZT. The detection circuit 3231 may detect changes of electric signals of the cantilever material. The amplification circuit 3233 may adjust the amplitude of the electric signals. In some embodiments, the suspension structure is connected with a base through an elastic member, and vibration of bone conduction audio signals acts on the suspension structure. The suspension structure and the corresponding elastic member may transmit the vibration to the cantilever and constitute an acoustic channel for transmitting the audio signal, which may function as a second-order bandpass filter. The cantilever attached to the suspension structure may also function as a second-order bandpass filter.

Figure 32B:
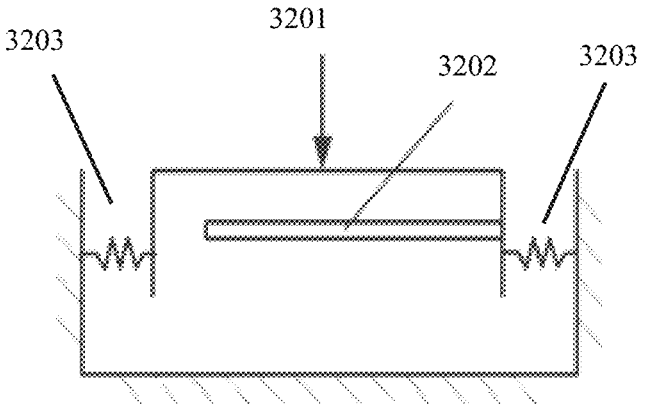
FIG. 32B is a schematic diagram of an exemplary cantilever according to some embodiments of the present disclosure.

FIG. 32B is a schematic diagram of an exemplary cantilever according to some embodiments of the present disclosure. As shown in FIG. 32B, a cantilever 3202 may connect to an elastic component 3203. An audio signal arriving at the elastic component (e.g., the elastic component 3203) may cause vibrations of the elastic component. The elastic component may transmit the vibrations to the cantilever 3202. The elastic component and the cantilever 3202 may be arranged in a same acoustic-electric transducing module 1510, which may function as a second-order bandpass filter. The cantilever can obtain an audio signal 3200 and cause changes in electric parameters of a cantilever material.

Figure 32C:
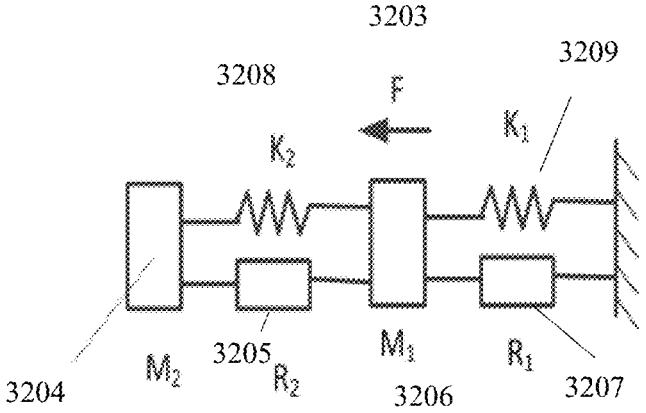
FIG. 32C is a schematic diagram of an exemplary mechanical model corresponding to the sound sensitive component according to some embodiments of the present disclosure.

FIG. 32C is a schematic diagram of an exemplary mechanical model corresponding to the sound sensitive component 1720 according to some embodiments of the present disclosure. The mechanical model may include a first cantilever 3202, a second cantilever 3201, a first elastic component 3208, a second elastic component 3209, a first damping component 3205, and a second damping component 3207. An end of the second elastic component 3209 may be fixed. An end of the second damping component 3207 may be fixed.

Figure 32D:
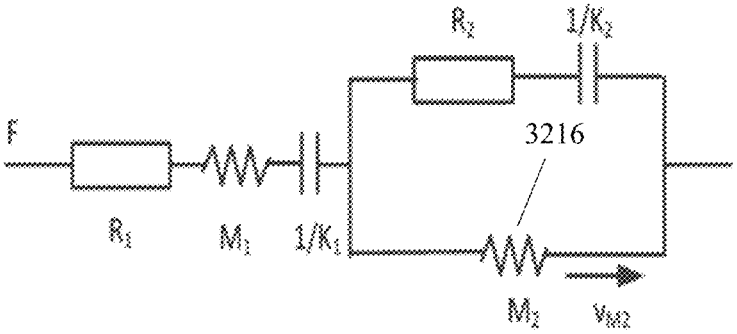
FIG. 32D is a schematic diagram of an exemplary equivalent circuit of the mechanical model shown in FIG. 19C according to some embodiments of the present disclosure.

FIG. 32D is a schematic diagram of an exemplary circuit of the mechanical model shown in FIG. 32C according to some embodiments of the present disclosure.

An impedance of the system (referred to as Z below) to the inputted signal may be determined according to Equation (29) as follows:

$$Z = Z_1 + Z_2 = R_1 + j\left(\omega M_1 - \frac{K_1}{\omega}\right) + \frac{j\omega M_2 R_2 + M_2 K_2}{R_2 + \left(\omega M_2 - \frac{K_2}{\omega}\right)}, \tag{29}$$

where ω refers to the angular frequency of the acoustic structure (e.g., the cantilever), j refers to a unit imaginary number, $Z_1$ refers to the impedance of the second cantilever 3201, $Z_2$ refers to the impedance of the first cantilever 3202, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the first cantilever 3202, $K_1$ refers to the elastic modulus of the second cantilever 3201, and $K_2$ refers to the elastic modulus of the first cantilever 3202.

The amplitude of the current in the circuit may correspond to a vibration velocity of the cantilever $M_2$; therefore, the vibration velocity $v_{M2}$ of the cantilever $M_2$ may be determined according to Equation (30) and Equation (31) as follows:

$$v_{M2} = F \cdot \frac{Z_2}{Z_1 + Z_2} / j\omega M_2, \tag{30}$$

$$= F \cdot \frac{R_2 + \frac{K_2}{j\omega}}{\left[\left[R_1 + j\left(\omega M_1 - \frac{K_1}{\omega}\right)\right][R_2 + j\left(\omega M_2 - \frac{K_2}{\omega}\right)] + j\omega M_2 R_2 + M_2 K_2\right]}, \tag{31}$$

where F refers to the sound force of an audio signal received, ω refers to the angular frequency of the acoustic structure (e.g., the cantilever), j refers to an unit imaginary number, $Z_1$ refers to the acoustic impedance of the second cantilever 3201, $Z_2$ refers to the acoustic impedance of the first cantilever 3202, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the second cantilever 3201, $K_1$ refers to the elastic modulus of the second cantilever 3201, and $K_2$ refers to the elastic modulus of the first cantilever 3202.

In some embodiments, the displacement $s_{M2}$ of the cantilever under the audio signal may be determined according to Equation (32) and Equation (33) as follows:

$$S_{M2} = \int v_{M2} \cdot e^{j\omega t} dt = \frac{1}{j\omega} \cdot v_{M2} \cdot e^{j\omega t}, \tag{32}$$

$$= F \cdot e^{j\omega t} \cdot \frac{\left(R_2 + \frac{K_2}{j\omega}\right) \cdot \frac{1}{j\omega}}{\left[\left[R_1 + j\left(\omega M_1 - \frac{K_1}{\omega}\right)\right][R_2 + j\left(\omega M_2 - \frac{K_2}{\omega}\right)] + j\omega M_2 R_2 + M_2 K_2\right]}, \tag{33}$$

where F refers to the sound force of an audio signal received, (prefers to the angular frequency of the acoustic structure (e.g., the cantilever), j refers to an unit imaginary number, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the second cantilever 3201, $K_1$ refers to the elastic modulus of the second cantilever 3201, and $K_2$ refers to the elastic modulus of the first cantilever 3202.

By performing a Laplace transform, the transfer function may be expressed as follows:

$$G(s) = \frac{R_2 s + K_2}{a_4 s^4 + a_3 s^3 + a_2 s^2 + a_1 s + a_0}, \tag{34}$$

and where $$a_0 = K_1 K_2, \tag{35}$$

$$a_1 = R_1 K_2 + R_2 K_1, \tag{36}$$

$$a_2 = R_1 R_2 + M_1 K_2 + M_2 K_1 + M_2 K_2, \tag{37}$$

$$a_3 = R_1 M_2 + R_2 M_1 + M_2 R_2, \tag{38}$$

$$a_4 = M_1 M_2. \tag{39}$$

It can be known from the transfer function that it is a fourth-order system, and an order of the band-pass filter can be increased by the above setting method. In addition, the filter circuit 3232 may be added in the circuit component 1730 so that the corresponding electric signal may be filtered. The above setting may cause a slope of the filtering frequency response edge of the sound-electric transducer to the audio signal to be larger, and filtering effect to be better.

Figure 33A:
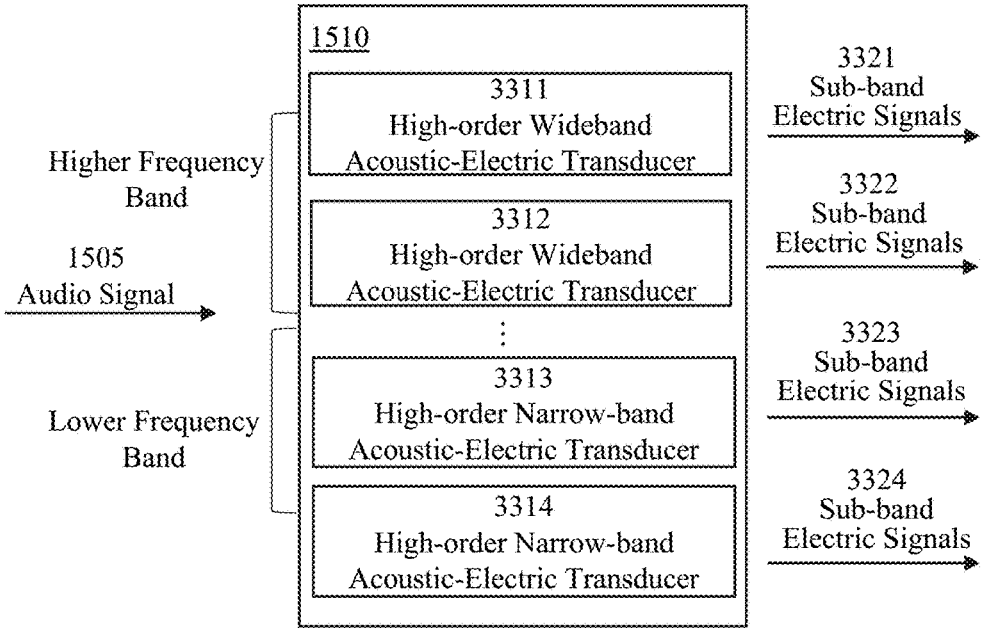
FIG. 33A is a schematic diagram of an exemplary acoustic-electric transducing module according to some embodiments of the present disclosure.

FIG. 33A is a schematic diagram of an exemplary acoustic-electric transducing module 1510 according to some embodiments of the present disclosure.

The acoustic-electric transducing module 1510 may generate sub-band signals according to an audio signal using a plurality of acoustic-electric transducers. The acoustic-electric transducers may function as bandpass filters. For different frequency bands to be processed, corresponding acoustic-electric transducers may be set to have a different frequency response. In some embodiments, the bandwidths of the acoustic-electric transducers in the acoustic-electric transducing module 1510 may be different. The bandwidth of the acoustic-electric transducer may be set to increase with its center frequency. In some embodiments, the acoustic-electric transducer may be a high-order acoustic-electric transducer. In some embodiments, for a low-middle frequency band, the corresponding acoustic-electric transducer may be high-order narrow-band. In a middle-high frequency band, the acoustic-electric transducer may be high-order wideband.

As shown in FIG. 33A, the acoustic-electric transducing module 1510 may include one or more high-order wideband acoustic-electric transducers (e.g., a high-order wideband acoustic-electric transducer 3311, 3312, etc.) in a middle-high frequency band, and one or more high-order narrow-band acoustic-electric transducers (e.g., a high-order narrow-band acoustic-electric transducer 3313, 3314, etc.) in a low-middle frequency band.

The acoustic-electric transducing module 1510 may obtain an audio signal 1505, and output a plurality of sub-band electric signals, e.g., sub-band electric signals 3321, 3322, 3323, . . . , 3324.

Figure 33B:
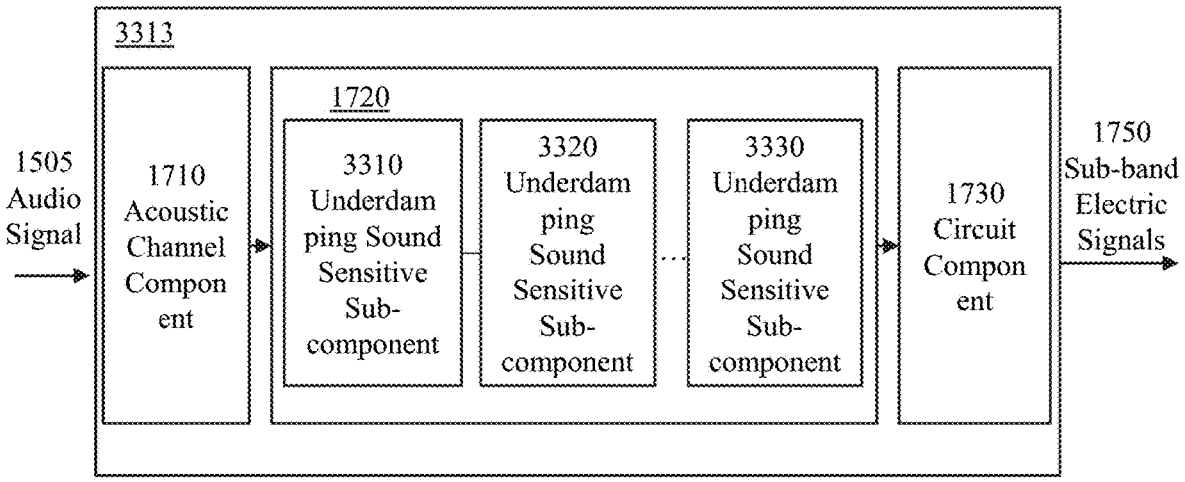
FIG. 33B is a schematic diagram of an exemplary high-order narrow-band acoustic-electric transducer according to some embodiments of the present disclosure.

FIG. 33B is a schematic diagram of an exemplary high-order narrow-band acoustic-electric transducer according to some embodiments of the present disclosure.

As shown in FIG. 33B, the high-order narrow-band acoustic-electric transducer 3313 may include an acoustic channel component 1710, a sound sensitive component 1720, and a circuit component 1730.

The sound sensitive component 1720 may include a plurality of underdamping sound-sensitive sub-components (e.g., underdamping sound-sensitive sub-components 3310, 3330, . . . , 3350). The plurality of underdamping sound-sensitive sub-components may be connected in series. Center frequencies of the underdamping sound-sensitive sub-components may be the same or close to each other. Multiple underdamping sound-sensitive sub-components being connected in series may increase the order of filtering characteristics of the sound sensitive component 1720. Each underdamping sound-sensitive sub-component may reduce bandwidth and achieve narrow-band filtering. In some embodiments, the transducer may function as a high-order narrow-band acoustic-electric transducer. As shown in FIG. 33B, the high-order narrow-band acoustic-electric transducer 3313 may obtain an audio signal 1505 and output a sub-band electric signal 1750 based on the audio signal 1505.

Figure 33C:
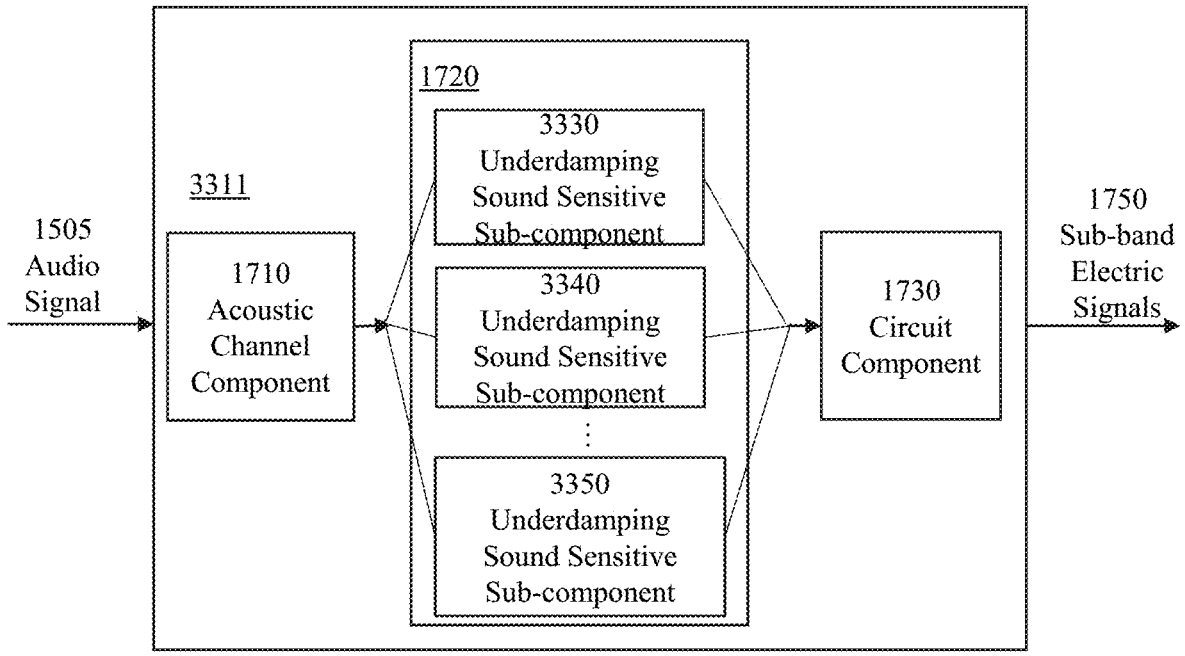
FIG. 33C is a schematic diagram of an exemplary high-order wideband acoustic-electric transducer according to some embodiments of the present disclosure.

FIG. 33C is a schematic diagram of an exemplary high-order wideband acoustic-electric transducer according to some embodiments of the present disclosure.

As shown in FIG. 33C, the high-order wideband acoustic-electric transducer 3311 may include an acoustic channel component 1710, a sound sensitive component 1720, and a circuit component 1730. The sound sensitive component 1720 may include a plurality of underdamping sound-sensitive sub-components (e.g., an underdamping sound-sensitive sub-component 3320, 3340, . . . , 3350). The plurality of underdamping sound-sensitive sub-components may be connected in parallel. Center frequencies of underdamping sound-sensitive sub-components may be different. The parallel connection of multiple underdamping sound-sensitive sub-components may broaden a bandwidth of the sound sensitive component 1720. In some embodiments, the high-order narrow-band acoustic-electric transducer 3311 may function as a high-order wideband acoustic-electric transducer. As shown in FIG. 33C, the high-order narrow-band acoustic-electric transducer 3311 may obtain an audio signal 1505 and output a sub-band electric signal 1750 accordingly.

Figure 34A:
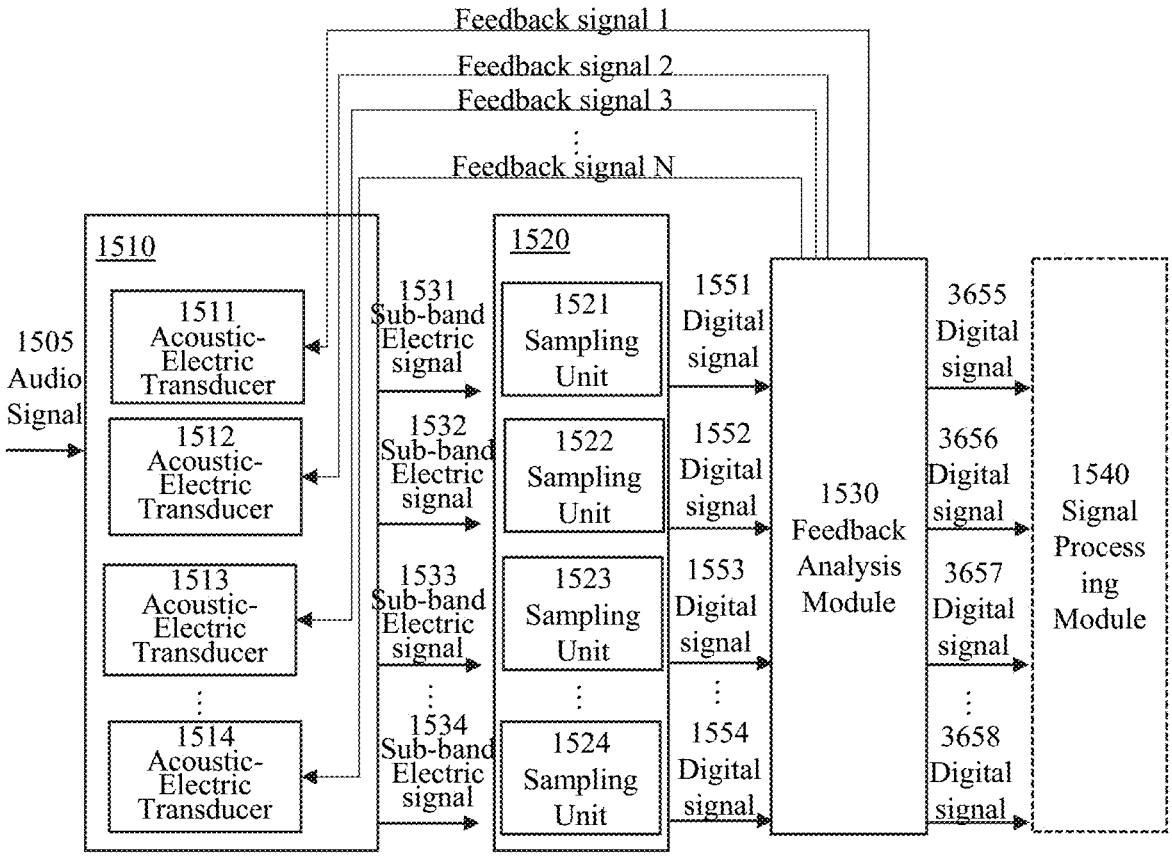
FIG. 34A is a schematic diagram of an exemplary signal processing device according to some embodiments of the present disclosure.

FIG. 34A is a schematic diagram of an exemplary signal processing device 3400 according to some embodiments of the present disclosure. The signal processing device 3400 may include an acoustic-electric transducing module 1510, a plurality of sampling modules (e.g., sampling units 1521, 1522, 1523, . . . , 1524), a feedback analysis module 1530 (or referred to as a feedback module), and a signal processing module 1540. The acoustic-electric transducing module 1510 may include a plurality of acoustic-electric transducers, (e.g., an acoustic-electric transducer 1511, 1512, 1513, . . . , 1514).

As shown in FIG. 34A, the acoustic-electric transducing module 1510 may obtain an audio signal 1505, and output a plurality of sub-band electric signals (e.g., sub-band electric signals 1531, 1532, 1533, . . . , 1534.

Each of the plurality of acoustic-electric transducer may convert the audio signal 1505 into a sub-band electric signal and output a corresponding sub-band electric signal.

Each of the plurality of sampling modules may sample a corresponding sub-band electric signal, convert the sub-band electric signal into a digital signal, and output the digital signal.

The feedback analysis module 1530 may obtain a plurality of digital signals (e.g., digital signals 1551, 1552, 1553, 1554) transmitted by the plurality of sampling modules. The feedback analysis module 1530 may analyze each digital signal corresponding to the sub-band electric signal, output a plurality of feedback signals (e.g., feedback signals 1, 2, 3, . . . , N) and transmit each feedback signal to a corresponding acoustic-electric transducer. The corresponding acoustic-electric transducer may adjust its parameters based on the feedback signal.

The signal processing module 1540 may obtain a plurality of digital signals (e.g., digital signals 3655, 3656, 3657, 3658) transmitted by the feedback analysis module 1530. A transmission mode of digital signals may be separately output through different parallel lines or may share one line according to a specific transmission protocol.

Figure 34B:
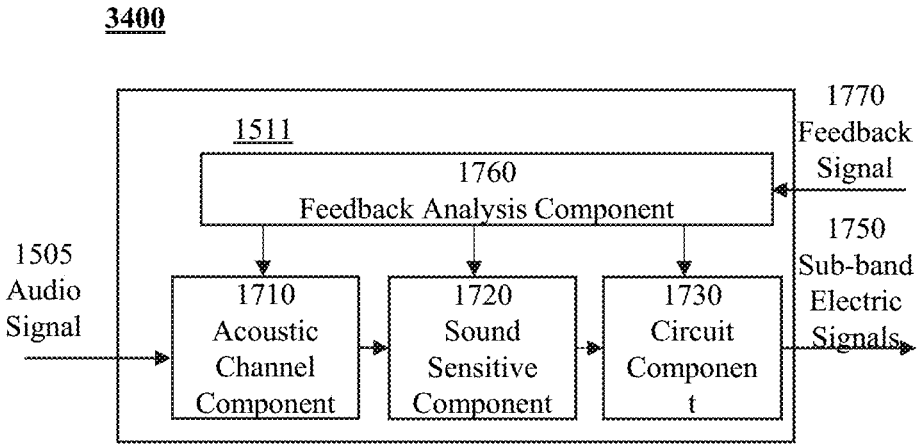
FIG. 34B is a schematic diagram of an exemplary acoustic-electric transducer according to some embodiments of the present disclosure.

FIG. 34B is a schematic diagram of an exemplary acoustic-electric transducer 1511 according to some embodiments of the present disclosure. The acoustic-electric transducer 1511 may include an acoustic channel component 1710, a sound sensitive component 1720, a circuit component 1730, and a feedback processing component 1760.

The feedback processing component 1760 may be configured to obtain a feedback signal 1770 from the feedback analysis module 1530 and adjust parameters of the acoustic-electric transducer 1511.

In some embodiments, the feedback processing component 1760 may adjust at least one of the acoustic channel component 1710, the sound sensitive component 1720, and the circuit component 1730.

In some embodiments, the feedback processing component 1760 may adjust parameters (e.g., size, position, and connection manner) of the acoustic channel component to adjust filtering characteristics of the acoustic channel component 1710 using electromechanical control systems. Exemplary electromechanical control systems may include pneumatic mechanisms, motor-driven mechanisms, hydraulic actuators, or the like, or a combination thereof.

In some embodiments, the feedback processing component 1760 may adjust parameters (e.g., size, position, or connection manner) of the sound sensitive component 1720 to adjust filtering characteristics of the sound sensitive component using electromechanical control systems.

In some embodiments, the feedback processing component 1760 may include a feedback circuit that is directly coupled to the circuit component 1730 to adjust the circuit component 1730.

Figure 35:
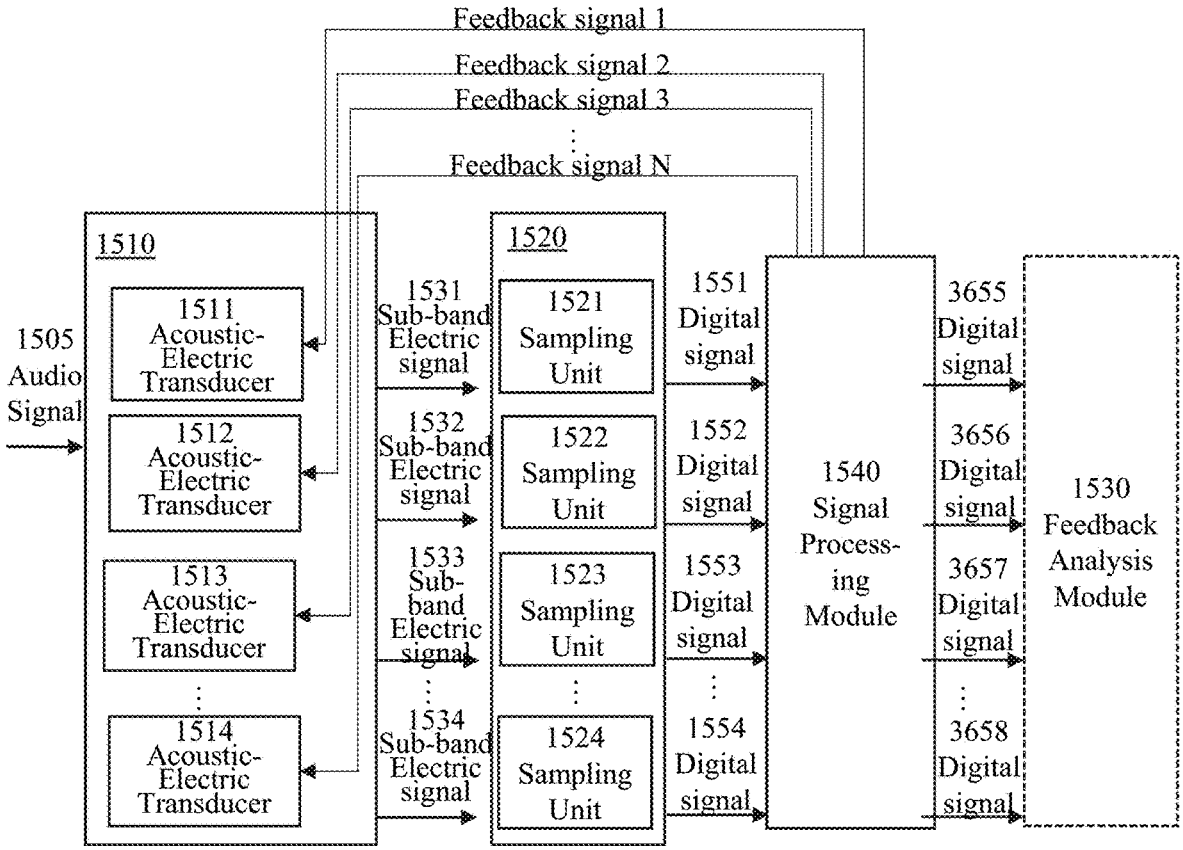
FIG. 35 is a schematic diagram of an exemplary signal processing device according to some embodiments of the present disclosure.

FIG. 35 is a schematic diagram of an exemplary signal processing device 3500 according to some embodiments of the present disclosure. The signal processing device 3500 may include an acoustic-electric transducing module 1510, a plurality of sampling units (e.g., sampling units 1521, 1522, 1522, . . . , and 1524), a feedback analysis module 1530, and a signal processing module 1540.

The acoustic-electric transducing module 1510 may include a plurality of acoustic-electric transducers, (e.g., acoustic-electric transducers 1511, 1512, 1513, . . . , 1514).

As shown in FIG. 35, the acoustic-electric transducing module 1510 may obtain an audio signal 1505 and output a plurality of sub-band electric signals (e.g., sub-band electric signals 1531, 1532, 1533, . . . , 1534).

Each of the plurality of acoustic-electric transducer may convert the audio signal 1505 into a corresponding sub-band electric signal output the corresponding sub-band electric signal. Each of the plurality of sampling units may sample a corresponding sub-band electric signal, convert the sub-band electric signal into a digital signal, and output the digital signal.

The signal processing module 1540 may obtain the plurality of digital signals (e.g., digital signals 1551, 1552, 1553, 1554) transmitted by the plurality of sampling units. Digital signals may be separately output through different parallel lines or may share one line according to a specific transmission protocol.

The feedback analysis module 1530 may obtain a plurality of digital signals (e.g., digital signals 3655, 3656, 3657, 3658) transmitted by the signal processing module 1540. The feedback analysis module 1530 may analyze each digital signal corresponding to a sub-band electric signal, output a plurality of feedback signals (e.g., feedback signals 1, 2, 3, . . . , N) and transmit each feedback signal to a corresponding acoustic-electric transducer. The corresponding acoustic-electric transducer may adjust its parameters based on the feedback signal.

The acoustic-electric transducer 1511 in the signal processing device 3500 may be similar to the acoustic-electric transducer 1511 in the signal processing device 3400. More detailed descriptions about the acoustic-electric transducer 1511 in the signal processing device 3500 may be found elsewhere in the present disclosure (e.g., FIG. 34B and the descriptions thereof).

Figure 36:
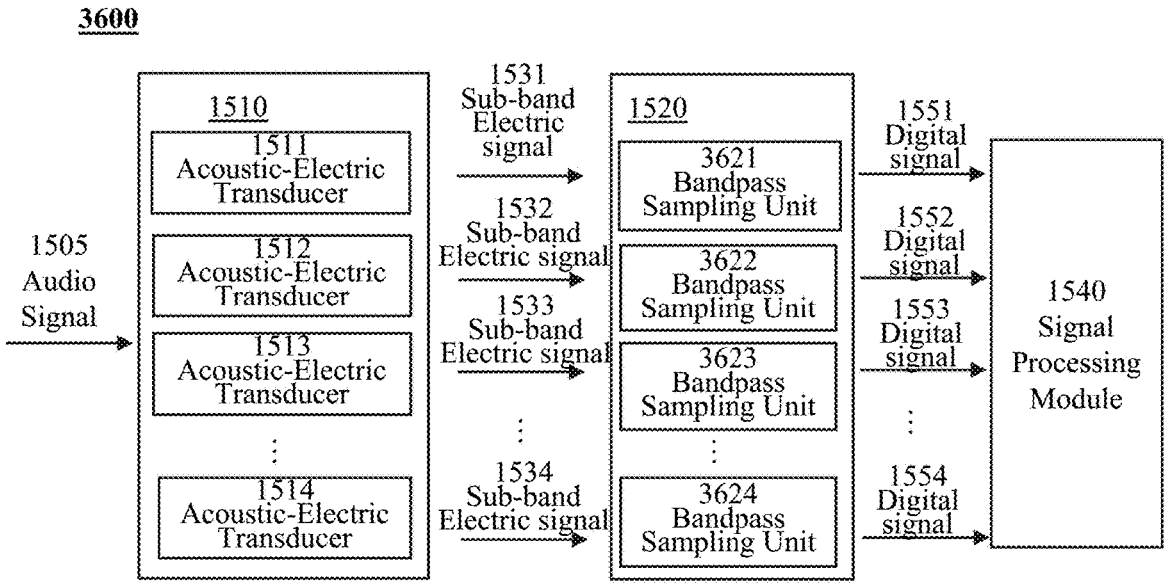
FIG. 36 is a schematic diagram of an exemplary signal processing device according to some embodiments of the present disclosure.

FIG. 36 is a schematic diagram of an exemplary signal processing device 15300 according to some embodiments of the present disclosure. The signal processing device 15300 may include an acoustic-electric transducing module 1510, a plurality of bandpass sampling modules (e.g., bandpass sampling modules 3621, 3622, 3623, . . . , 3624), and a signal processing module 1540.

The acoustic-electric transducing module 1510 may include a plurality of acoustic-electric transducers (e.g., acoustic-electric transducers 1511, 1512, 1513, . . . , 1514).

As shown in FIG. 36, the acoustic-electric transducing module 1510 may obtain an audio signal 1505 and output a plurality of sub-band electric signals. Each of the plurality of acoustic-electric transducer may convert the audio signal 1505 into a corresponding sub-band electric signal output the corresponding sub-band electric signal. Each of the plurality of bandpass sampling modules may sample a corresponding sub-band electric signal, convert the sub-band electric signal into a digital signal, and output the digital signal. The signal processing module 1540 may obtain a plurality of digital signals transmitted by the plurality of bandpass sampling modules.

Figure 37:
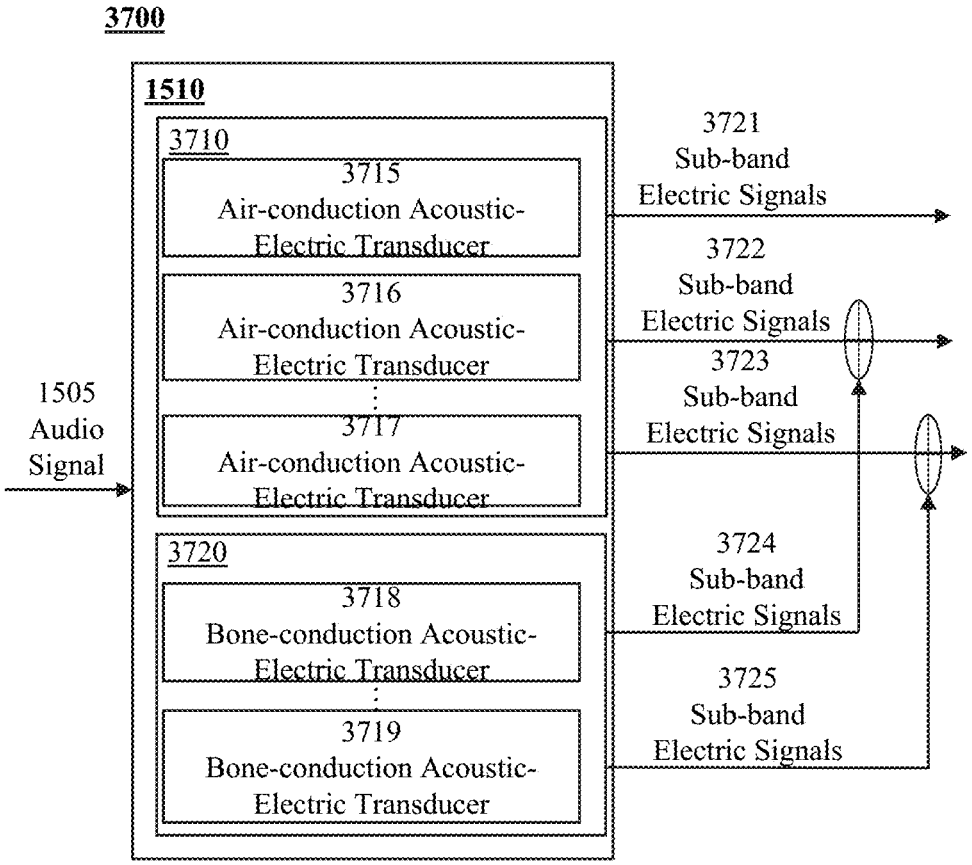
FIG. 37 is a schematic diagram of an exemplary signal processing device according to some embodiments of the present disclosure.

FIG. 37 is a schematic diagram of an exemplary signal processing device 3700 according to some embodiments of the present disclosure. The acoustic-electric transducing module 1510 may include one or more air-conduction acoustic-electric transducer 3710 (e.g., air-conduction acoustic-electric transducer 3715, 3716, and 3717) and one or more bone-conduction acoustic-electric transducers 3720 (e.g., bone-conduction acoustic-electric transducer 3718, 3719). An air-conduction acoustic-electric transducer may decompose the audio signal detected to one or more sub-band electric signals. A bone-conduction acoustic-electric transducer may decompose the detected audio signal into one or more sub-band electric signals.

Air-conduction acoustic-electric transducers may detect the audio signal and output a plurality of sub-band electric signals. Each air-conduction acoustic-electric transducer may output a corresponding sub-band electric signal. For example, the air-conduction acoustic-electric transducer 3715, 2517, 3718 may detect the audio signal respectively, and correspondingly output sub-band electric signals 3721, 3722, 3723.

Bone-conduction acoustic-electric transducers may detect the audio signal and output a plurality of sub-band electric signals. Each bone-conduction acoustic-electric transducer may output a corresponding sub-band electric signal. For example, the bone-conduction acoustic-electric transducer 3718 and 3719 may detect the audio signal respectively, and correspondingly output the sub-band electric signals 3724 and 3715.

In some embodiments, at the same frequency band, the sub-band electric signal output by the bone-conduction acoustic-electric transducer may be used to enhance the signal-to-noise ratio (SNR) of the sub-band electric signals output by the air-conduction acoustic-electric transducer. For example, the sub-band electric signal 3722 generated by the air-conduction acoustic-electric transducer 3716 may superpose the sub-band electric signal 3724 generated by the bone-conduction acoustic-electric transducer 3718. The sub-band electric signal 3724 may have higher SNR with respect to the sub-band electric signal 3722. The sub-band electric signal 3723 output by the air-conduction acoustic-electric transducer 3717 may superpose the sub-band electric signal 3725 output by the bone-conduction acoustic-electric transducer 3719. The sub-band electric signal 3725 may have a higher SNR than that of the sub-band electric signal 3723.

In some embodiments, the air-conduction acoustic-electric transducer 2401 may be used to supplement a frequency band that cannot be covered by the sub-band electric signals output by the bone-conduction acoustic-electric transducer 2402.

Figure 38:
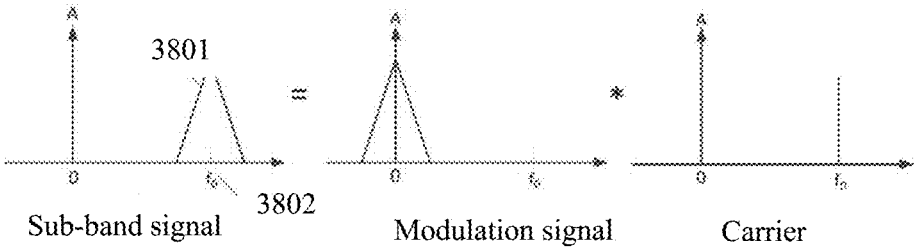
FIG. 38 is a schematic diagram illustrating an exemplary signal modulation process according to some embodiments of the present disclosure.

FIG. 38 is a schematic diagram illustrating exemplary signal modulation process according to some embodiments of the present disclosure. As shown in FIG. 38, a sub-band electric signal may include a frequency domain envelope 3801.

Each sub-band electric signal may be considered as a signal (or referred to as a modulation signal) having a frequency domain envelope (which is the same as the frequency domain envelope 3801) that is modulated by a corresponding center frequency signal as a carrier to the center frequency 3802. That is, the sub-band electric signal may include two parts. One part is a signal having a frequency domain envelope (which is same as the frequency domain envelope 3801) as a modulation signal, and the other part is a signal having a center frequency (which is the same as the center frequency 3802) as a carrier.

Main information of the sub-band electric signal is concentrated in the frequency domain envelope. Therefore, when the sub-band electric signal is sampled, it is necessary to ensure that the frequency domain envelope is effectively sampled, and a sampling frequency is not less than 2 times a bandwidth of the sub-band electric signal. After sampling, the second signal having a frequency (which is the same as the center frequency 3802) may be used as the carrier to restore the sub-band electric signal. Thus, the sub-band electric signal may be sampled using the bandpass sampling module. Specifically, the sampling frequency may be not less than 2 times the bandwidth and not more than 4 times the bandwidth. The sampling frequency $f_s$ is set according to Equation (40) as follows:

$$f_s=2f_B(r_1/r_2) \quad (40),$$

where $f_B$ refers to the bandwidth of the sub-band electric signal, and $$r_1 = \frac{[f_0 + (f_B/2)]}{f_B}, \quad (41)$$

where $f_0$ refers to the center frequency of the sub-band electric signal, and $r_2$ is a largest integer less than $r_1$.

To implement various modules, units, and their functionalities described in the present disclosure, computer hardware platforms may be used as the hardware platform(s) for one or more of the elements described herein. A computer with user interface elements may be used to implement a personal computer (PC) or any other type of work station or terminal device. A computer may also act as a server if appropriately programmed.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. A bone conduction speaker, comprising a vibration device and a plurality of acoustic-electric transducers, wherein the vibration device includes a vibration conductive plate and a vibration board, the vibration conductive plate is physically connected with the vibration board, vibrations generated by the vibration conductive plate and the vibration board have at least two resonance peaks, frequencies of the at least two resonance peaks being in a range of 80 Hz-18000 Hz, and sounds are generated by the vibrations transferred through a human bone; and the plurality of acoustic-electric transducers includes a first acoustic-electric transducer having a first frequency response and a second acoustic-electric transducer having a second frequency response, the second frequency response being different from the first frequency response, wherein the first acoustic-electric transducer is configured to detect an audio signal, and generate a first sub-band signal according to the audio signal; and the second acoustic-electric transducer is configured to detect the audio signal, and generate a second sub-band signal according to the audio signal.

2. The bone conduction speaker according to claim 1, wherein the first acoustic-electric transducer has a first frequency width, and the second acoustic-electric transducer has a second frequency width different from the first frequency width.

3. The bone conduction speaker of claim 2, wherein the second frequency width is larger than the first frequency width, and a second center frequency of the second acoustic-electric transducer is higher than a first center frequency of the first acoustic-electric transducer.

4. The bone conduction speaker of claim 2, wherein the first frequency response and the second frequency response intersect at a point which is near a half-power point of the first frequency response and a half-power point of the second frequency response.

5. The bone conduction speaker of claim 1, further comprising:

a first sampling module connected to the first acoustic-electric transducer and configured to sample the first sub-band signal to generate a first sampled sub-band signal; and a second sampling module connected to the second acoustic-electric transducer and configured to sample the second sub-band signal to generate a second sampled sub-band signal.

6. The bone conduction speaker of claim 5, further comprising a feedback module configured to adjust at least one of the first acoustic-electric transducer or the second acoustic-electric transducer.

7. The bone conduction speaker of claim 6, wherein the feedback module is configured to adjust the at least one of the first acoustic-electric transducer or the second acoustic-electric transducer according to at least one of the first sampled sub-band signal or the second sampled sub-band signal.

8. The bone conduction speaker of claim 6, further comprising a processing module configured to process the first sampled sub-band signal and the second sampled sub-band signal to generate a first processed sub-band signal and a second processed sub-band signal, wherein the feedback module is configured to adjust the at least one of the first acoustic-electric transducer or the second acoustic-electric transducer according to the first processed sub-band signal or the second processed sub-band signal.

9. The bone conduction speaker of claim 1, wherein the first acoustic-electric transducer includes a sound sensitive component and an acoustic channel component, the sound sensitive component being configured to generate an electric signal according to the audio signal.

10. The bone conduction speaker of claim 9, wherein:

the acoustic channel component includes a second-order component; and the sound sensitive component includes a multi-order bandpass diaphragm.

11. The bone conduction speaker of claim 1, wherein the first acoustic-electric transducer includes a first-order bandpass filter or a multi-order bandpass filter.

12. The bone conduction speaker of claim 1, wherein the bone conduction speaker includes at least one of:

no more than 10 first-order acoustic-electric transducers, wherein each first-order acoustic-electric transducer corresponds to a frequency band whose width is no larger than 20 kHz;

no more than 20 second-order acoustic-electric transducers, wherein each second-order acoustic-electric transducer corresponds to a frequency band whose width is no larger than 20 kHz;

no more than 30 third-order acoustic-electric transducers, wherein each third-order acoustic-electric transducer corresponds to a frequency band whose width is no larger than 20 kHz; or no more than 40 fourth-order acoustic-electric transducers, wherein each fourth-order acoustic-electric transducer corresponds to a frequency band whose width is no larger than 20 kHz.

13. The bone conduction speaker of claim 1, wherein the bone conduction speaker includes at least one of:

no more than 8 first-order acoustic-electric transducers, wherein each first-order acoustic-electric transducer corresponds to a frequency band whose width is no larger than 8 kHz;

no more than 13 second-order acoustic-electric transducers, wherein each second-order acoustic-electric transducer corresponds to a frequency band whose width is no larger than 8 kHz;

no more than 19 third-order acoustic-electric transducers, wherein each third-order acoustic-electric transducer corresponds to a frequency band whose width is no larger than 8 kHz; or no more than 26 fourth-order acoustic-electric transducers, wherein each fourth-order acoustic-electric transducer corresponds to a frequency band whose width is no larger than 8 kHz.

14. The bone conduction speaker of claim 1, wherein the first acoustic-electric transducer is a high-order wideband acoustic-electric transducer, and the second acoustic-electric transducer is a high-order narrow-band acoustic-electric transducer.

15. The bone conduction speaker of claim 14, wherein the high-order wideband acoustic-electric transducer includes a plurality of underdamping sound sensitive components connected in parallel.

16. The bone conduction speaker of claim 15, wherein the plurality of underdamping sound sensitive components include a first underdamping sound sensitive component having a fourth frequency response, a second underdamping sound sensitive component having a fifth frequency response, and a third underdamping sound sensitive component having a sixth frequency response, wherein:

a fifth center frequency of the second underdamping sound sensitive component is higher than a fourth center frequency of the first underdamping sound sensitive, and a sixth center frequency of the third underdamping sound sensitive component is higher than the fifth center frequency of the second underdamping sound sensitive, and the fourth frequency response and the fifth frequency response intersect at a point which is near a half-power point of the fourth frequency response and a half-power point of the fifth frequency response.

17. The bone conduction speaker of claim 15, wherein the plurality of underdamping sound sensitive components include a first underdamping sound sensitive component having a fourth frequency response, and a second underdamping sound sensitive component having a fifth frequency response, wherein:

the fourth frequency response and the fifth frequency response intersect at a point which is near a half-power point of the fourth frequency response and a half-power point of the fifth frequency response.

18. The bone conduction speaker of claim 14, wherein the high-order narrow-band acoustic-electric transducer includes a plurality of underdamping sound sensitive components connected in series.

19. The bone conduction speaker according to claim 1, wherein the vibration conductive plate includes a first torus and at least two first rods, the at least two first rods converging to a center of the first torus.

20. The bone conduction speaker according to claim 19, wherein the vibration board includes a second torus and at least two second rods, the at least two second rods converging to a center of the second torus.

* * * * *